US009027673B2

(12) United States Patent
Vail, III et al.

(10) Patent No.: US 9,027,673 B2
(45) Date of Patent: May 12, 2015

(54) UNIVERSAL DRILLING AND COMPLETION SYSTEM

(75) Inventors: William Banning Vail, III, Bothell, WA (US); Robert L. Dekle, Tulsa, OK (US); Damir S. Skerl, Houston, TX (US); James E. Chitwood, Spring, TX (US)

(73) Assignee: Smart Drilling and Completion, Inc., Bothell, WA (US)

( * ) Notice: Subject to any disclaimer, the term of this patent is extended or adjusted under 35 U.S.C. 154(b) by 610 days.

(21) Appl. No.: 13/068,133

(22) Filed: May 2, 2011

(65) Prior Publication Data

US 2011/0214920 A1 Sep. 8, 2011

Related U.S. Application Data

(63) Continuation-in-part of application No. 12/653,740, filed on Dec. 17, 2009, now Pat. No. 8,651,177.

(60) Provisional application No. 61/274,215, filed on Aug. 13, 2009, provisional application No. 61/395,081, filed on May 6, 2010, provisional application No. 61/396,030, filed on May 19, 2010, provisional application No. 61/396,420, filed on May 25, 2010, provisional application No. 61/396,940, filed on Jun. 5, 2010, provisional application No. 61/465,608, filed on (Continued)

(51) Int. Cl.
*E21B 7/00* (2006.01)
*E21B 33/10* (2006.01)
*E21B 10/00* (2006.01)

(52) U.S. Cl.
CPC . *E21B 7/00* (2013.01); *E21B 33/10* (2013.01); *E21B 10/00* (2013.01)

(58) Field of Classification Search
USPC ..... 175/57, 65, 81, 336, 371, 38, 94, 100; 166/129, 132
See application file for complete search history.

(56) References Cited

U.S. PATENT DOCUMENTS 2,233,692 A * 3/1941 Bryant ..... 175/210
2,764,387 A * 9/1956 Dionisotti ..... 175/212

(Continued)

FOREIGN PATENT DOCUMENTS

WO WO2009065523 * 5/2009
WO WO 2011/140426 11/2011

OTHER PUBLICATIONS

International Search Report and Written Opinion for International (PCT) Patent Application No. PCT/US11/35496 (now published as WO 2011/140426) mailed Aug. 11, 2011, 9 pages.

(Continued)

*Primary Examiner* — Kenneth L Thompson
*Assistant Examiner* — Michael Wills, III
(74) *Attorney, Agent, or Firm* — Sheridan Ross P.C.

(57) ABSTRACT

Methods and apparatus are described to drill and complete wellbores. Such wellbores include extended reach horizontal wellbores, for example in shales, deep subsea extended reach wellbores, and multilateral wellbores. Specifically, the invention provides simple threaded subassemblies that are added to existing threaded tubular drilling and completion equipment which are used to dramatically increase the lateral reach using that existing on-site equipment. These subassemblies extract power from downward flowing clean mud, or other fluids, in an annulus to provide additional force or torque on tubular elements within the wellbore, while maintaining circulation, to extend the lateral reach of the drilling equipment and completion equipment. These added elements include combinations of The Leaky Seal™, a Cross-Over, The Force Sub™ and The Torque Sub™. The use of such additional simple elements allow lighter drilling equipment to be used to reach a given lateral distance, therefore reducing drilling costs.

17 Claims, 31 Drawing Sheets

Related U.S. Application Data

Mar. 22, 2011, provisional application No. 61/397,848, filed on Jun. 16, 2010, provisional application No. 61/399,110, filed on Jul. 6, 2010, provisional application No. 61/399,938, filed on Jul. 20, 2010, provisional application No. 61/401,974, filed on Aug. 19, 2010, provisional application No. 61/404,970, filed on Oct. 12, 2010, provisional application No. 61/455,123, filed on Oct. 13, 2010, provisional application No. 61/456,986, filed on Nov. 15, 2010, provisional application No. 61/458,403, filed on Nov. 22, 2010, provisional application No. 61/458,490, filed on Nov. 24, 2010, provisional application No. 61/459,896, filed on Dec. 20, 2010, provisional application No. 61/460,053, filed on Dec. 23, 2010, provisional application No. 61/461,266, filed on Jan. 14, 2011, provisional application No. 61/462,393, filed on Feb. 2, 2011, provisional application No. 61/517,218, filed on Apr. 15, 2011.

(56) References Cited

U.S. PATENT DOCUMENTS

| | | | | |
|---|---|---|---|---|
| 3,823,788 | A | 7/1974 | Garrison et al. | |
| 4,244,431 | A * | 1/1981 | Johnson | 175/320 |
| 4,354,559 | A * | 10/1982 | Johnson | 175/71 |
| 6,189,621 | B1 | 2/2001 | Vail, III | |
| 6,374,838 | B1 | 4/2002 | Baugh | |
| 6,397,946 | B1 | 6/2002 | Vail, III | |
| 6,561,280 | B1 | 5/2003 | Baugh et al. | |
| 7,108,080 | B2 * | 9/2006 | Tessari et al. | 175/21 |
| 7,311,151 | B2 * | 12/2007 | Chitwood et al. | 166/367 |
| 8,240,397 | B2 | 8/2012 | Crawford et al. | |
| 8,651,177 | B2 | 2/2014 | Vail, III et al. | |
| 2005/0098349 | A1 | 5/2005 | Krueger et al. | |
| 2006/0144620 | A1 * | 7/2006 | Cooper et al. | 175/57 |
| 2006/0283636 | A1 * | 12/2006 | Reagan | 175/107 |
| 2007/0278007 | A1 * | 12/2007 | Krueger et al. | 175/25 |
| 2007/0278011 | A1 * | 12/2007 | Barnett | 175/65 |
| 2009/0025930 | A1 * | 1/2009 | Iblings et al. | 166/244.1 |
| 2009/0308656 | A1 | 12/2009 | Chitwood et al. | |
| 2010/0319995 | A1 * | 12/2010 | Johnson | 175/57 |
| 2011/0005834 | A1 * | 1/2011 | Crawford et al. | 175/48 |

OTHER PUBLICATIONS

International Preliminary Report on Patentability for International (PCT) Patent Application No. PCT/US11/35496 (now published as WO 2011/140426) mailed Nov. 15, 2012, 8 pages.

* cited by examiner from WO 94/13925
(Vestavik)

UNIVERSAL DRILLING AND COMPLETION SYSTEM

PRIORITY FROM A U.S. PATENT APPLICATION

The present application is a continuation-in-part (C.I.P.) application of U.S. patent application Ser. No. 12/653,740, filed on Dec. 17, 2009 now U.S. Pat. No. 8,651,177, that is entitled "Long-Lasting Hydraulic Seals for Smart Shuttles, for Coiled Tubing Injectors, and for Pipeline Pigs", an entire copy of which is incorporated herein by reference.

U.S. patent application Ser. No. 12/653,740, filed on Dec. 17, 2009, claimed priority from U.S. Provisional Patent Application No. 61/274,215, filed on Aug. 13, 2009, that is entitled "Long-Lasting Hydraulic Seals for Smart Shuttles, for Coiled Tubing Injectors, and for Pipeline Pigs", an entire copy of which is incorporated herein by reference.

Applicant claims priority for this application to the above U.S. patent application Ser. No. 12/653,740, filed on Dec. 17, 2009.

Applicant also claims priority for this application to the above U.S. Provisional Patent Application No. 61/274,215, filed on Aug. 13, 2009.

PRIORITY FROM CURRENT U.S. PROVISIONAL PATENT APPLICATIONS

Applicant claims priority for this application to U.S. Provisional Patent Application No. 61/395,081, filed May 6, 2010, that is entitled "Annular Pressure Smart Shuttle", an entire copy of which is incorporated herein by reference.

Applicant claims priority for this application to U.S. Provisional Patent Application No. 61/396,030, filed on May 19, 2010, that is entitled "The Hydroelectric Drilling Machine", an entire copy of which is incorporated herein by reference.

Applicant claims priority for this application to U.S. Provisional Patent Application No. 61/396,420, filed on May 25, 2010, that is entitled "Universal Drilling and Completion System", an entire copy of which is incorporated herein by reference.

Applicant claims priority for this application to U.S. Provisional Patent Application No. 61/396,940, filed on Jun. 5, 2010, that is entitled "Subterranean Drilling Machine with Counter-Rotating Cutters", an entire copy of which is incorporated herein by reference.

Applicant claims priority for this application to U.S. Provisional Patent Application No. 61/465,608, filed on Mar. 22, 2011, that is entitled "Drilling Machine with Counter-Rotating Cutters to Drill Multiple Slots in a Formation to Produce Hydrocarbons", an entire copy of which is incorporated herein by reference.

Applicant claims priority for this application to U.S. Provisional Patent Application No. 61/397,848, filed on Jun. 16, 2010, that is entitled "Modified Pelton Type Tangential Turbine Hydraulic Drives to Replace Electric Motors in Electrical Submersible Pumps", an entire copy of which is incorporated herein by reference.

Applicant claims priority for this application to U.S. Provisional Patent Application No. 61/399,110, filed on Jul. 6, 2010, that is entitled "Hydraulic Subsea System Used to Remove Hydrocarbons From Seawater in the Event of a Seafloor Oil/Gas Well Failure", an entire copy of which is incorporated herein by reference.

Applicant claims priority for this application to U.S. Provisional Patent Application No. 61/399,938, filed on Jul. 20, 2010, that is entitled "Deep Upweller", an entire copy of which is incorporated herein by reference.

Applicant claims priority for this application to U.S. Provisional Patent Application No. 61/401,974, filed on Aug. 19, 2010, that is entitled "Universal Drilling and Completion System and Deep Upweller", an entire copy of which is incorporated herein by reference.

Applicant claims priority for this application to U.S. Provisional Patent Application No. 61/404,970, filed on Oct. 12, 2010, that is entitled "UDCS and Pelton-like Turbine Powered Pumps", an entire copy of which is incorporated herein by reference.

Applicant claims priority for this application to U.S. Provisional Patent Application No. 61/455,123, filed on Oct. 13, 2010, that is entitled "UDCS Presentation", an entire copy of which is incorporated herein by reference.

Applicant claims priority for this application to U.S. Provisional Patent Application No. 61/456,986, filed on Nov. 15, 2010, that is entitled "New Vane Mud Motor for Downhole Drilling Applications", an entire copy of which is incorporated herein by reference.

Applicant claims priority for this application to U.S. Provisional Patent Application No. 61/458,403, filed on Nov. 22, 2010, that is entitled "Leaky Seal for Universal Drilling and Completion System", an entire copy of which is incorporated herein by reference.

Applicant claims priority for this application to U.S. Provisional Patent Application No. 61/458,490, filed on Nov. 24, 2010, that is entitled "Transverse Flow Channel Mud Motor", an entire copy of which is incorporated herein by reference.

Applicant claims priority for this application to U.S. Provisional Patent Application No. 61/459,896, filed on Dec. 20, 2010, that is entitled "The Force Sub", an entire copy of which is incorporated herein by reference.

Applicant claims priority for this application to U.S. Provisional Patent Application No. 61/460,053, filed on Dec. 23, 2010, that is entitled "The Force Sub—Part 2", an entire copy of which is incorporated herein by reference.

Applicant claims priority for this application to U.S. Provisional Patent Application No. 61/461,266, filed on Jan. 14, 2011, that is entitled "The Force Sub—Part 3", an entire copy of which is incorporated herein by reference.

Applicant claims priority for this application to U.S. Provisional Patent Application No. 61/462,393, filed on Feb. 2, 2011, that is entitled "UDCS, The Force Sub, and The Torque Sub", an entire copy of which is incorporated herein by reference.

Applicant claims priority for this application to U.S. Provisional Patent Application No. 61/517,218, filed on Apr. 15, 2011, that is entitled "UDCS, The Force Sub, and The Torque Sub—Part 2", an entire copy of which is incorporated herein by reference.

CROSS-REFERENCES TO RELATED APPLICATIONS

This section is divided into "Cross References to Related U.S. Patent Applications", "Other Related U.S. Applications", "Related Foreign Applications", "Cross-References to Related U.S. Provisional Patent Applications", and "Related U.S. Disclosure Documents". This is done so for the purposes of clarity.

CROSS-REFERENCES TO RELATED U.S. PATENT APPLICATIONS

The present application is related to U.S. patent application Ser. No. 12/583,240, filed on Aug. 17, 2009, that is entitled "High Power Umbilicals for Subterranean Electric Drilling Machines and Remotely Operated Vehicles", an entire copy of which is incorporated herein by reference. Ser. No. 12/583,240 was published on Dec. 17, 2009 having Publication Number US 2009/0308656 A1, an entire copy of which is incorporated herein by reference.

The present application is related U.S. patent application Ser. No. 12/005,105, filed on Dec. 22, 2007, that is entitled "High Power Umbilicals for Electric Flowline Immersion Heating of Produced Hydrocarbons", an entire copy of which is incorporated herein by reference. Ser. No. 12/005,105 was published on Jun. 26, 2008 having Publication Number US 2008/0149343 A1, an entire copy of which is incorporated herein by reference.

The present application is related to U.S. patent application Ser. No. 10/800,443, filed on Mar. 14, 2004, that is entitled "Substantially Neutrally Buoyant and Positively Buoyant Electrically Heated Flowlines for Production of Subsea Hydrocarbons", an entire copy of which is incorporated herein by reference. Ser. No. 10/800,443 was published on Dec. 9, 2004 having Publication Number US 2004/0244982 A1, an entire copy of which is incorporated herein by reference. Ser. No. 10/800,443 issued as U.S. Pat. No. 7,311,151 B2 on Dec. 25, 2007.

The present application is related U.S. patent application Ser. No. 10/729,509, filed on Dec. 4, 2003, that is entitled "High Power Umbilicals for Electric Flowline Immersion Heating of Produced Hydrocarbons", an entire copy of which is incorporated herein by reference. Ser. No. 10/729,509 was published on Jul. 15, 2004 having the Publication Number US 2004/0134662 A1, an entire copy of which is incorporated herein by reference. Ser. No. 10/729,509 issued as U.S. Pat. No. 7,032,658 B2 on the date of Apr. 25, 2006, an entire copy of which is incorporated herein by reference.

The present application is related to U.S. patent application Ser. No. 10/223,025, filed Aug. 15, 2002, that is entitled "High Power Umbilicals for Subterranean Electric Drilling Machines and Remotely Operated Vehicles", an entire copy of which is incorporated herein by reference. Ser. No. 10/223,025 was published on Feb. 20, 2003, having Publication Number US 2003/0034177 A1, an entire copy of which is incorporated herein by reference. Ser. No. 10/223,025 issued as U.S. Pat. No. 6,857,486 B2 on the date of Feb. 22, 2005, an entire copy of which is incorporated herein by reference.

Applicant does not claim priority from the above five U.S. patent application Ser. No. 12/583,240, Ser. No. 12/005,105, Ser. No. 10/800,443, Ser. No. 10/729,509 and Ser. No. 10/223,025.

OTHER RELATED U.S. APPLICATIONS

The following applications are related to this application, but applicant does not claim priority from the following related applications.

This application relates to Ser. No. 09/375,479, filed Aug. 16, 1999, having the title of "Smart Shuttles to Complete Oil and Gas Wells", that issued on Feb. 20, 2001, as U.S. Pat. No. 6,189,621 B1, an entire copy of which is incorporated herein by reference.

This application also relates to application Ser. No. 09/487,197, filed Jan. 19, 2000, having the title of "Closed-Loop System to Complete Oil and Gas Wells", that issued on Jun. 4, 2002 as U.S. Pat. No. 6,397,946 B1, an entire copy of which is incorporated herein by reference.

This application also relates to application Ser. No. 10/162,302, filed Jun. 4, 2002, having the title of "Closed-Loop Conveyance Systems for Well Servicing", that issued as U.S. Pat. No. 6,868,906 B1 on Mar. 22, 2005, an entire copy of which is incorporated herein by reference.

This application also relates to application Ser. No. 11/491,408, filed Jul. 22, 2006, having the title of "Methods and Apparatus to Convey Electrical Pumping Systems into Wellbores to Complete Oil and Gas Wells", that issued as U.S. Pat. No. 7,325,606 B1 on Feb. 5, 2008, an entire copy of which is incorporated herein by reference.

And this application also relates to application Ser. No. 12/012,822, filed Feb. 5, 2008, having the title of "Methods and Apparatus to Convey Electrical Pumping Systems into Wellbores to Complete Oil and Gas Wells", that was published as US 2008/128128 A1 on Jun. 5, 2008, an entire copy of which is incorporated herein by reference.

RELATED FOREIGN APPLICATIONS

The following foreign applications are related to this application, but applicant does not claim priority from the following related foreign applications.

This application relates to PCT Application Serial Number PCT/US00/22095, filed Aug. 9, 2000, having the title of "Smart Shuttles to Complete Oil and Gas Wells", that has International Publication Number WO 01/12946 A1, that has International Publication Date of Feb. 22, 2001, that issued as European Patent No. 1,210,498 B1 on the date of Nov. 28, 2007, an entire copy of which is incorporated herein by reference.

This application also relates to Canadian Serial No. CA2000002382171, filed Aug. 9, 2000, having the title of "Smart Shuttles to Complete Oil and Gas Wells", that was published on Feb. 22, 2001, as CA 2382171 AA, an entire copy of which is incorporated herein by reference.

This application further relates to PCT Patent Application Number PCT/US02/26066 filed on Aug. 16, 2002, entitled "High Power Umbilicals for Subterranean Electric Drilling Machines and Remotely Operated Vehicles", that has the International Publication Number WO 03/016671 A2, that has International Publication Date of Feb. 27, 2003, that issued as European Patent No. 1,436,482 B1 on the date of Apr. 18, 2007, an entire copy of which is incorporated herein by reference.

This application further relates to Norway Patent Application No. 2004 0771 filed on Aug. 16, 2002, having the title of "High Power Umbilicals for Subterranean Electric Drilling Machines and Remotely Operated Vehicles", that issued as Norway Patent No. 326,447 that issued on Dec. 8, 2008, an entire copy of which is incorporated herein by reference.

This application further relates to Canada Patent Application 2454865 filed on Aug. 16, 2002, having the title of "High Power Umbilicals for Subterranean Electric Drilling Machines and Remotely Operated Vehicles", that was published as CA 2454865 AA on the date of Feb. 27, 2003, an entire copy of which is incorporated herein by reference.

This application further relates to PCT Patent Application Number PCT/US03/38615 filed on Dec. 5, 2003, entitled "High Power Umbilicals for Electric Flowline Immersion Heating of Produced Hydrocarbons", that has the International Publication Number WO 2004/053935 A2, that has International Publication Date of Jun. 24, 2004, an entire copy of which is incorporated herein by reference.

This application further relates to PCT Patent Application Number PCT/US2004/008292, filed on Mar. 17, 2004, entitled "Substantially Neutrally Buoyant and Positively Buoyant Electrically Heated Flowlines for Production of Subsea Hydrocarbons", that has International Publication Number WO 2004/083595 A2 that has International Publication Date of Sep. 30, 2004, an entire copy of which is incorporated herein by reference.

CROSS-REFERENCES TO RELATED U.S. PROVISIONAL PATENT APPLICATIONS

This application relates to Provisional Patent Application No. 60/313,654 filed on Aug. 19, 2001, that is entitled "Smart Shuttle Systems", an entire copy of which is incorporated herein by reference.

This application also relates to Provisional Patent Application No. 60/353,457 filed on Jan. 31, 2002, that is entitled "Additional Smart Shuttle Systems", an entire copy of which is incorporated herein by reference.

This application further relates to Provisional Patent Application No. 60/367,638 filed on Mar. 26, 2002, that is entitled "Smart Shuttle Systems and Drilling Systems", an entire copy of which is incorporated herein by reference.

And yet further, this application also relates the Provisional Patent Application No. 60/384,964 filed on Jun. 3, 2002, that is entitled "Umbilicals for Well Conveyance Systems and Additional Smart Shuttles and Related Drilling Systems", an entire copy of which is incorporated herein by reference.

This application also relates to Provisional Patent Application No. 60/432,045, filed on Dec. 8, 2002, that is entitled "Pump Down Cement Float Valves for Casing Drilling, Pump Down Electrical Umbilicals, and Subterranean Electric Drilling Systems", an entire copy of which is incorporated herein by reference.

And yet further, this application also relates to Provisional Patent Application No. 60/448,191, filed on Feb. 18, 2003, that is entitled "Long Immersion Heater Systems", an entire copy of which is incorporated herein by reference.

Ser. No. 10/223,025 claimed priority from the above Provisional Patent Application No. 60/313,654, No. 60/353,457, No. 60/367,638 and No. 0/384,964, and applicant claims any relevant priority in the present application.

Ser. No. 10/729,509 claimed priority from various Provisional patent applications, including Provisional Patent Application No. 60/432,045, and 60/448,191, and applicant claims any relevant priority in the present application.

The present application also relates to Provisional Patent Application No. 60/455,657, filed on Mar. 18, 2003, that is entitled "Four SDCI Application Notes Concerning Subsea Umbilicals and Construction Systems", an entire copy of which is incorporated herein by reference.

The present application further relates to Provisional Patent Application No. 60/504,359, filed on Sep. 20, 2003, that is entitled "Additional Disclosure on Long Immersion Heater Systems", an entire copy of which is incorporated herein by reference.

The present application also relates to Provisional Patent Application No. 60/523,894, filed on Nov. 20, 2003, that is entitled "More Disclosure on Long Immersion Heater Systems", an entire copy of which is incorporated herein by reference.

The present application further relates to Provisional Patent Application No. 60/532,023, filed on Dec. 22, 2003, that is entitled "Neutrally Buoyant Flowlines for Subsea Oil and Gas Production", an entire copy of which is incorporated herein by reference.

And yet further, the present application relates to Provisional Patent Application No. 60/535,395, filed on Jan. 10, 2004, that is entitled "Additional Disclosure on Smart Shuttles and Subterranean Electric Drilling Machines", an entire copy of which is incorporated herein by reference.

Ser. No. 10/800,443 claimed priority from U.S. Provisional Patent Applications No. 60/455,657, No. 60/504,359, No. 60/523,894, No. 60/532,023, and No. 60/535,395, and applicant claims any relevant priority in the present application.

Further, the present application relates to Provisional Patent Application No. 60/661,972, filed on Mar. 14, 2005, that is entitled "Electrically Heated Pumping Systems Disposed in Cased Wells, in Risers, and in Flowlines for Immersion Heating of Produced Hydrocarbons", an entire copy of which is incorporated herein by reference.

Yet further, the present application relates to Provisional Patent Application No. 60/665,689, filed on Mar. 28, 2005, that is entitled "Automated Monitoring and Control of Electrically Heated Pumping Systems Disposed in Cased Wells, in Risers, and in Flowlines for Immersion Heating of Produced Hydrocarbons", an entire copy of which is incorporated herein by reference.

Further, the present application relates to Provisional Patent Application No. 60/669,940, filed on Apr. 9, 2005, that is entitled "Methods and Apparatus to Enhance Performance of Smart Shuttles and Well Locomotives", an entire copy of which is incorporated herein by reference.

And further, the present application relates to Provisional Patent Application No. 60/761,183, filed on Jan. 23, 2006, that is entitled "Methods and Apparatus to Pump Wirelines into Cased Wells Which Cause No Reverse Flow", an entire copy of which is incorporated herein by reference.

And yet further, the present application relates to Provisional Patent Application No. 60/794,647, filed on Apr. 24, 2006, that is entitled "Downhole DC to AC Converters to Power Downhole AC Electric Motors and Other Methods to Send Power Downhole", an entire copy of which is incorporated herein by reference.

Still further, the present application relates to Provisional Patent Application No. 61/189,253, filed on Aug. 15, 2008, that is entitled "Optimized Power Control of Downhole AC and DC Electric Motors and Distributed Subsea Power Consumption Devices", an entire copy of which is incorporated herein by reference.

And further, the present application relates to Provisional Patent Application No. 61/190,472, filed on Aug. 28, 2008, that is entitled "High Power Umbilicals for Subterranean Electric Drilling Machines and Remotely Operated Vehicles", an entire copy of which is incorporated herein by reference.

And finally, the present application relates to Provisional Patent Application No. 61/192,802, filed on Sep. 22, 2008, that is entitled "Seals for Smart Shuttles", an entire copy of which is incorporated herein by reference.

Ser. No. 12/583,240 claimed priority from Provisional Patent Application Ser. No. 61/189,253, No. 61/190,472, No. 61/192,802, No. 61/270,709, and No. 61/274,215, and applicant claims any relevant priority in the present application.

Entire copies of Provisional patent applications are incorporated herein by reference, unless unintentional errors have been found and specifically identified. Several such unintentional errors are herein noted. Provisional Patent Application Ser. No. 61/189,253 was erroneously referenced as Ser. No. 60/189,253 within Provisional Patent Application Ser. No. 61/270,709 and within Provisional Patent Application No. 61/274,215 mailed to the USPTO on Aug. 13, 2009, and these changes are noted here, and are incorporated by herein by reference. Entire copies of the cited Provisional patent applications are incorporated herein by reference unless they present information which directly conflicts with any explicit statements in the application herein.

RELATED U.S. DISCLOSURE DOCUMENTS

This application further relates to disclosure in U.S. Disclosure Document No. 451,044, filed on Feb. 8, 1999, that is entitled 'RE:—Invention Disclosure—"Drill Bit Having Monitors and Controlled Actuators"', an entire copy of which is incorporated herein by reference.

This application further relates to disclosure in U.S. Disclosure Document No. 458,978 filed on Jul. 13, 1999 that is entitled in part "RE:—INVENTION DISCLOSURE MAILED Jul. 13, 1999", an entire copy of which is incorporated herein by reference.

This application further relates to disclosure in U.S. Disclosure Document No. 475,681 filed on Jun. 17, 2000 that is entitled in part "ROV Conveyed Smart Shuttle System Deployed by Workover Ship for Subsea Well Completion and Subsea Well Servicing", an entire copy of which is incorporated herein by reference.

This application further relates to disclosure in U.S. Disclosure Document No. 496,050 filed on Jun. 25, 2001 that is entitled in part "SDCI Drilling and Completion Patents and Technology and SDCI Subsea Re-Entry Patents and Technology", an entire copy of which is incorporated herein by reference.

This application further relates to disclosure in U.S. Disclosure Document No. 480,550 filed on Oct. 2, 2000 that is entitled in part "New Draft Figures for New Patent Applications", an entire copy of which is incorporated herein by reference.

This application further relates to disclosure in U.S. Disclosure Document No. 493,141 filed on May 2, 2001 that is entitled in part "Casing Boring Machine with Rotating Casing to Prevent Sticking Using a Rotary Rig", an entire copy of which is incorporated herein by reference.

This application further relates to disclosure in U.S. Disclosure Document No. 492,112 filed on Apr. 12, 2001 that is entitled in part "Smart Shuttle™. Conveyed Drilling Systems", an entire copy of which is incorporated herein by reference.

This application further relates to disclosure in U.S. Disclosure Document No. 495,112 filed on Jun. 11, 2001 that is entitled in part "Liner/Drainhole Drilling Machine", an entire copy of which is incorporated herein by reference.

This application further relates to disclosure in U.S. Disclosure Document No. 494,374 filed on May 26, 2001 that is entitled in part "Continuous Casting Boring Machine", an entire copy of which is incorporated herein by reference.

This application further relates to disclosure in U.S. Disclosure Document No. 495,111 filed on Jun. 11, 2001 that is entitled in part "Synchronous Motor Injector System", an entire copy of which is incorporated herein by reference.

And yet further, this application also relates to disclosure in U.S. Disclosure Document No. 497,719 filed on Jul. 27, 2001 that is entitled in part "Many Uses for The Smart Shuttle™ and Well Locomotive™", an entire copy of which is incorporated herein by reference.

This application further relates to disclosure in U.S. Disclosure Document No. 498,720 filed on Aug. 17, 2001 that is entitled in part "Electric Motor Powered Rock Drill Bit Having Inner and Outer Counter-Rotating Cutters and Having Expandable/Retractable Outer Cutters to Drill Boreholes into Geological Formations", an entire copy of which is incorporated herein by reference.

Still further, this application also relates to disclosure in U.S. Disclosure Document No. 499,136 filed on Aug. 26, 2001, that is entitled in part 'Commercial System Specification PCP-ESP Power Section for Cased Hole Internal Conveyance "Large Well Locomotive™"', an entire copy of which is incorporated herein by reference.

And yet further, this application also relates to disclosure in U.S. Disclosure Document No. 516,982 filed on Aug. 20, 2002, that is entitled "Feedback Control of RPM and Voltage of Surface Supply", an entire copy of which is incorporated herein by reference.

And further, this application also relates to disclosure in U.S. Disclosure Document No. 531,687 filed May 18, 2003, that is entitled "Specific Embodiments of Several SDCI Inventions", an entire copy of which is incorporated herein by reference.

Further, the present application relates to U.S. Disclosure Document No. 572,723, filed on Mar. 14, 2005, that is entitled "Electrically Heated Pumping Systems Disposed in Cased Wells, in Risers, and in Flowlines for Immersion Heating of Produced Hydrocarbons", an entire copy of which is incorporated herein by reference.

Yet further, the present application relates to U.S. Disclosure Document No. 573,813, filed on Mar. 28, 2005, that is entitled "Automated Monitoring and Control of Electrically Heated Pumping Systems Disposed in Cased Wells, in Risers, and in Flowlines for Immersion Heating of Produced Hydrocarbons", an entire copy of which is incorporated herein by reference.

Further, the present application relates to U.S. Disclosure Document No. 574,647, filed on Apr. 9, 2005, that is entitled "Methods and Apparatus to Enhance Performance of Smart Shuttles and Well Locomotives", an entire copy of which is incorporated herein by reference.

Yet further, the present application relates to U.S. Disclosure Document No. 593,724, filed Jan. 23, 2006, that is entitled "Methods and Apparatus to Pump Wirelines into Cased Wells Which Cause No Reverse Flow", an entire copy of which is incorporated herein by reference.

Further, the present application relates to U.S. Disclosure Document No. 595,322, filed Feb. 14, 2006, that is entitled "Additional Methods and Apparatus to Pump Wirelines into Cased Wells Which Cause No Reverse Flow", an entire copy of which is incorporated herein by reference.

And further, the present application relates to U.S. Disclosure Document No. 599,602, filed on Apr. 24, 2006, that is entitled "Downhole DC to AC Converters to Power Downhole AC Electric Motors and Other Methods to Send Power Downhole", an entire copy of which is incorporated herein by reference.

And finally, the present application relates to the U.S. Disclosure Document that is entitled "Seals for Smart Shuttles" that was mailed to the USPTO on the Date of Dec. 22, 2006 by U.S. Mail, Express Mail Service having Express Mail Number EO 928 739 065 US, an entire copy of which is incorporated herein by reference.

Various references are referred to in the above defined U.S. Disclosure Documents. For the purposes herein, the term "reference cited in applicant's U.S. Disclosure Documents" shall mean those particular references that have been explicitly listed and/or defined in any of applicant's above listed U.S. Disclosure Documents and/or in the attachments filed with those U.S. Disclosure Documents. Applicant explicitly includes herein by reference entire copies of each and every "reference cited in applicant's U.S. Disclosure Documents". To best knowledge of applicant, all copies of U.S. patents that were ordered from commercial sources that were specified in the U.S. Disclosure Documents are in the possession of applicant at the time of the filing of the application herein.

RELATED U.S. TRADEMARKS

Various references are referred to in the above defined U.S. Disclosure Documents. For the purposes herein, the term "reference cited in applicant's U.S. Disclosure Documents" shall mean those particular references that have been explicitly listed and/or defined in any of applicant's above listed U.S. Disclosure Documents and/or in the attachments filed with those U.S. Disclosure Documents. Applicant explicitly includes herein by reference entire copies of each and every "reference cited in applicant's U.S. Disclosure Documents". In particular, applicant includes herein by reference entire copies of each and every U.S. patent cited in U.S. Disclosure Document No. 452648, including all its attachments, that was filed on Mar. 5, 1999. To best knowledge of applicant, all copies of U.S. patents that were ordered from commercial sources that were specified in the U.S. Disclosure Documents are in the possession of applicant at the time of the filing of the application herein.

Applications for U.S. Trademarks have been filed in the USPTO for several terms used in this application. An application for the Trademark "Smart Shuttle" was filed on Feb. 14, 2001 that is Serial No. 76/213676, an entire copy of which is incorporated herein by reference. The term Smart Shuttle® is now a Registered Trademark. The "Smart Shuttle™" is also called the "Well Locomotive". An application for the Trademark "Well Locomotive" was filed on Feb. 20, 2001 that is Serial Number 76/218211, an entire copy of which is incorporated herein by reference. The term "Well Locomotive" is now a registered Trademark. An application for the Trademark of "Downhole Rig" was filed on Jun. 11, 2001 that is Serial Number 76/274726, an entire copy of which is incorporated herein by reference. An application for the Trademark "Universal Completion Device" was filed on Jul. 24, 2001 that is Serial Number 76/293175, an entire copy of which is incorporated herein by reference. An application for the Trademark "Downhole BOP" was filed on Aug. 17, 2001 that is Serial Number 76/305201, an entire copy of which is incorporated herein by reference.

Accordingly, in view of the Trademark Applications, the term "smart shuttle" will be capitalized as "Smart Shuttle"; the term "well locomotive" will be capitalized as "Well Locomotive"; the term "downhole rig" will be capitalized as "Downhole Rig"; the term "universal completion device" will be capitalized as "Universal Completion Device"; and the term "downhole bop" will be capitalized as "Downhole BOP".

Other U.S. Trademarks related to the invention disclosed herein include the following: "Subterranean Electric Drilling Machine", or "SEDM™"; "Electric Drilling Machine™", or "EDM™"; "Electric Liner Drilling Machine™", or "ELDM™", "Continuous Casing Casting Machine™", or "CCCM™"; "Liner/Drainhole Drilling Machine™", or "LDDM™"; "Drill and Drag Casing Boring Machine™", or "DDCBM™"; "Next Step Drilling Machine™", or "NSDM™"; "Next Step Electric Drilling Machine™", or "NSEDM™"; "Next Step Subterranean Electric Drilling Machine™", or "NSSEDM™"; and "Subterranean Liner Expansion Tool™", or "SLET™"

Other additional Trademarks related to the invention disclosed herein are the following: "Electrically Heated Composite Umbilical™", or "EHCU™"; "Electric Flowline Immersion Heater Assembly™", or "EFIHA™"; and "Pump-Down Conveyed Flowline Immersion Heater Assembly™", or "PDCFIHA™".

Yet other additional Trademarks related to the invention disclosed herein are the following: "Adaptive Electronics Control System™", or "AECS™"; "Subsea Adaptive Electronics Control System™", or "SAECS™"; "Adaptive Power Control System™", or "APCS™"; and "Subsea Adaptive Power Control System™", or "SAPCS™".

BACKGROUND OF THE INVENTION

1. Field of the Invention

The fundamental field of the invention relates to methods and apparatus used to drill and complete wellbores. Such wellbores include extended reach horizontal wellbores, for example in shales, deep subsea extended reach wellbores, and multilateral wellbores. Relevant to the invention are topics that include liner drilling, deep water drilling, extended reach drilling, Managed Pressure Drilling (MPD), and one of it's variants, Constant Bottom Hole Pressure (CBHP) drilling. Specifically, the invention relates to adding simple threaded subassemblies to existing threaded tubular drilling and completion equipment typically already present at a given wellsite that are used to dramatically increase the lateral reach using that existing on-site equipment. These subassemblies extract power from downward flowing clean mud, or other fluids, in an annulus to provide additional force and torque on tubular elements within the wellbore to extend the lateral reach of the drilling equipment and completion equipment. This extra force is provided while maintaining the appropriate circulation. The extra Weight-on-Bit is maintained while continuously maintaining proper circulation. The field of the invention also relates to dramatically reducing the cost to drill new wells by reducing the strength requirements on wellsite drilling and completion equipment to reach a predetermined lateral distance. The field of invention also relates to the reduction in drilling costs of a multiple well drilling program, for example in shales. Such an approach would be particularly useful in the Barnette, Marcellus, and in the Bakken formations.

2. Description of the Related Art

In CSUG/SPE 137821, entitled "New Approach to Improve the Horizontal Drilling reach", by Vestavik, et al, the Reelweel Drilling Method (RDM) is described. The Dual Drill String (DSS) method is described that uses a Top Drive. The rotating Dual Drill String seals against the interior of a Sliding Piston. The exterior portion of the Sliding Piston seals against the interior of a casing. Applied annular pressure to that Sliding Piston is used to push the Bottom Hole Assembly (BHA) into a horizontal section of a well. Within 10¾ inch casing, Reelwell reports a 14 ton increase in net force applied to the BHA with an applied annular pressure of 50 bar (approximately 725 psi). So, Reelwell does use applied annular pressure to increase Weight on Bit (WOB).

The Reelwell Drilling Method uses the annulus for pressuring their Sliding Piston to increase WOB, and uses the Dual Drill String to maintain circulation while increasing WOB. However, the Dual Drill String is comprised of a pipe-within-a pipe. These concentric pipes are more costly compared to conventional drill pipe, are more complex to assemble in a drilling environment, and require specially trained personnel.

A further significant disadvantage of the RDM, is that the interior of a Dual Drill String is used to circulate fluids both ways. One channel of the pipe system carries clean mud downhole, and the other channel carries dirty mud uphole. Normally, dirty mud goes up an annulus. However, with the DDS, the dirty mud goes up one channel within the DDS, and is therefore called a "reverse circulation" technique (SPE 89505, entitled "Reverse Circulation With Coiled Tubing—Results of 1600+jobs, by Michel, et. al."). It is known in the industry that reverse circulation causes an increase in pressure at the bit because the area available to fluid flow up is much smaller compared to the typically available area to annular annular flow up. Put another way, in reverse circulation, an increase in the pressure on clean mud flowing down the annulus is necessary to compensate for the extra pressure required to push mud up the inside of the drill pipe at the same flow rate. That increase in pressure appears at the drill bit.

This increase in pressure can be defined as a "Back Pressure" and is caused by the frictional fluid flow within pipes and tubulars. Such frictional flow within pipes is well documented in standard text books and can be calculated at the website www.efunda.com. Such increase in Back Pressure can result in drilling conditions outside the desirable pressure range at the intersection of the drill bit with the rock face. That desirable pressure range is called the "Drilling Window" (IADC/SPE 122281, entitled "Managed Pressure Drilling: What It Is and What it is Not", by Malloy, et. al.).

This increase in Back Pressure can be overcome to some degree by using light oil based drilling mud, but that approach is expensive, and has additional environmental disposal problems. Most importantly, the increase in Back Pressure results in strong limitations on the maximum possible mud flow rate. Reelwell has reported flow rates of less than 200 gallons per minute (SPE 124891, entitled "Reelwell Drilling Method—A Unique Combination of MPD and Liner Drilling", by Vestavik, et. al.). However, many drilling applications call for about 600 gallons per minute, or more, to carry away rock chips, particularly for long extended reach applications. For a given OD of drill pipe, for example for an OD of 6⅝ inches, Reelwell's Dual Drill String will ALWAYS have a larger Back Pressure when compared to the reverse circulation of just the dirty mud up within a single pipe having the same OD. Such considerations are particularly important for extreme lateral reach drilling with the 5⅞ inch Extreme Reach Drill Pipe available from NOV Grant Prideco (see www.nov.com).

The Reelwell-Telemetry System involving a modification of its Dual Drill String is described in an Award received by Reelwell at the 2010 Offshore Technology Conference (see www.otcnet.org) and it does provide high speed data communications. However, apparently this telemetry system and associated Dual Drill String is not compatible with the standard IntelliServ™ Wired Drill Pipe commercially available today for high speed data communications (see www.nov.com).

For extended reach drilling applications, it may be useful at any given well to use mechanical friction reduction tools and systems. For example, such tools are shown in U.S. Pat. No. 6,585,043 entitled "Friction Reducing Tool" and U.S. Pat. No. 7,025,136 entitled "Torque Reduction Tool", both assigned to Weatherford. The LoTAD™ (trademark of Weatherford) Mechanical Friction-Reduction System is documented at the website of www.Weatherford.com.

Check valves and pressure relief valves have been used with hydraulic seals to convey coiled tubings into wellbores and for cleaning the wellbores. See U.S. Pat. No. 7,025,142 entitled "Bi-Directional Thruster Pig Apparatus and Method of Utilizing Same", having the inventor of James Crawford, that describes "changeable, adjustable check valves that are double acting in each direction" to determine the amount of "hydraulic thrust pressure". OTC 8675 entitled "Extended Reach Pipeline Blockage Remediation", by Baugh, et. al. describes a sets of relief valves. These all appear to basically spring and ball type check-valve devices. Any such device would be challenged technologically for use in any drilling machine having a clean mud flow rate of 600 gallons per minute, a pressure drop across the device of 725 psi, which therefore, internally dissipates about 250 horsepower within the device. Such technological challenges include at least the following: the heating of such devices dissipating high horsepower would present many problems; the mud at such high flow rates is very abrasive, and the springs, balls, and ball seats, are subject to wear from such high mud flow rates; the mechanisms can clog up or jam; such devices can set up pressure oscillations because of the natural frequencies of the springs and balls and their interaction with tubular structures in the wellbore; the force characteristics of the springs are temperature dependent; the check valves are difficult to maintain in calibration with wear; and such check valves can have relatively complex pressure vs. flow rate characteristics.

Please refer to the section of the specification below under the heading of "References" for precise definitions of the above references cited.

SUMMARY OF THE INVENTION

An object of the invention is to provide a new method to drill wells with standard drill pipe where pressurized clean mud is pumped down the annulus that provides additional force on the bit (WOB) AND which provides fresh mud to circulate down to the drill bit.

Another object of the invention is to provide new apparatus to drill wells with standard drill pipe that includes a threaded tubular element having a Leaky Seal and a Cross-Over that is inserted into an existing threaded drill string that provides additional force on the bit (WOB) AND which provides fresh mud to circulate down to the drill bit.

Another object of the invention is to use annular mud flow for at least two purposes simultaneously: to provide additional WOB and to provide fresh mud to the drill bit.

Another object of the invention is to use annular mud flow for multiple purposes simultaneously including (for example): to provide additional WOB; and to provide fresh mud to the drill bit; and to provide power to a mud motor powered progressing cavity pump that is to be used for Underbalanced Drilling, or for Managed Pressure Drilling, or for Constant Pressure Drilling; and to provide power to a mud motor to turn the shaft of attached to a rotary drill bit.

Yet another object of the invention is to provide new reverse circulation methods for drilling and completing wellbores.

Another object of the invention is to provide methods and apparatus that reduces the Back Pressure during reverse circulation methods of operation using the Force Sub.

Another object of the invention is to provide a new drilling methods and apparatus that as an option, can use commercially available Wired Drill Pipe for high speed data communications.

Another object of the invention is to provide new drilling methods and apparatus to drill extended reach wellbores.

Yet another object of the invention is to provide new drilling apparatus that may be used in conjunction with other commercially available systems to reduce mechanical friction, such as the LoTAD™ system.

Another object of the invention is to provide a Leaky Seal having a passageway through the seal that passes high mud flow rates, such as 600 gallons per minute, that provides a pressure differential across the seal related to the flow rate of the mud through the passageway of the seal, and which is relatively indestructible at such a high mud flow rate.

Yet another object of the invention is to provide extended reach horizontal wellbores, for example in shales.

Another object of the invention is to provide deep subsea extended reach wellbores.

Another object of the invention to provide subsea multilateral wellbores.

Yet another object of the invention is to provide simple threaded subassemblies that are added to existing threaded tubular drilling and completion equipment which are used to dramatically increase the lateral reach using that existing on-site equipment.

Another object of the invention is to provide tubular sub-assemblies for use in wellbores that extract power from downward flowing clean mud, or other fluids, in an annulus to provide additional force on tubular elements within the wellbore, while maintaining circulation, to extend the lateral reach of the drilling and completion equipment.

Another object of the invention is to provide tubular sub-assemblies for use in wellbores that extract power from downward flowing clean mud, or other fluids, in an annulus to provide additional torque on tubular elements within the wellbore, while maintaining circulation, to extend the lateral reach of the drilling and completion equipment.

Another object of the invention is to provide tubular sub-assemblies for use in wellbores that that extract power from downward flowing clean mud, or other fluids, in an annulus to provide additional force and torque on tubular elements within the wellbore, while maintaining circulation, to extend the lateral reach of the drilling equipment and completion equipment Yet another object of the invention is provide simple add-on tubular elements to an existing drill string within a wellbore that allows comparatively lighter drilling equipment to successfully drill through a given set of geological formations that are used to reach a given lateral distance, therefore reducing drilling costs at the wellbore.

And, finally, another object of the invention is to provide simple add-on tubular elements to an existing drill string within a wellbore that allows lighter completion equipment to be used to complete a well at a given lateral distance, therefore reducing completion costs of the wellbore

DESCRIPTION OF THE PREFERRED EMBODIMENTS

Figure 1:
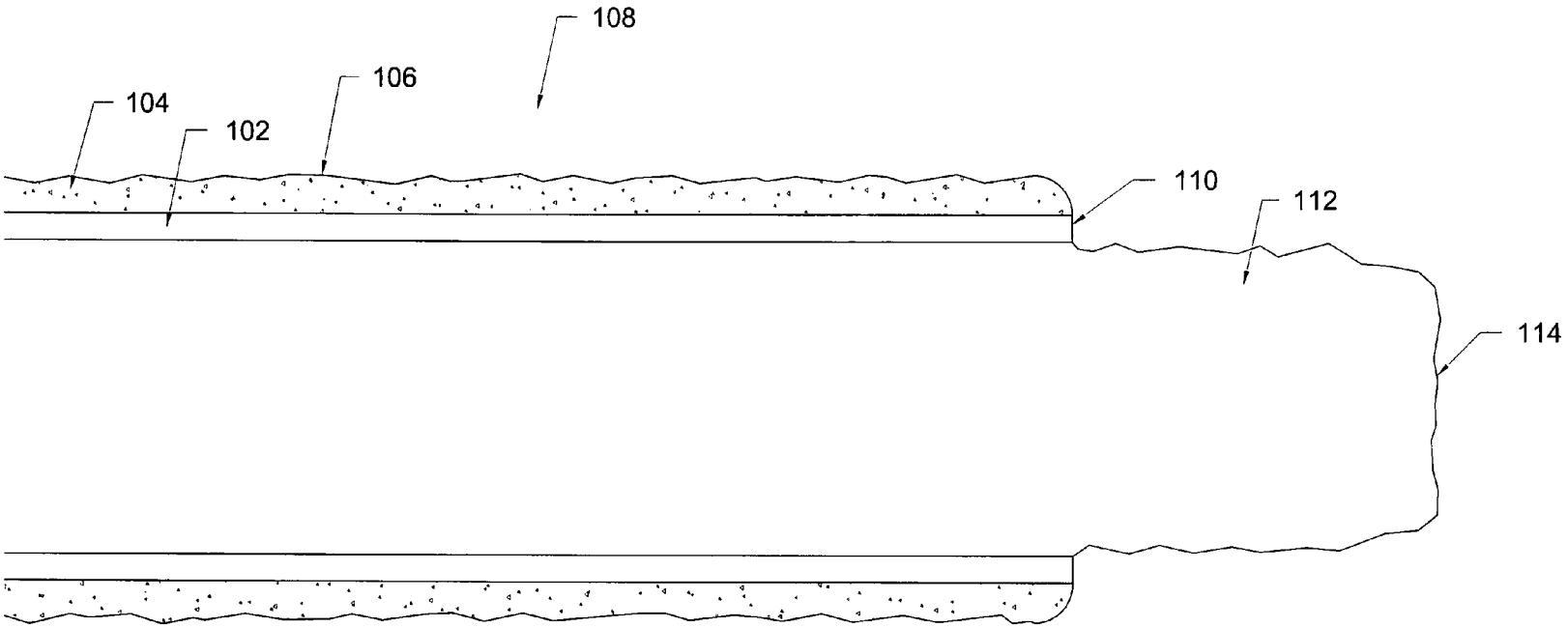
FIG. 1 PRIOR ART
FIG. 1 shows a partially cased wellbore with an open hole segment.

FIG. 1 shows the existing situation at typical drilling site. At this time during the drilling and well completion process, casing 102 has been cemented in place with cement 104 within previously drilled borehole 106 in subterranean geological formation 108. The well was drilled and cased to a first distance 110. Presently, additional open hole 112 has been drilled to a maximum lateral distance 114 within the geological formation. In one preferred embodiment of the invention, the existing drilling equipment and existing completion equipment cannot drill or complete further, although this equipment is still located and available at the wellsite, but is not shown in FIG. 1. In this FIG. 1, and in all the drawings herein unless otherwise specified, the direction to the right-hand side is the direction downhole.

Figure 2:
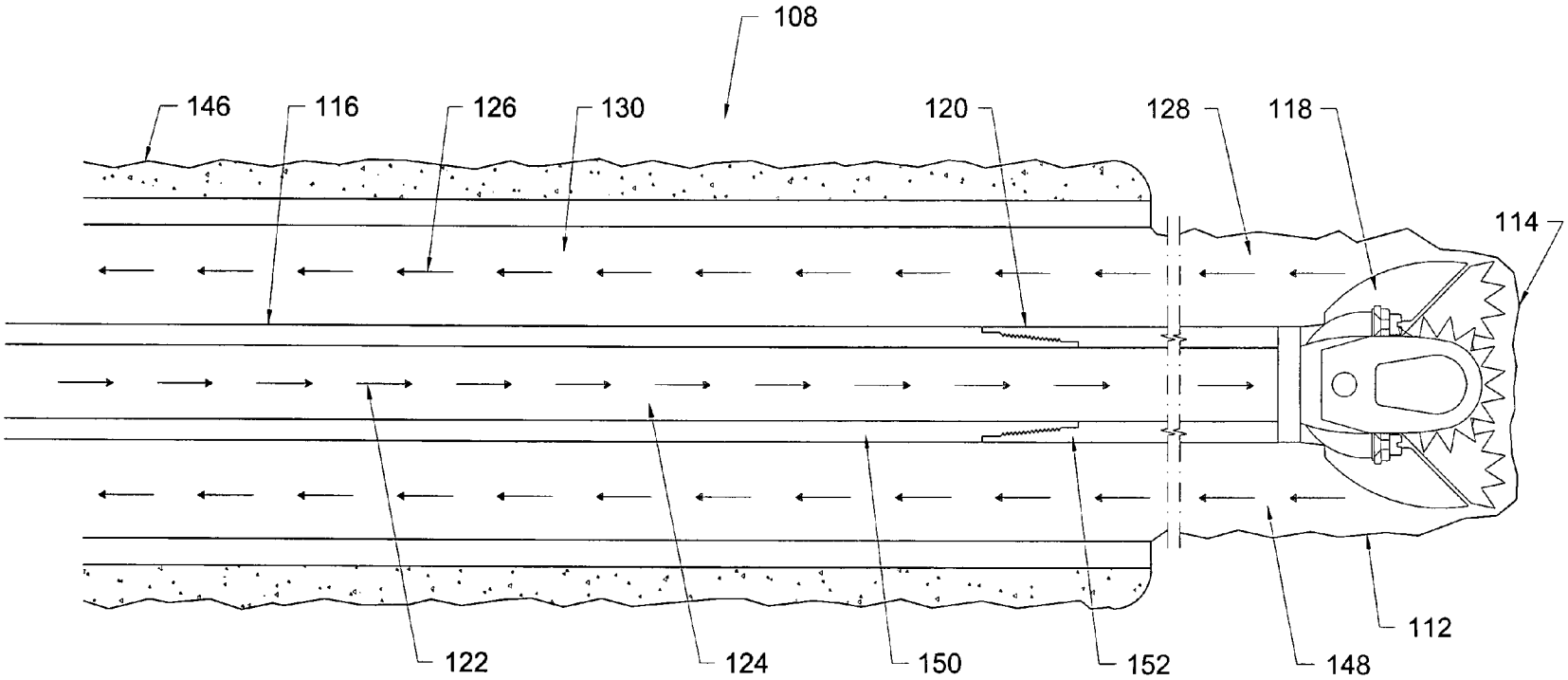
FIG. 2 PRIOR ART
FIG. 2 shows a rotary drill string attempting to further extend the open hole segment, but cannot drill any further because of wellbore frictional effects.

FIG. 2 shows rotary drill string 116 attached to rotary drill bit 118 within the well previously shown in FIG. 1. Typical pipe joint 120 is shown where individual drill pipes are typically threaded together to form the drill string. This drilling equipment is being used to try to drill an extra distance into formation but cannot drill further than the lateral distance 114 because of frictional losses and other limiting factors during typical drilling operations. Put simply, the existing drilling equipment cannot drill further than the lateral distance 114 shown in FIG. 2. Drilling mud is shown flowing downward by the downward flowing arrow 122 within the inside area of the drill pipe 124 through which fluids may flow. Element 124 is also called the interior of the drill pipe. The downward flowing fluid 122 may be any mud or any type of fluid typically found within wells in the oil and gas industries. In FIG. 2, the dirty drilling mud with rock cuttings is shown flowing uphole by upward pointing arrow 126. In FIG. 2, the upward flowing dirty mud first flows in sequence within the annulus 128 between the OD of the drill pipe and the ID of the open hole 112, and then within the annulus 130 between the ID of the well casing and the OD of the drill pipe. In this application, OD is an abbreviation for "Outside Diameter", and ID is an abbreviation for "Inside Diameter". The casing 102 has an outside diameter 132, an inside diameter 134, and a typical wall thickness 136 (which numerals 132, 134, and 136 are not shown on FIGS. 1 and 2 for the sake of brevity). Drill string 116 is comprised of segments of drill pipes having OD 138, ID 140, a typical wall thickness 142, and mating threads 144 as typically used in the industry (which numerals 138, 140, 142, and 144 are not shown on FIGS. 1 and 2 for the sake of brevity). The ID 146 of the open hole segment 148 is shown in FIG. 2. The ID of the original borehole in the cased section is designated by the numeral 149 (which numeral is not shown for the purposes of brevity). The materials of all the components defined herein are those materials typically used in the industry. The lower end of drill pipe 150 having "male threads" is threaded into the upper end of drill pipe 152 having "female threads" at pipe joint 120.

Figure 3:
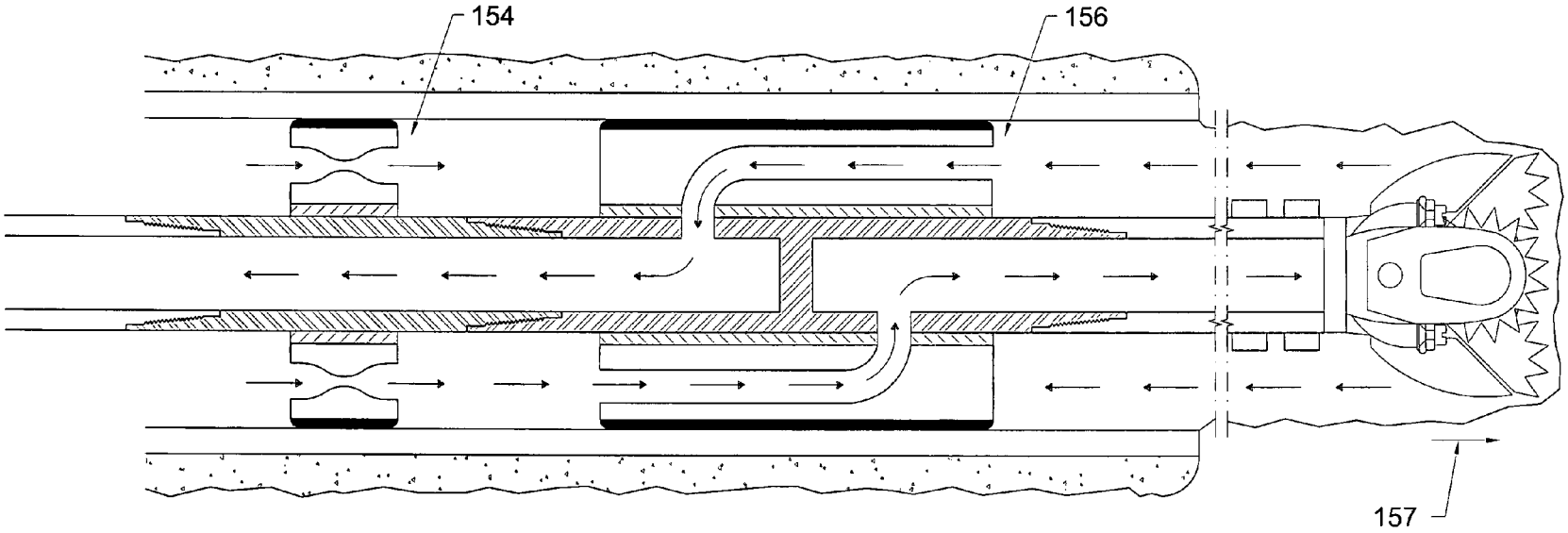
FIG. 3 shows the Leaky Seal and Cross-Over on separate threaded subassemblies screwed into a rotary drill string for drilling an extending portion of the open-hole well in FIGS. 1 and 2 which is a first embodiment the Universal Drilling Machine™. With this embodiment of the invention, the well can be drilled further with existing drilling equipment located at the wellsite. A pressure differential across Leaky Seal causes an additional force on the drill bit, and mud flow through the Cross-Over provides clean drilling mud to the bit.

FIG. 3 shows one embodiment of the invention having Leaky Seal Subassembly 154 and Cross-Over Subassembly 156 added to the rotary drill string shown in FIG. 2 to extend the open hole well bore. It is desired to extend the wellbore by a distance 157 shown in FIG. 3. In one embodiment, these components are added to existing drilling equipment at the wellsite.

There is not sufficient room on the face of FIG. 3 to put the following numerals. Consequently, the following numerals related to FIG. 3 as shown will be added to FIGS. 3A and 3B. In the following, and unless stated otherwise, the term "FIG. 3" shall mean FIG. 3 and/or FIG. 3A and/or FIG. 3B as a group. To make that overall assembly starting with the apparatus shown in FIG. 2, first pipe joint 120 is opened up by unthreading the mating parts. The lower end of the Cross-Over Subassembly 158 having male threads is then screwed into the upper end of drill pipe 152 having female threads. Then, the lower end of the Leaky Seal Subassembly 160 having male threads is screwed into the upper end 162 of the Cross-Over Subassembly having female threads. Then, the upper end of the Leaky Seal Subassembly 164 having female threads is joined to the lower end of drill pipe 150 having male threads. In FIG. 3, lower Drilling Bottom Hole Assembly 166 has also been added as a portion of the drilling machine as is typical in the art. This is abbreviated as a "DBHA" for Drilling Bottom Hole Assembly. The legend DBHA is not shown in FIG. 3 for the purposes of brevity. Another term for Drilling Bottom Hole Assembly is "downhole drill bit apparatus", and the terms may be used interchangeably for the purposes herein. This DBHA may be selected to have any number of sensors, transmitters, mud-pulse transmitters, bidirectional transmitter/receivers, measurement-while-drilling packages, logging-while-drilling packages, directional drilling packages, etc. that are typically used in the drilling industry. The machine created by adding the Leaky Seal Subassembly and the Cross-Over Subassembly to the existing drilling apparatus in FIG. 2 is one embodiment of the Universal Drilling Machine. In the foregoing, the Leaky Seal Subassembly 154 may simply be called the Leaky Seal Sub or simply the Leaky Seal. In the foregoing, the Cross-Over Subassembly 156 may be called the Cross-Over Sub, or simply the Cross-Over. This shortened nomenclature shall be used unless stated otherwise in the specification which follows.

The Leaky Seal 154 possess fluid passage 170. This fluid passage 170 may be called interchangeably the orifice of the Leaky Seal, the fluid passageway through the Leaky Seal and is an example of a fluid passage means. Fluid passage means 170 provides means to pass fluids from a first side of the Leaky Seal (uphole in one embodiment) to a second side of the Leaky Seal (downhole side in another embodiment). A fluid passage means may also provide a passageway for fluids to pass around the Leaky Seal, for example, through a portion of the mandrel underneath what would normally be called a seal mounted on the exterior of the mandrel. Figures showing such devices appear in various Provisional patent applications incorporated herein by reference, which also show wireline settable and retrievable Leaky Seals. Such a fluid passage means may include one or more of any such passages, through the seal, and/or around it. Other types of fluid passage means and will be discussed separately, for example please see FIG. 7 for yet another such embodiment. Any one well component may in fact possess one or more fluid passage means.

In FIG. 3, uphole side 172 of Leaky Seal 154 is exposed to average ambient wellbore pressure P172 in its vicinity. Downhole side 174 of Leaky Seal 154 is exposed to ambient wellbore pressure P174 in its vicinity. (These averages include the variations in pressure across the area exposed to the wellbore fluids caused by the presence of the orifice itself.) The numerical difference in pressure between the Uphole Side of the Leaky Seal and the Downhole Side of the Leaky Seal is the algebraic quantity: (P172−P174). That algebraic quantity multiplied by the area A of the Leaky Seal (if cylindrical in shape) generates a force FLS1 on the Leaky Seal given approximately by the following:

$$FLS1=(A)(P172-P174) \qquad \text{Equation 1}$$

Figure 3A:
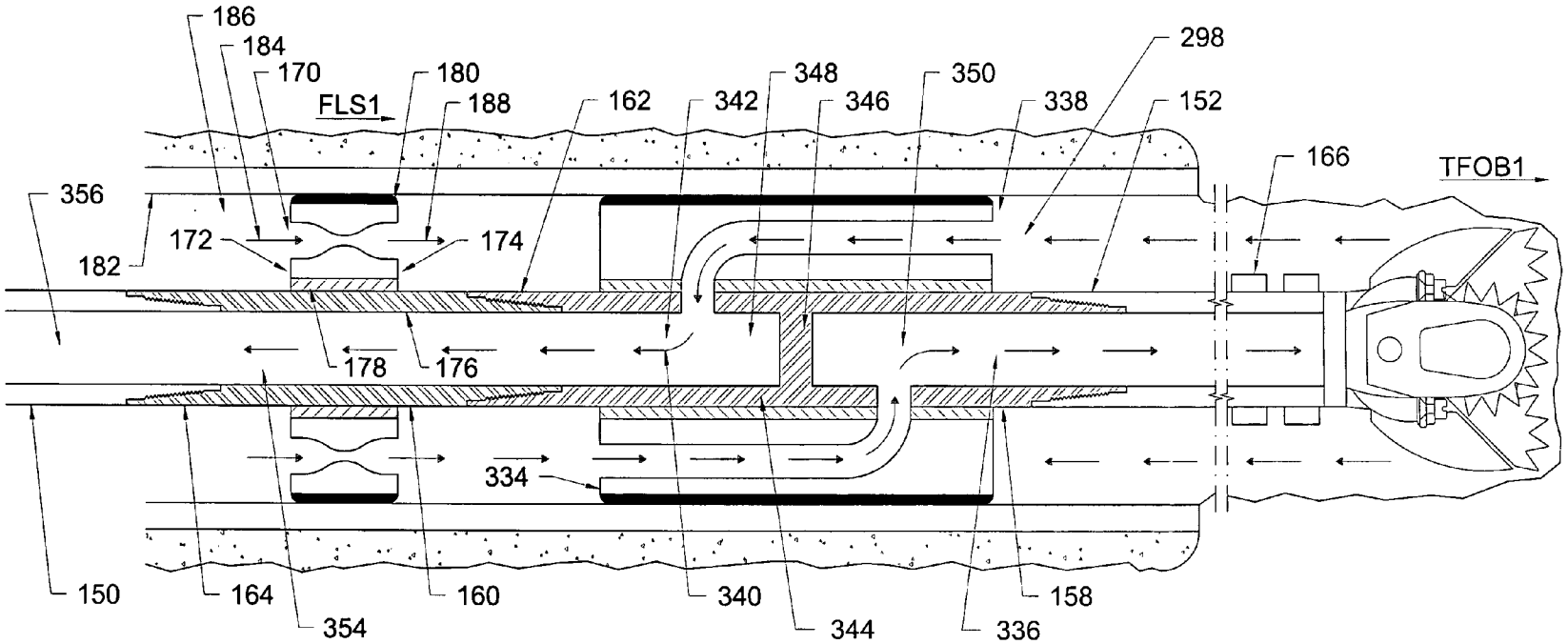
FIG. 3A—Same as FIG. 3, but with more room for numerals.

The legend FLS1 is shown in FIG. 3A. That force FLS1 is transmitted downhole through rigidly attached tubulars and provides an extra force, or an additional force, that is part of the total force on bit TFOB1 in FIG. 3A. That legend TFOB1 appears in FIG. 3A. Before the application of the force from FLS1, the initial, or beginning force of bit is defined as IFOB1, which legend is not shown in FIG. 3A in the interests of brevity. The extra force contributed through the tubulars of the system by the Force Sub is then algebraically (TFOB1–IFOB2). There are, of course, some losses in transmitting the force FLS1 through the tubulars, but that subject is subject to standard torque and drag analysis on drill strings that is known to anybody having ordinary skill in the art.

In several of the preferred embodiments, the uphole side 172 of Leaky Seal 154 may also be called a first side 172 of Leaky Seal 154 that, in several embodiments, may also be called a high pressure side 172 of the Leaky Seal.

In the following, the downhole side 174 of the Leaky Seal 154 may also be called a second side 174 of the Leaky Seal 154 that, in several embodiments, may also be called a lower pressure side 172 of the Leaky Seal.

Figure 6:
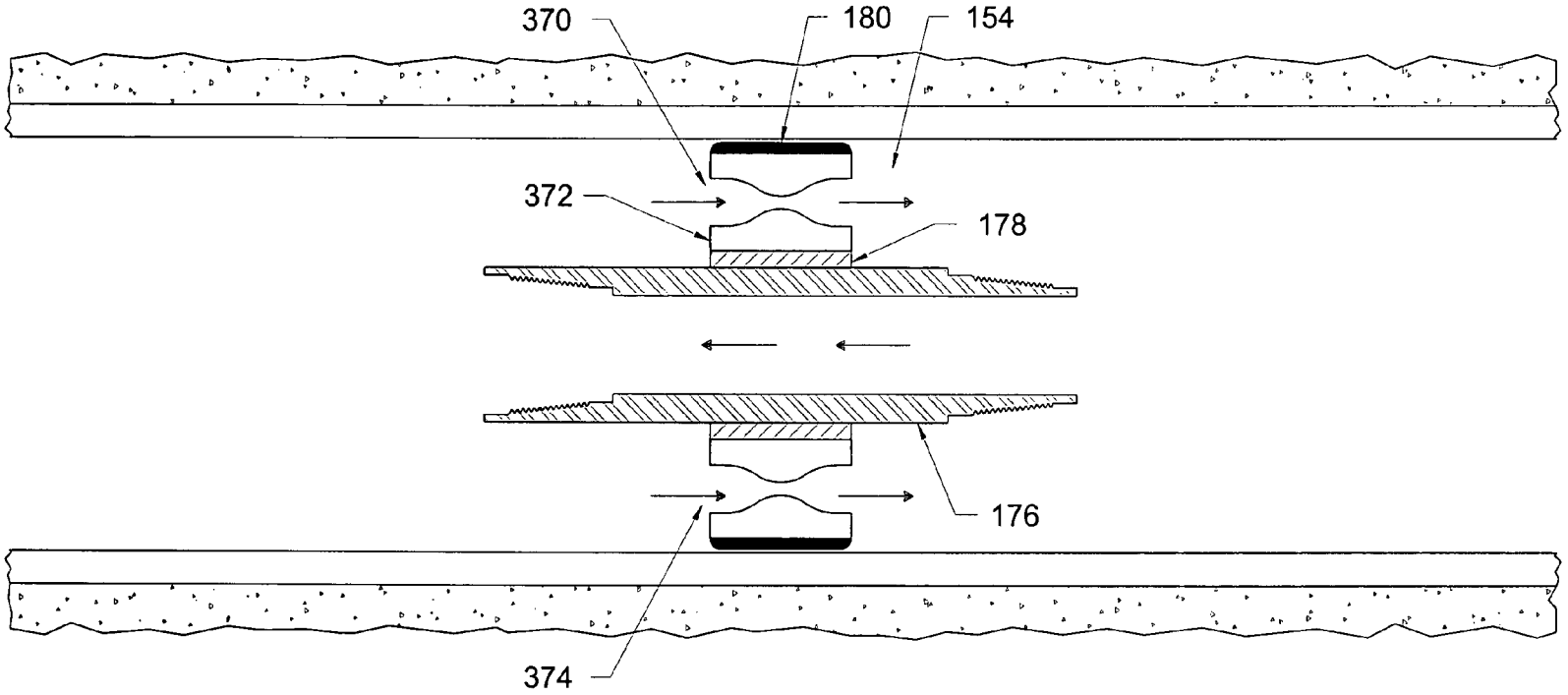
FIG. 6 shows an expanded view of the Leaky Seal that is rigidly attached to a threaded sub that screws into a rotary drill string.

Other means to generate forces on downhole components are also discussed in relation to other embodiments below. In one embodiment, the Leaky Seal 154 is rigidly attached to its mandrel 176 by attachment means 178. The Leaky Seal 154 has exterior sliding and rotating seal 180 that makes hydraulic sealing contact with the interior of portion of the casing designated by 182 in FIG. 3. Arrow 184 shows fluid flowing through the annulus 186 between the OD of drill pipe 150 and the ID of casing 102 and into the orifice 170 of the Leaky Seal. Arrow 188 shows fluid flowing out of the orifice of the Leaky Seal. The fluid flows through the body of the Leaky Seal which body is not shown in FIG. 3, but which is shown in FIG. 6 (element 372).

FIG. 3 shows Cross-Over 156. In one embodiment, Cross-Over 156 is rigidly attached to its mandrel 190 by suitable attachment means 192. The Cross-Over 156 has exterior sliding and rotating seal 194 that makes hydraulic sealing contact with the interior portion of the casing designated by 196 in FIG. 3. Arrow 198 shows fluid flowing through the annulus 200 between the OD of mandrels 176 and 190 and the ID of casing 102 below the Leaky Seal and above the Cross-Over. Fluid 202 then flows through first channel entry 204 and down first channel 206 through the body of the Cross-Over to first channel exit 208 through second interior portion 350 of mandrel 190. Fluid 209 continues to flow downhole through the second interior portion 350 of mandrel 190 through the interior 210 of Drilling Bottom Hole Assembly 166 and through the nozzles 212 of the drill bit (element 212 not shown for brevity).

In FIG. 3, then dirty mud with cuttings 213 then flows up the annulus 214 formed between the Drilling Bottom Hole Assembly 166 and the inside wall of the open hole 216. Thereafter, the dirty mud with cuttings 218 flows upward in the annulus 220 formed between the OD of drill pipe 152 and the OD of mandrel 190 and the interior portion of the casing 196. Thereafter, dirty mud with cuttings 222 flows through second channel entry 226 and then through second channel 228 through the body of the Cross-Over to second channel exit 230 through the first interior portion 348 of mandrel 190. Dirty mud with cuttings 232 then flows uphole through the first interior portion 348 of mandrel 190, through the interior 354 of mandrel 176 and through the inside diameter 356 of drill pipe 150 towards the surface.

So, FIG. 3 shows that the pressure drop across Leaky Seal causes an additional force on the bit, and the mud flow through Cross-Over provides clean drilling mud to the bit. The additional force on bit is transmitted via rigid tubulars connecting the Leaky Seal to the drill bit, collectively identified by the legend 298 in FIG. 3A in particular. Such tubulars include mandrels and drill strings that are attached to various different types of DBHA's.

As stated above, Cross-Over 156 possesses first channel entry 204. That first channel entry 204 is located on a first annular side 334 of Cross-Over 156 that is also called the upper annular side 334 of Cross-Over 156 that, in some embodiments, is called the high pressure annular side 334 of Cross-Over 156.

As stated above, fluid flows down first channel 206 through the body of the Cross-Over to the first channel exit 208 and through the second interior portion 350 of mandrel 190. Fluid 209 flowing downward within the second portion 350 of mandrel 190 is flowing downward within the lower central portion 336 of Cross-Over 156, which is also called the second central portion of Cross-Over 156, that in some embodiments is called the low pressure central portion of Cross-Over 156.

As stated above, dirty mud with cuttings 222 flows through second channel entry 226. That second channel entry 226 is located on a second annular side 338 of Cross-Over 156 that is also called the lower annular side 338 of Cross-Over 156, that in some embodiments, is called the low pressure annular side 338 of Cross-over 156.

As stated above, fluid flows through second channel 228 through the body of the Cross-Over to second channel exit 230 through the first interior portion 348 of mandrel 190. Dirty mud with cuttings 232 then flows uphole through the first interior portion 348 of mandrel 190. Dirty mud with cuttings 340 is flowing upward within the upper central portion 342 of Cross-Over 156, which is also called the first central portion 342 of Cross-Over 156, that is some embodiments is called the flowing uphole pressure side 342 of Cross-Over 156.

In several preferred embodiments of the invention, mandrel 190 is comprised of tubular-like body 344 with interior blockage 346, having male threaded ends on the downhole side and female threads on the uphole side, that is manufactured as one component of steel, for example, type 304 stainless steel. Accordingly, mandrel 190 has a first interior portion 348 and has a second interior portion 350. First interior portion 348 is also called the uphole interior portion of mandrel 190. Second interior portion 350 is also called the downhole interior portion of mandrel 190.

Figure 3B:
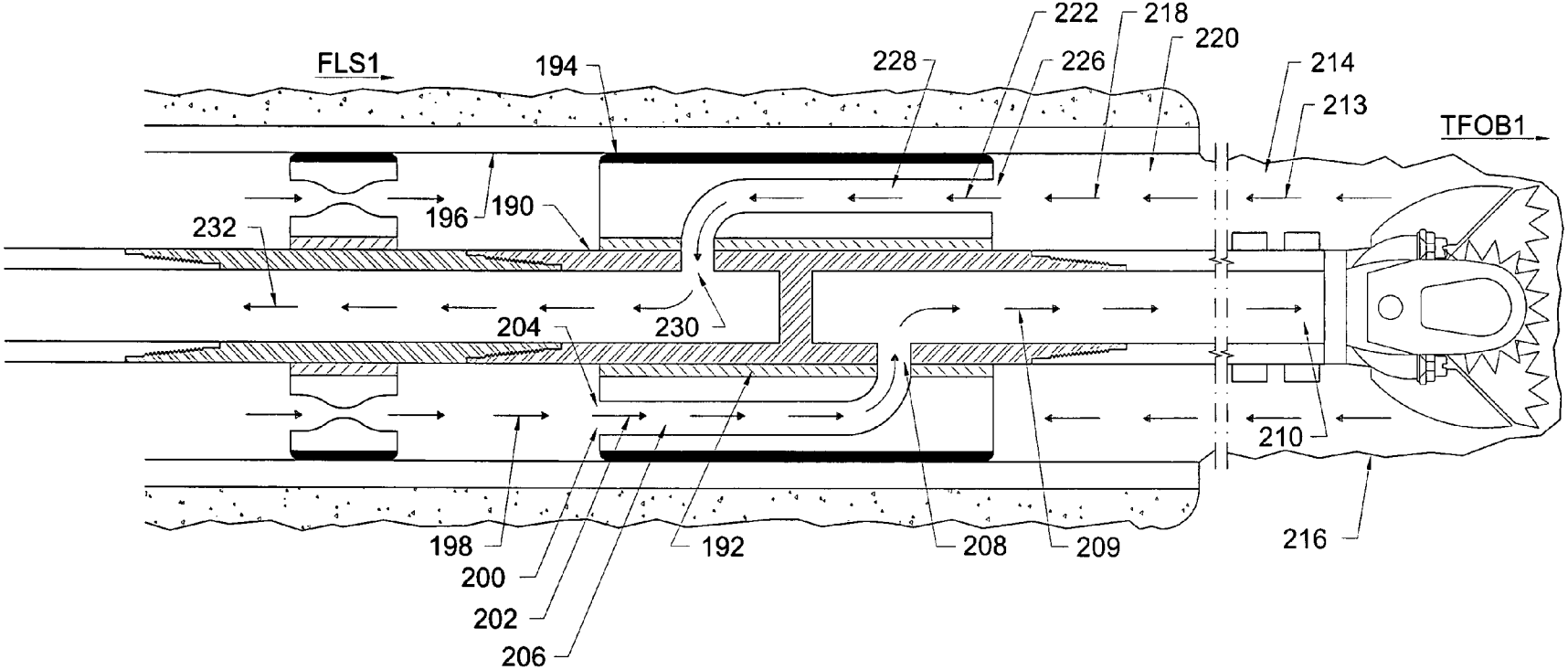
FIG. 3B—Same as FIG. 3, with additional room for numerals.
Figure 3C:
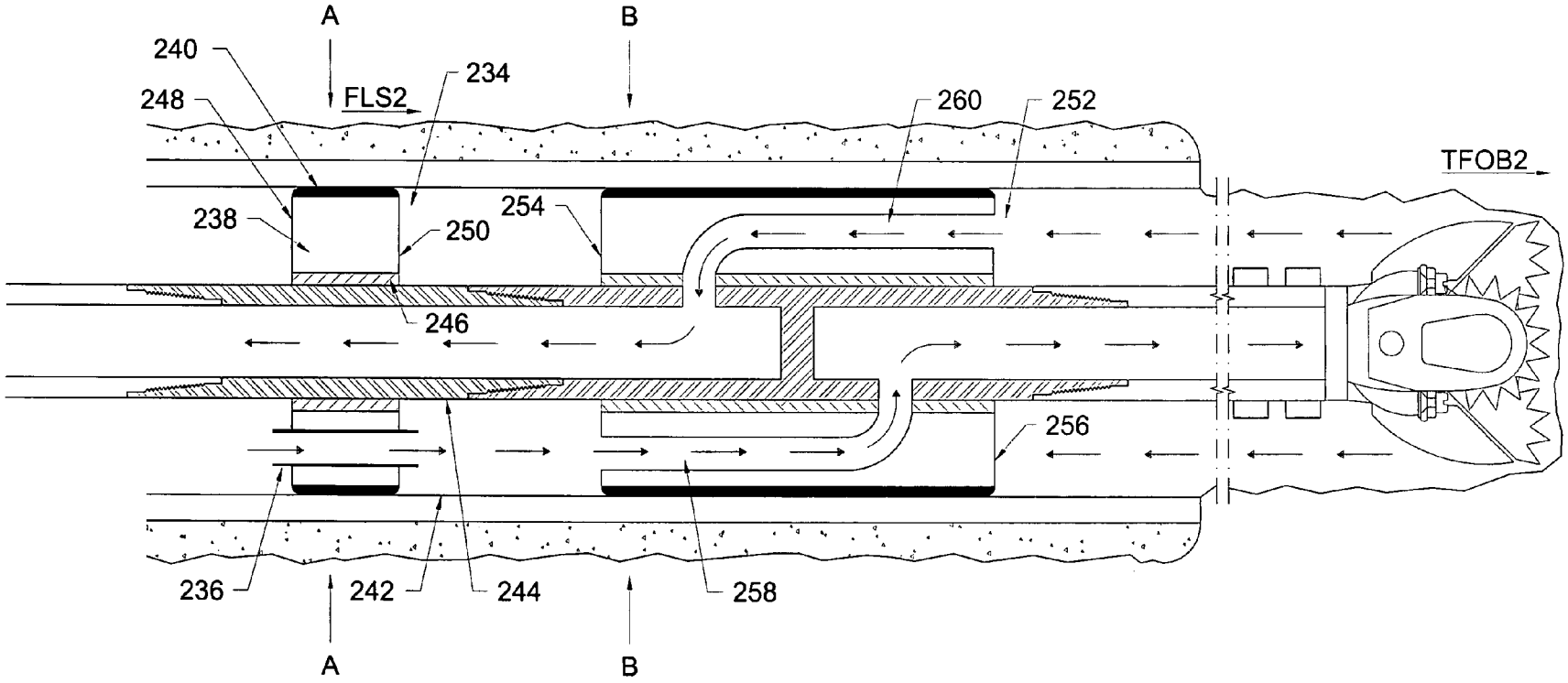
FIG. 3C is similar to FIGS. 3, 3A and 3B, except in this preferred embodiment the Leaky Seal possesses a round hollow tube passing through the portion of the body of the Leaky Seal.

FIG. 3C is similar to FIGS. 3, 3A and 3B, except in this preferred embodiment the Leaky Seal 234 possesses a round hollow tube 236 passing through the portion of the body 238 of the Leaky Seal. The length of round hollow tube 236 is designated by L236, and its inside diameter is ID236, although those legends are not shown on FIG. 3C in the interests of brevity. Leaky Seal 234 has exterior sliding and rotating seal portion 240 that makes hydraulic sealing contact with the interior of portion of the casing designated by 242 in FIG. 3C. In one preferred embodiment, the Leaky Seal 234 is rigidly attached to its mandrel 244 by attachment means 246. Round hollow tube 236 is an example of a fluid passageway through the Leaky Seal and is an example of a fluid passage means. Round hollow tube 236 is also an example of a fluid channel through the Leaky Seal.

In FIG. 3C, the uphole side 248 of Leaky Seal 234 is exposed to average ambient wellbore pressure P248 in its vicinity, but the legend P248 is not shown in FIG. 3C for the purposes of brevity. Downhole side 250 of Leaky Seal 234 is exposed to ambient wellbore pressure P250 in its vicinity, but the legend P250 is not shown in the interests of brevity. The difference in these pressures provides the Pressure Differential on the Leaky Seal that produces a force on the Leaky Seal.

The force FLS2 on the Leaky Seal 234 is shown as a legend in FIG. 3C. The total force on bit TFOB2 is also shown as a legend in FIG. 3C.

Also shown in FIG. 3C is the Cross-Over generally shown as element 252. This is essentially the same as element 156 in FIG. 3. In FIG. 3C, the uphole side of annular portion 254 of Cross-Over 252 is exposed to average ambient wellbore pressure P254 in its vicinity, but the legend P254 is not shown in FIG. 3C for the purposes of brevity. Downhole side of annular portion 256 of Cross-Over 252 is exposed to ambient wellbore pressure P256 in its vicinity, but the legend P256 is not shown in the interests of brevity. The difference in these pressures provides any Pressure Differential on the Cross-Over. In FIG. 3C, first fluid flow channel 258 has a substantial tubular shape and an average inside diameter ID258, although the legend ID258 is not shown on FIG. 3C for the purposes of brevity. In FIG. 3C, second fluid flow channel 260 has a substantial tubular shape and an average inside diameter ID260, although this legend is not shown in FIG. 3C for the purposes of brevity. If ID258 and ID260 are larger than ID236, then there will be relatively little Pressure Differential across the Cross-Over, and therefore little net force applied to the Cross-Over due to flowing fluids. In this case, the primary force on the combined Leaky Seal and Cross-Over in FIG. 3C will come from the net force on just the Leaky Seal caused by the Pressure Differential Across the Leaky Seal.

Figure 3D:
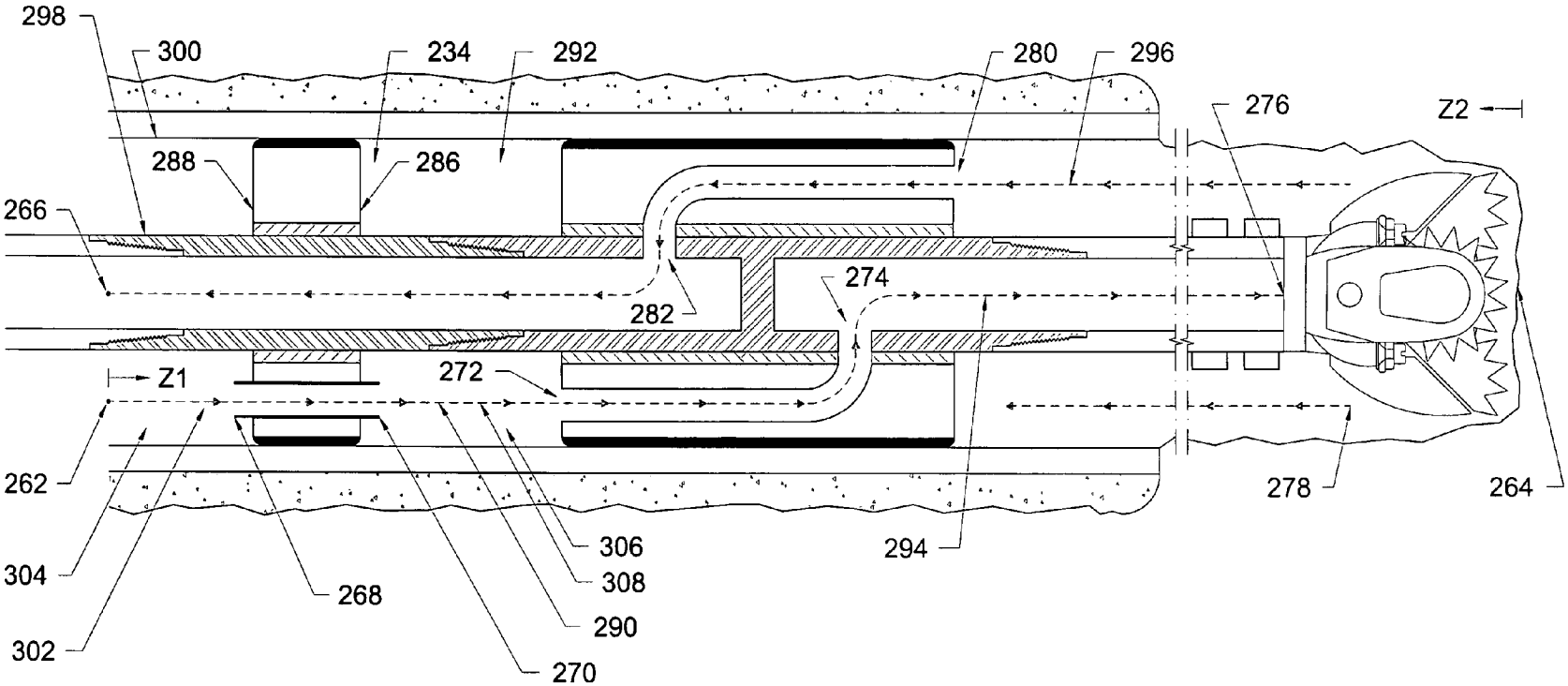
FIG. 3D is similar to FIG. 3C, except several reference points are identified for pressure and other measurements.

FIG. 3D is similar to FIG. 3C, except several reference points are identified for pressure measurements. Numeral 262 is located a distance D262 above the Upper Face 266 of the Leaky Seal, although the legend D262 is not shown in FIG. 3D for the purposes of brevity. A first pressure vs. distance P1(262 vs. Z1) is then calculated and/or measured starting with Z1 having the value of zero at position 262, and various different values measured with a tape measure, for example, at the following sequence of locations ("first path"): 268, 270, 272, 274, 276 and at the face of the drill bit 264. Then, a second pressure vs. distance P2(264 vs. Z2) is then calculated and/or measured starting with Z2 having the value of zero at the position of 264, and various different values at the following sequence of locations: 278, 280, 282, and ending at the position 266 that is a distance D276 above the Upper Face 266 of the Leaky Seal ("second path"), although that legend is not shown in FIG. 3D for the purposes of brevity.

The mud flow system in the well shown in FIG. 3D takes path 1 downhole, and then takes path 2 uphole. Paths 1 and 2 cross-over between certain annular portions and certain portions flowing through the ID's of mandrels and drill pipes as described above. Collectively Paths 1 and Paths 2 is called the "Mud Flow Path" for the well shown in FIG. 3D that is identified by numeral 308. Element 308 depicts the entire Mud Flow Path downhole, and then uphole. The portion of the "Mud Flow Path" 290 carrying clean mud downhole is shown in FIG. 3D. The portion of the "Mud Flow Path" 291 carrying dirty mud uphole is not shown in FIG. 3D for the purpose of clarity.

In FIG. 3D, the drilling machine 292 has a Mud Flow Path that provides clean drilling mud 294 to the drill bit and returns dirty mud with rock chips 296 that is a direction towards the surface.

Any portion of the Mud Flow Path having clean mud, and that passes through an annular region between the OD of the tubulars 298, and the ID 300 of casing 102, is an Annular Clean Mud Flow Path 302. Examples of an annular region between the OD of tubulars 298 and the ID 300 of casing 102 carrying clean drilling mud are shown by numerals 304 and 306 in FIG. 3D. The portion of the Mud Flow Path Carrying clean mud is defined as numeral 299 (not shown for the purposes of simplicity).

As described herein, the average pressure is available at all points within the Mud Flow Path. The average mud flow rate, often expressed in gallons per minute, is available at all points within the Mud Flow Path. In analogy with above, a first mud flow rate vs. distance MFR(262 vs. Z1) is calculated or measured. In analogy with the above, a second mud flow rate vs. distance MFR(264 vs. Z2) is calculated or measured. These two legends are not shown in FIG. 3D for the purposes of brevity.

All hydraulic parameters are available by either calculation, or measurement, at all points along the Mud Flow Path. Starting at point 262, the Mud Flow Path goes to the bit, and then dirty mud with chips proceeds to point 266.

Pressure at location 288 is the ambient pressure P288 on a first side of the Leaky Seal 234. Pressure at location 286 is the ambient pressure P286 on a second side of the Leaky Seal 234. The average fluid flow rate through round hollow tube 236 at point 290 is given by MFR290. The legends P286, P288, and MFR290 are not sown in FIG. 3D for the purposes of brevity.

In brief summary, FIGS. 3C and 3D have shown a Leaky Seal (234) possessing a fluid passageway (236) through the Leaky Seal that causes a predetermined volume of fluid per unit time (MFR290) to pass through the fluid passageway upon application of a predetermined pressure difference (P288−P286) applied between a first side of the Leaky Seal (288) and a second side (286) of the Leaky Seal.

Several relevant hydraulic calculations have been done at www.efunda.com for the round hollow tube 236 in FIG. 3C that is also shown on FIG. 3D.

For one set of typical parameters for a clean mud flowing at 200 gallons per minute through the ID236 of the tube equal to 0.59 inches, and the length of the tube L236 equal to 11 inches, results in a pressure drop across the tube itself of 725 psi, that consumes 84.6 horsepower.

For another set of typical parameters for a clean mud flowing at 600 gallons per minute through the ID236 of the tube equal to 0.91 inches, and the length of the tube L236 equal to 11 inches, results in a pressure drop across the tube itself of 725 psi, that consumes 253.8 horsepower.

Such hydraulic calculations are routinely available, and are described in the Standard Text Books defined below.

The terms "Newtonian Model" and "Bingham Plastic Model" are defined in Schlumberger's Oilfield Glossary (www.glossary.oilfield.slb.com).

In the "Newtonian Model", the shear stress is linear with the shear rate. Water at room temperature can be described as a Newtonian fluid.

Bingham plastic fluids behave differently. The Oilfield Dictionary further states: "Fluids obeying this model (two parameter rheological model) are called Bingham plastic fluids and exhibit a linear shear-stress, shear-rate behavior after an initial shear stress threshold has been reached. Plastic viscosity (PV) is the slope of the line and the yield pint (YP) is the threshold stress."

In terms of fluid flow through the hollow tube 236, a Newtonian fluid will move through the tube for any infinitesimal pressure applied to the fluid. So, the pressure drop across the tube caused by fluid flow through the tube is necessarily monotonically increasing, and is not subject to any discontinuous change.

On the other-hand, if a Bingham plastic fluid, there will be a certain Pressure Threshold to be reached before fluids flow under the application of pressure. In this case, an infinitesimal pressure applied to the fluid will not cause the fluid to move through the tube. In that case, the fluid flow through the tube is not monotonically increasing, but undergoes a discontinuous change when the applied pressure exceeds the Pressure Threshold.

It should also be stated that the insertion of any check valve into the Mud Flow Path 308 that contains a Leaky Seal is an embodiment of this invention. The method of inserting one or more check valves into the Mud Flow Path 308 that contains a Leaky Seal is an embodiment of this invention. The use of any float valve, normally associated with cementing operations, in Mud Flow Path 308 that contains a Leaky Seal is also an embodiment of this invention. The use of any flapper valve in the Mud Flow Path 308 that contains a Leaky Seal is an embodiment of this inventing. The use of any hydraulic device, or hydraulic means, in the Mud Flow Path 308 that contains a Leaky Seal is an embodiment of the invention. The use of any ball and dart device or system in the Mud Flow Path 308 that contains a Leaky Seal is an embodiment of this invention.

Figure 3E:
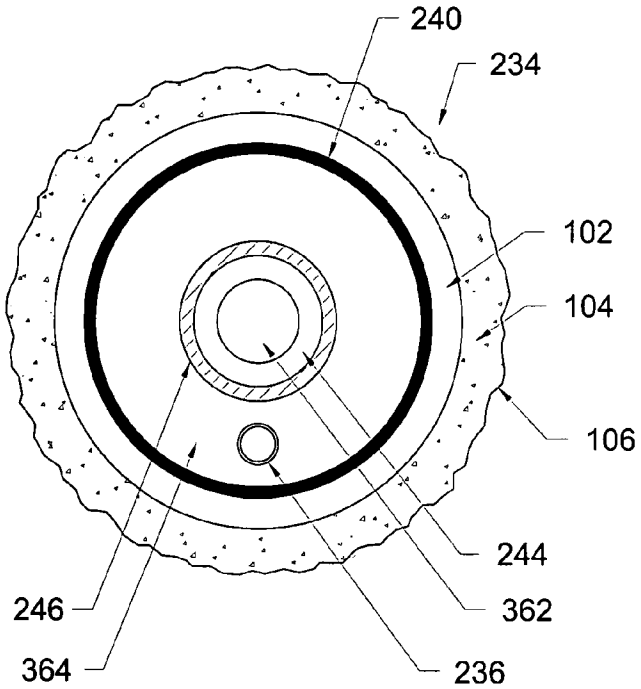
FIG. 3E shows a cross section of a Leaky Seal.

FIG. 3E shows a cross section of Leaky Seal 234. FIG. 3C defines cross-section A-A (a plane perpendicular to the paper of FIG. 3C defines the planar cross-section). Any numerals not defined in this description of FIG. 3E have already been previously defined.

FIG. 3E shows the cross section of Leaky Seal 234. All the numerals except a few have already been defined. The central passage through mandrel 244 is identified by numeral 362.

In the case of FIG. 3E, the area 364 subject to applied fluid pressure is circular. In FIGS. 3C and 3D, fluid flow per unit time (MFR290) is caused to pass through the fluid passageway upon application of a predetermined pressure difference (P288–P286) applied between a first side of the Leaky Seal (288) and a second side (286) of the Leaky Seal. The pressure difference acts upon the area 364. That area is called A364, but that legend does not appear on FIG. 3E for the purposes of brevity.

Therefore, the Force applied to the Leaky Seal FLS, is in this embodiment, given by:

$$FLS=(A364)(P288-P286) \qquad \text{Equation 2}$$

This force is imparted through the rigid tubular elements to the drill bit, and is used to impart an "extra load" to the drill bit.

Figure 3F:
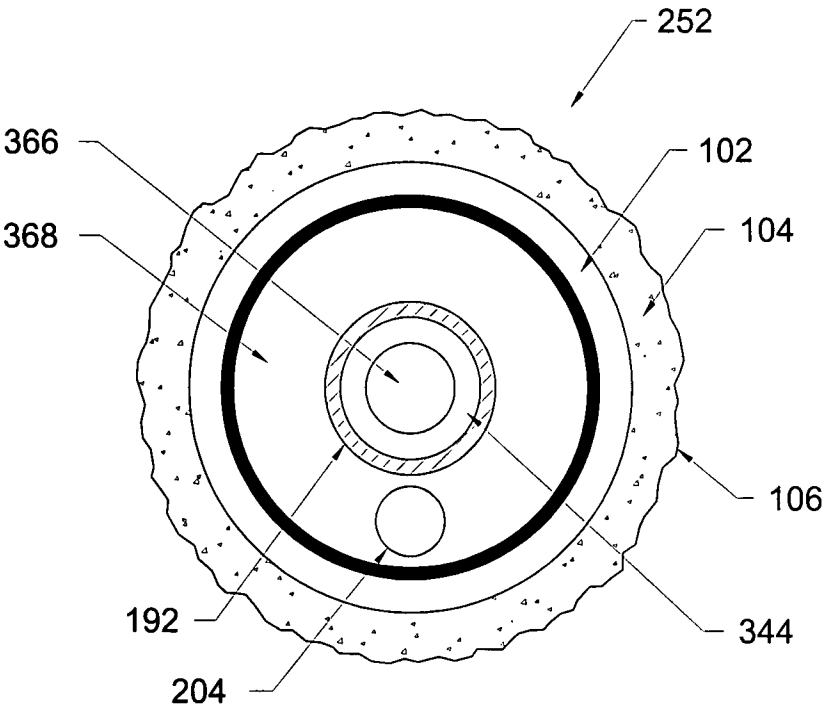
FIG. 3F shows a cross section of a Cross-Over.

FIG. 3F shows a cross section of Cross-Over 252. FIG. 3C defines cross-section B-B (a plane perpendicular to the paper of FIG. 3C defines the planar cross-section).

FIG. 3F shows the cross section of Cross-Over 252. All the numerals except a few have already been defined. The central passage 366 is shown through the upper central portion 342 of Cross-Over 156. Any numerals not defined in this description of FIG. 3E have already been previously defined.

In FIG. 3F, the area 368 is subject to applied fluid pressure. That area is defined as A368, but that legend is not shown on FIG. 3F in the interests of brevity. As discussed earlier, in several preferred embodiments, the area of the first channel entry 204 is chosen to be much larger than the area of round hollow tube 236 passing through the portion of the body 238 of the Leaky Seal. As previously discussed, when the passageways through the Cross-Over are much larger than the area of the round hollow tube 236, the net force from fluid pressure on the Cross-Over can be designed to be negligible. (However, in yet other preferred embodiments, the size of area of the passageways through the Cross-Over may be made smaller so that the Cross-Over can be designed to influence the force on the drill bit, but those embodiments will not be discussed further here in the interest of brevity.)

Figure 4:
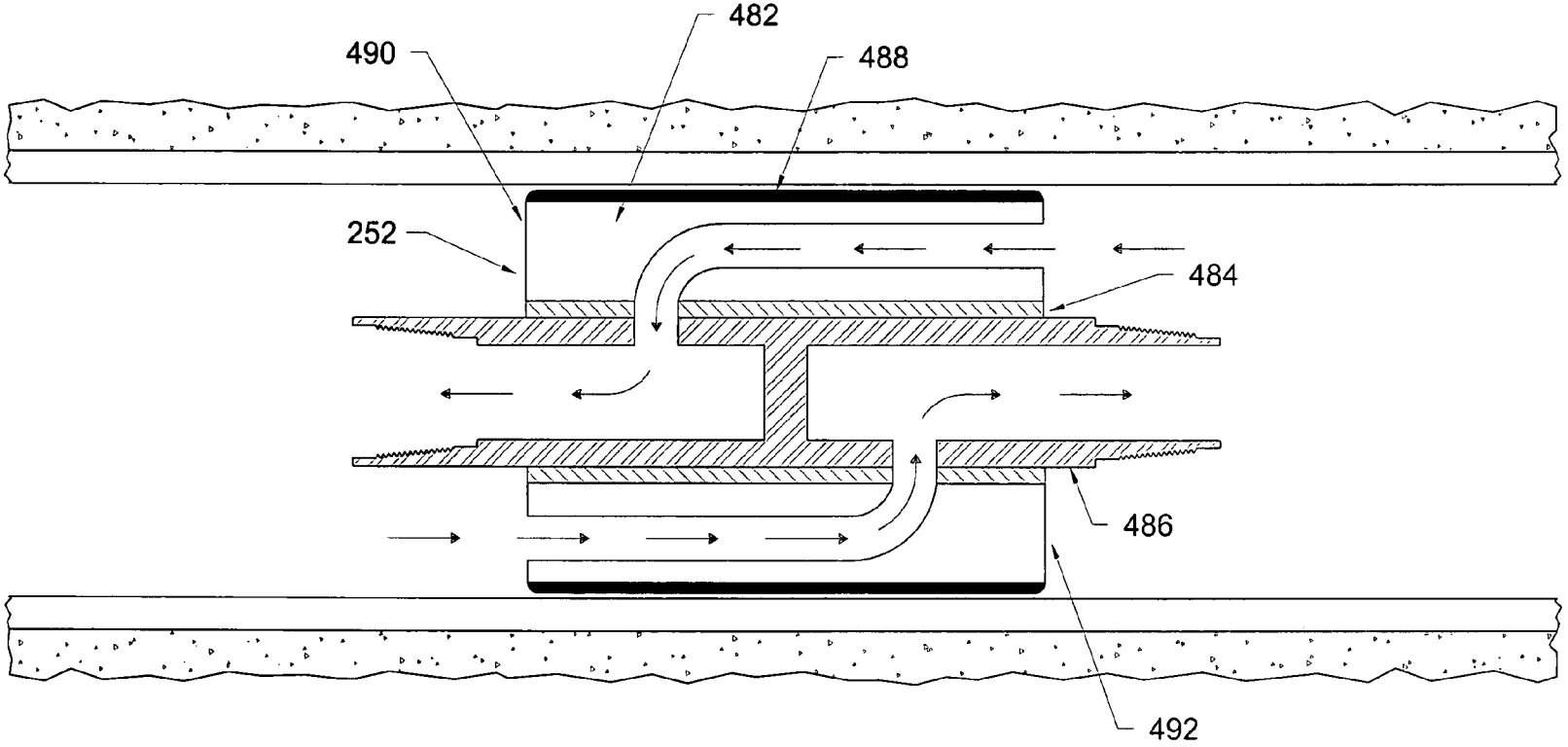
FIG. 4 shows an expanded view of a Cross-Over that is rigidly attached to a threaded sub that screws into a rotary drill string.

FIG. 4 shows an expanded view of a Cross-Over that is rigidly attached to a threaded sub that screws into a rotary drill string. FIG. 4 shows an expanded view of the detail in Cross-Over 252 that is defined in FIG. 3C. The Cross-Over 252 has Cross-Over body 482. In one embodiment of the invention, the body 482 is formed nitrile, and is attached by attachment means 484 to the exterior of portion of threaded mandrel 486. The exterior sliding and rotating seal 488 is a nitrile with good wear resistant properties. In one embodiment, the attachment means 484 is a thin layer of glue that was used when the body was formed on mandrel 486. In another embodiment of the invention, the body 482 is formed with any appropriate elastomer for the wellbore conditions and the exterior sliding and rotating seal 488 is formed from another appropriate wear resistant elastomer. Typical techniques and materials in the industry are used to construct different embodiments of the Cross-Over and to attach it by attachment means 484 to its mandrel 486. One preferred method of manufacture is to form a Cross-Over made of an elastomer on its mandrel.

Figure 5:
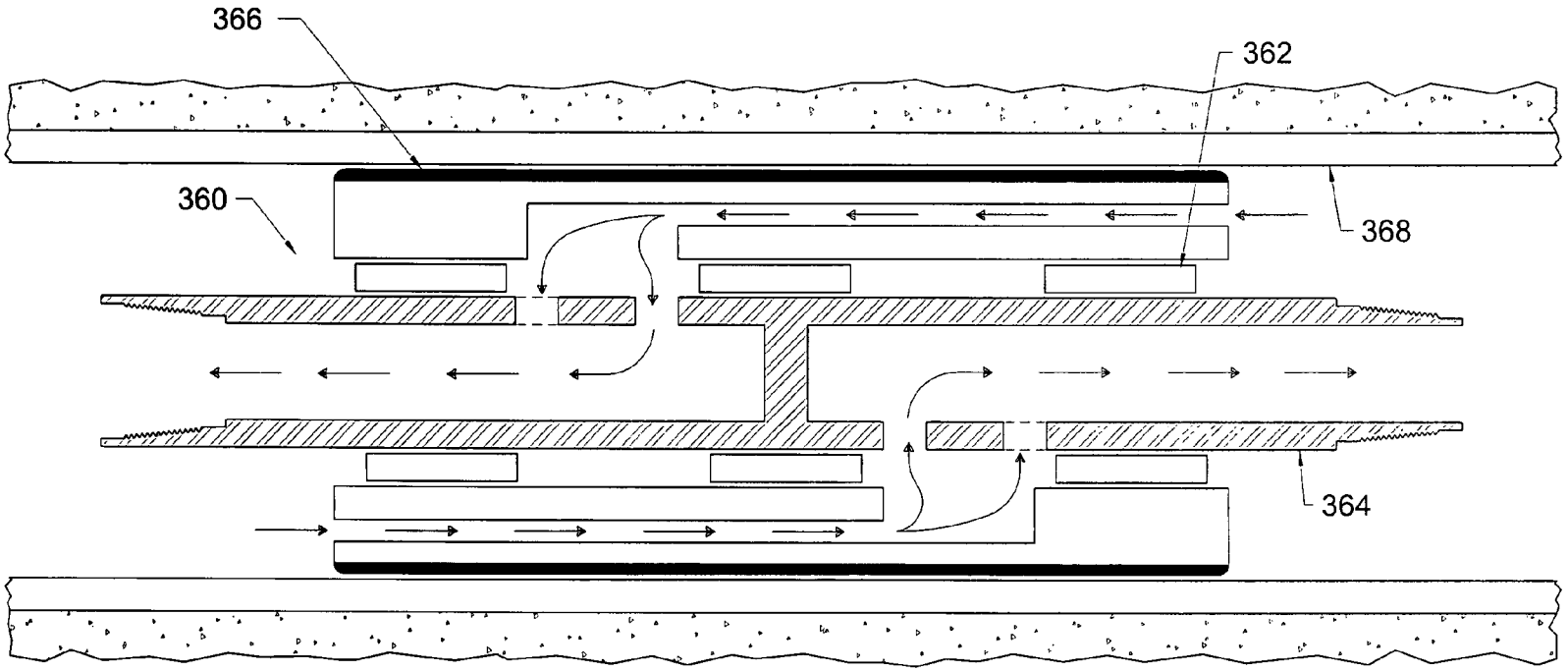
FIG. 5 shows an expanded view of another Cross-Over that possesses bearings which allows it to rotate with respect to the rotary drill string.

FIG. 5 shows an expanded view of another Cross-Over that possesses bearings which allows it to rotate with respect to the rotary drill string. FIG. 5 shows Cross-Over 360 having bearings 362 mounted on mandrel 364 which has exterior sliding (and rotating if desirable) seal 366 that makes hydraulic sealing contact with the interior of portion of the casing designated by numeral 368. In various embodiments, the bearings extend the life of the exterior sliding seal 366. In another embodiment, the exterior seal 488, which predominantly slides in this application, but may also do some rotation, is made of a suitably wear resistant elastomer chosen for the wellbore conditions.

FIG. 6 shows an expanded view of the Leaky Seal that is rigidly attached to a threaded sub that screws into a rotary drill string. In particular, FIG. 6 shows Leaky Seal 154 as shown in FIG. 3. First hollow passageway 370 through the body 372, and second hollow passageway 374 through the body 372 are shown. In one embodiment of the invention, the body 372 is formed nitrile, the exterior sliding and rotating seal 180 is a nitrile with good wear resistant properties, and the attachment means 178 is a thin layer of glue that was used when the body was formed on mandrel 176. In another embodiment of the invention, the body 372 is formed with any appropriate elastomer for the wellbore conditions and the exterior sliding seal 180 is formed from another appropriate wear resistant elastomer. Typical techniques and materials in the industry are used to construct different embodiments of the Leaky Seal and to attach it by attachment means 178 to its mandrel 176.

One method of manufacture is to form a Leaky Seal made of an elastomer on its mandrel. In the cases of the first hollow passageway 370, there is a first tapered entrance 310 into the interior of that passageway on a first uphole side 312 of the Leaky Seal, and there is a second tapered entrance 314 on the exit of that passageway on a second downhole side 316 of the Leaky Seal (elements 310, 312, 314 and 316 are not shown in FIG. 6 for the purposes of simplicity). Similar comments apply to the second hollow passageway 374. The uphole annular side 490 of the Cross-Over 482 is identified in FIG. 4. The downhole annular side of Cross-Over 492 of Cross-Over 482 is also identified in FIG. 4.

Figure 6A:
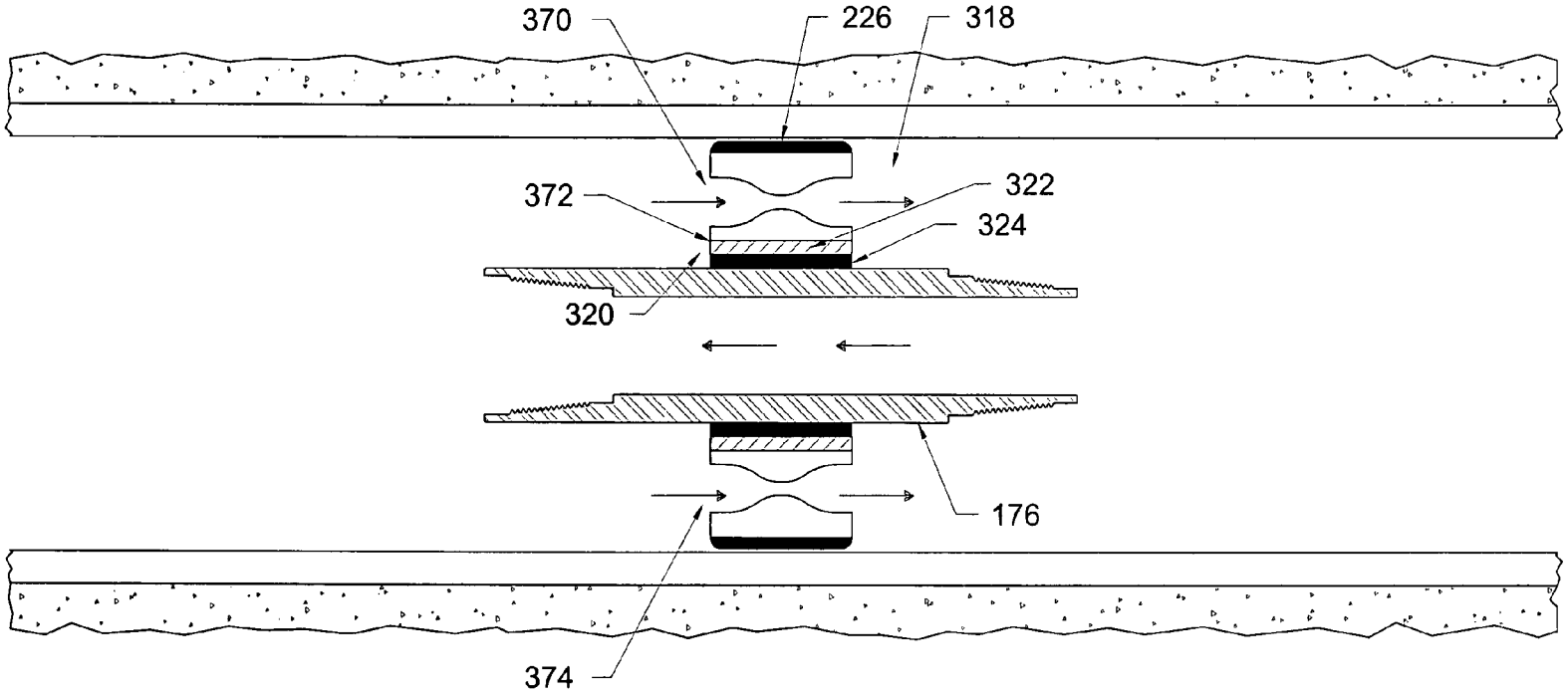
FIG. 6A shows an expanded view of a Leaky Seal that possesses bearings which allows it to rotate with respect to a rotary drill string.

FIG. 6A is similar to FIG. 6. However, here Leaky Seal 318 possesses a rotating bearing assembly 320 that is comprised of bearing mounting 324 on the OD of mandrel 176 and bearing rotating portion 322. The body of the Leaky Seal is suitably attached to the outer portion of the bearing rotating portion 322 by suitable attachment means 324 (not shown). One attachment means includes a glue. In one embodiment, the body is fabricated from a suitable elastomer, and is formed in-place on the bearing rotating portion 322. In another embodiment, the exterior seal 226, which predominantly slides in this application, but may also do some rotation, is made of a suitably wear resistant elastomer chosen for the wellbore conditions.

Figure 7:
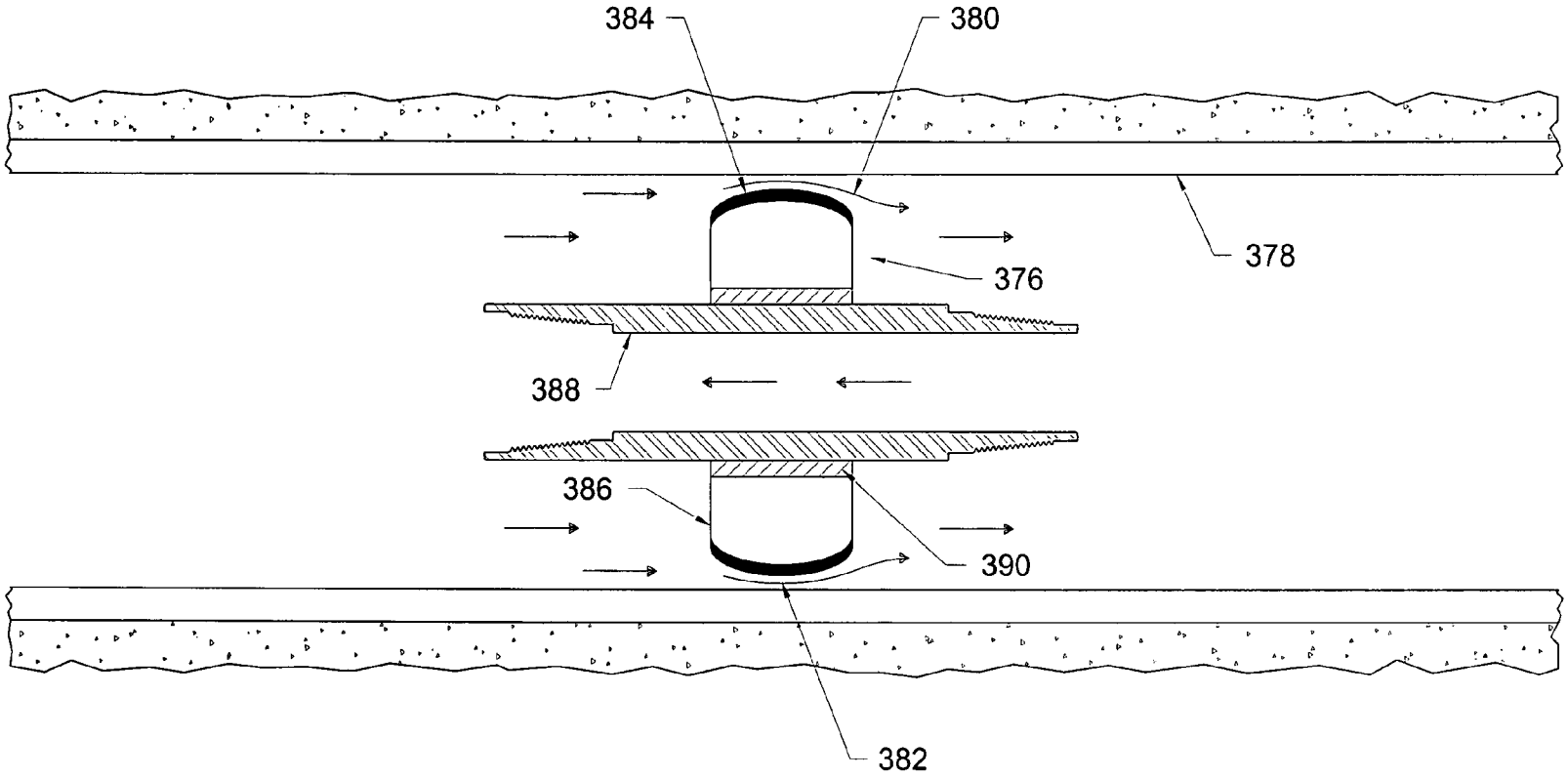
FIG. 7 shows another form of a Leaky Seal that allows fluid passage around its outside diameter that also allows the drill string to rotate within the casing with minimal resulting friction caused by the Leaky Seal.

FIG. 7 shows another form of a Leaky Seal that allows fluid passage around its outside diameter that also allows the drill string to freely rotate within the casing. Leaky Seal 376 has an outside diameter OD376 that is smaller than the inside diameter of the casing 378 designated with the legend ID378. The legends OD376 and ID378 are not shown in FIG. 7 for the purposes of brevity. This embodiment of the invention allows fluids 380 to pass around the space available between the respective inside and outside dimensions. This extra available space 382 is a form of a passageway around the Leaky Seal which is an example of one preferred embodiment of a fluid passage means. Leaky Seal 376 possesses exterior sliding and rotating seal 384 that makes hydraulic sealing contact with the interior portion of the casing 378. The body of the Leaky Seal 386 is rigidly attached to its mandrel 388 by suitable attachment means 390. The embodiment of Leaky Seal 376 allows the drill pipe to rotate freely while minimizing friction between the Leaky Seal and the inside diameter of the casing.

Yet other types of fluid passage means include passage around a seal through a passageway on the interior side of the seal that would require a modification of the mandrel (compared to that shown in FIG. 7). Here, the fluid passing by the Leaky Seal would flow through a portion of the mandrel on which the seal is mounted. This is yet another embodiment of a fluid passage means. There are many embodiments of fluid passage means that allow a Pressure Differential to be established across the Leaky Seal which results in a force applied to the Leaky Seal. In this disclosure "fluid" includes any wellbore fluid normally encountered in a wellbore specifically including oil, water, gas, solids, and mixtures of them.

Figure 8:
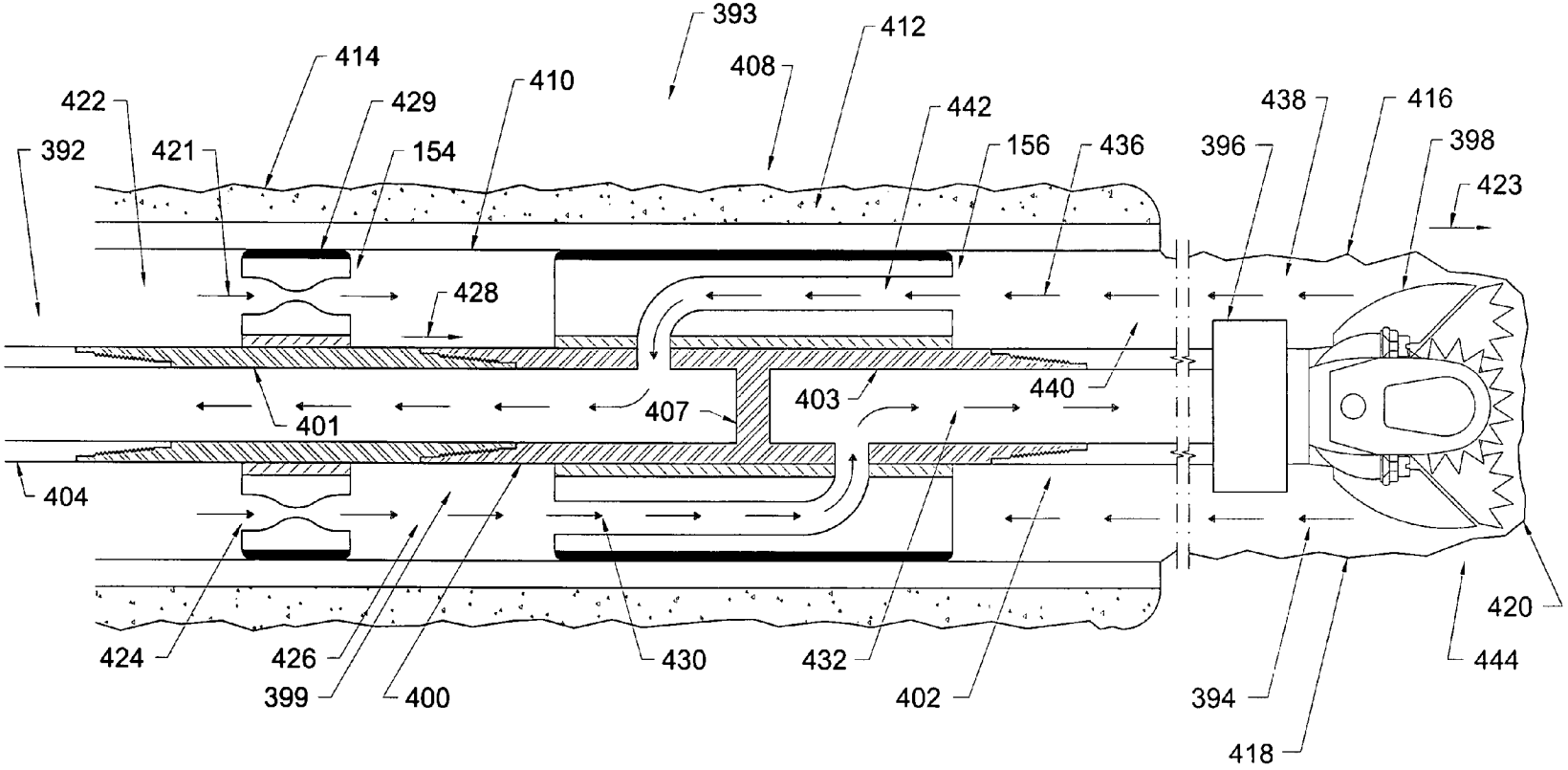
FIG. 8 shows the Leaky Seal and Cross-Over on separate mandrels inserted into a drill string in a previously cased well for extending an open hole portion of the well using slide drilling techniques which is a second embodiment of the Universal Drilling Machine.

FIG. 8 shows a Cross-Over and Leaky Seal on separate mandrels inserted into a drill string in a previously cased well for extending an open hole portion of the well using slide drilling techniques which is a second embodiment of the Universal Drilling Machine. Slide drilling techniques often require rotation in addition to sliding the drill bit forward into the well as drilling continues.

In FIG. 8, Leaky Seal 154 and Cross-Over 156 are attached to collectively identified tubular portions 392 of a drilling machine 393. Drilling machine 393 possesses a Drilling Bottom Hole Assembly 394 which has a mud motor 396 and drill bit 398. First tubular portion 399 of the drilling machine 393 is comprised of one or more mandrels 400 attached to said Leaky Seal and to said Cross-Over. (As shown in FIG. 8, first mandrel has numeral 401 and supports the Leaky Seal, and second mandrel has numeral 403 that is integral with the Cross-Over). Second tubular portion of drilling machine 393 is a drill string 402 comprised of one or more segmented drill pipes attached to Drilling Bottom Hole Assembly 394. Third tubular portion of drilling machine 393 is a drill string 404 comprised of segmented drill pipes that is controlled and positioned in the well by surface hoist equipment 406 (not shown in FIG. 8 for purposes of simplicity.

Wellbore 408 is comprised of two downhole sections. The first downhole section of wellbore 408 is a cased well having casing 410, surrounded by cement 412 that are located within the first borehole 414. That first downhole section has numeral 409 (not shown in the interests of brevity). The second downhole section of wellbore 408 is the open-hole section 416 previously drilled to a maximum lateral distance 418 with the standard drilling equipment. That section has numeral 411 (which is not shown in the interests of simplicity). In one embodiment of the invention, with the installation of the Leaky Seal and the Cross-Over into the standard drilling equipment available at the wellsite, that previous maximum open-hole section is currently being extended to the new distance 420. It is desired to drill an additional distance 423.

Clean drilling mud 421 flowing through first annular portion 422 of the first downhole section of the wellbore 408 flows through passageway means 424 of the Leaky Seal and then into the second annular portion 426 of the first section of the wellbore 408. The Leaky Seal makes a rotating and sliding seal (429) with the interior of the casing 410, that results in a force (428) applied to the first tubular portion 399 of the drilling machine 393 disposed within the first downhole section of the wellbore 408. At least a portion of that force is applied to the second tubular portion of drilling machine 393, which is drill string 402, that in turn is applied to the Drilling Bottom Hole Assembly 394, and then to the bit 398. At least a portion of that force 428 is applied to the weight on bit "WOB" at the cutting face of the drill bit against the open hole at location 420.

Clean drilling mud flowing through second annular portion 426 of the first downhole section of wellbore 408 continues to flow into first channel 430 of Cross-Over 156 and then crosses into the lower interior flow channel 432 within the downhole interior portion 405 of mandrel 403 that is a part of the interior of the first tubular portion 399 of drilling machine 393. Element 405 is not shown in FIG. 8 for the purposes of simplicity and is located below interior blockage 407 of Cross-Over 156. The clean drilling mud then flows within the second tubular portion of the drilling machine 393 that is drill string 402, and then through interior flow channels of the drill bit 434 (not shown for simplicity) and into the open borehole near location 420.

Dirty drilling mud 436 with rock cuttings flows through open-hole annulus 438 and then through the third annular portion 440 of the first downhole section of the wellbore 408. The dirty mud then flows into second channel 442 of the Cross-Over, through the uphole interior portion 443 of mandrels 401 and 403, then ultimately through the interior of the third tubular portion of the drilling machine 393 towards the surface. Element 443 is not shown in FIG. 8 for the purposes of simplicity and is located above interior blockage 407 of Cross-Over 156.

In FIG. 8, the Drilling Bottom Hole Assembly 394 possessing a mud motor 396 and drill bit 398 may also be called one embodiment of a Drilling Bottom Hole Assembly 444. Many different embodiments of the Drilling Bottom Hole Assembly 444 include components typically used in the industry which include measurement-while-drilling components, logging-while-drilling components, mud pulse communications components for sending information uphole in the mud column, downhole sensor components of many types including those for pressure, weight on bit, drill bit parameters, electronics communications components for sending information uphole, electronics communications components for receiving information downhole, computer components, processor components, electronics components etc.

The above description in FIG. 8 also applies to the Drilling Machines shown in FIGS. 3, 3A, 3B, 3C and 3D except those figures have no mud motor 396 within the Drilling Bottom Hole Assembly 166.

Figure 9:
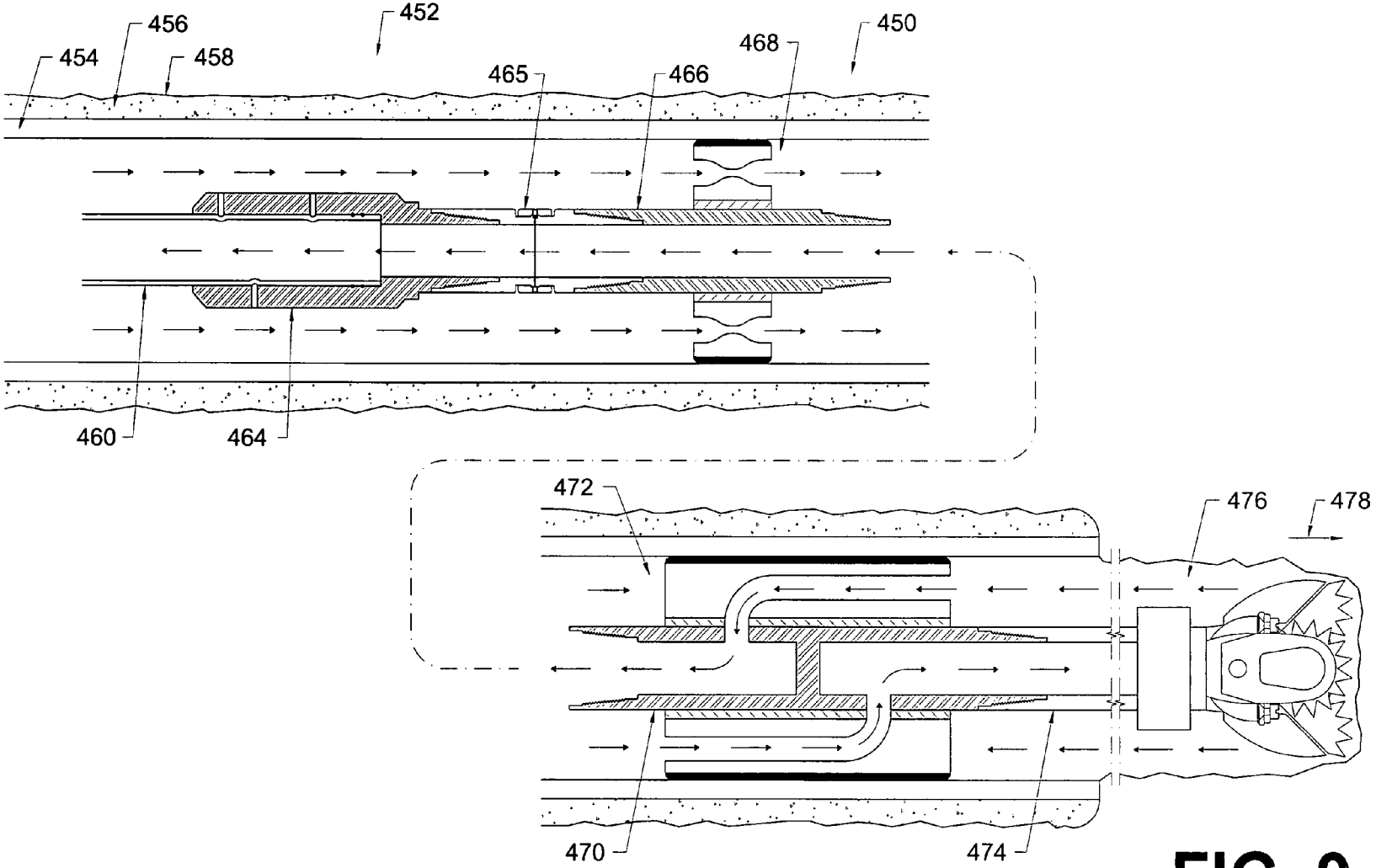
FIG. 9 shows a Leaky Seal and Cross-Over on separate mandrels attached to coiled tubing for drilling an extended portion of an open hole well that is a third embodiment of the Universal Drilling Machine.

The above description in FIG. 8 also applies to coiled tubing drilling shown in FIG. 9.

Using a description substantially based on FIG. 8, drilling machine 450 is disposed in the first downhole section of wellbore 452 that is cased well having casing 454, surrounded by cement 456 which are located within the first borehole 458. The second downhole section of wellbore 452 is the open-hole section which is not shown in the interests of simplicity because it substantially resembles that shown in FIG. 8.

Third tubular portion of drilling machine 450 is a coiled tubing 460 controlled and positioned by a surface coiled tubing unit 462 (not shown in FIG. 9 in the interests of simplicity).

In FIG. 9, first tubular portion of drilling machine 450 is comprised of a coiled tubing connection mandrel 464 which is joined by the differential threaded coupler assembly 465 to the mandrel 466 supporting the Leaky Seal 468 that is in turn joined to mandrel 470 that is integral with the Cross-Over 472.

Second tubular portion of drilling machine 450 is a drill string 474 comprised of one or more segmented drill pipes attached to Drilling Bottom Hole Assembly 476.

The drilling machine 450 is used to drill an extended reach portion of the open hole 478. Drilling machine 450 is yet another embodiment of the Universal Drilling Machine.

Figure 10:
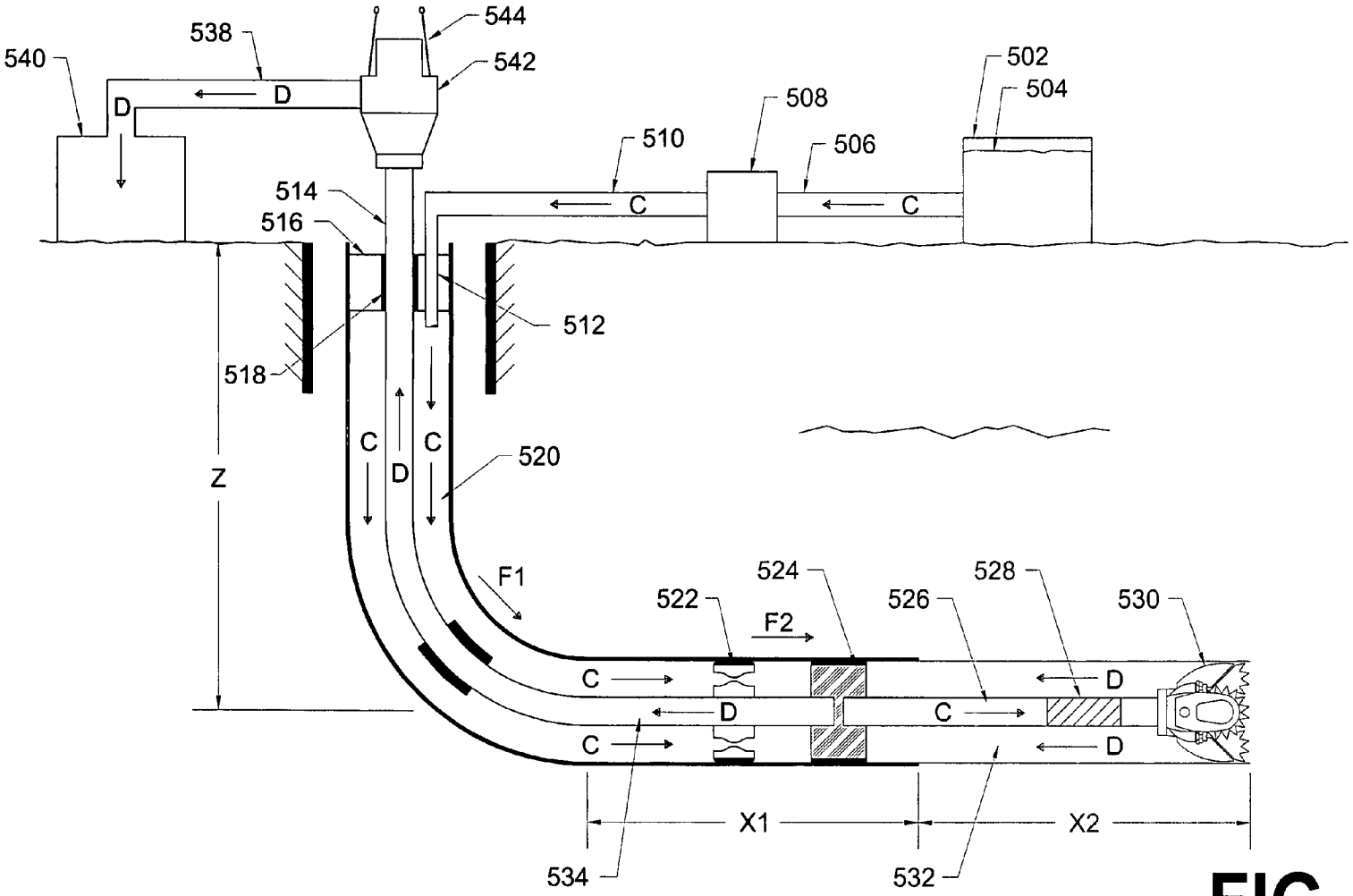
FIG. 10 shows an embodiment of wellbore pressure management with the Universal Drilling Machine.

One preferred embodiment of the invention showing important features of wellbore pressure management is shown in FIG. 10. Many of the elements have been described heretofore. In FIG. 10, F1 is the downward force on drill pipe 514 near the position of the wellbore makes a transition from vertical to horizontal; F2 is the force generated by the Leaky Seal 522 and Cross-Over 524; X1 is the first horizontal section that was drilled and cased; X2 the additional distance capable of being drilled because of the use of the Leaky Seal 522; Z is the depth from the surface to the horizontal well being drilled; and C is clean drilling mud and D is dirty mud with cutting being returned to the surface.

Clean mud tank 502 has clean drilling mud level 504 which provides a measurement of the volume of the clean drilling mud in that tank. Tank 502 provides mud through pipe 506 to mud pump 508 which in turn pumps mud through pipe 510 which in turn flows through the annular inlet pipe 512.

In this embodiment, rotating drill pipe 514 proceeds through annular seal 516 which is rigidly mounted to the wall of the casing and which has a surface 518 that makes a rotational seal with drill rotating drill pipe 514.

Clean drilling mud proceeds down the upper annular area 520 which proceeds to the Leaky Seal 522 and Cross-Over 524 that provides extra force F2 on the portion of the drill pipe in the region defined by these elements.

Clean drilling mud then proceeds through the interior of the drill pipe 526 through instrumentation package 528 to drill bit 530 that is one embodiment of a Drilling Bottom Hole Assembly 531 (which element is not shown in FIG. 10 for the purposes of simplicity).

Dirty mud with cuttings then proceeds through annular space 532 to Cross-Over 524. Thereafter, dirty mud with cuttings proceed to the surface through the interior of the drill pipe 534 to mud swivel assembly 542. Then dirty mud proceeds through pipe 538 to the return mud pit 540.

Two versions of this embodiment can be commonly used.

First, if a rotary table is used, then the mud swivel assembly 542 is supported by the derrick (now shown) and traveling hook link assembly 544. Element 544 is also called equivalently an elevator link assembly.

Second, if a top drive is used, then element 542 is instead a top drive that is supported by the derrick (not shown) and the traveling hook link assembly 544.

Figure 11:
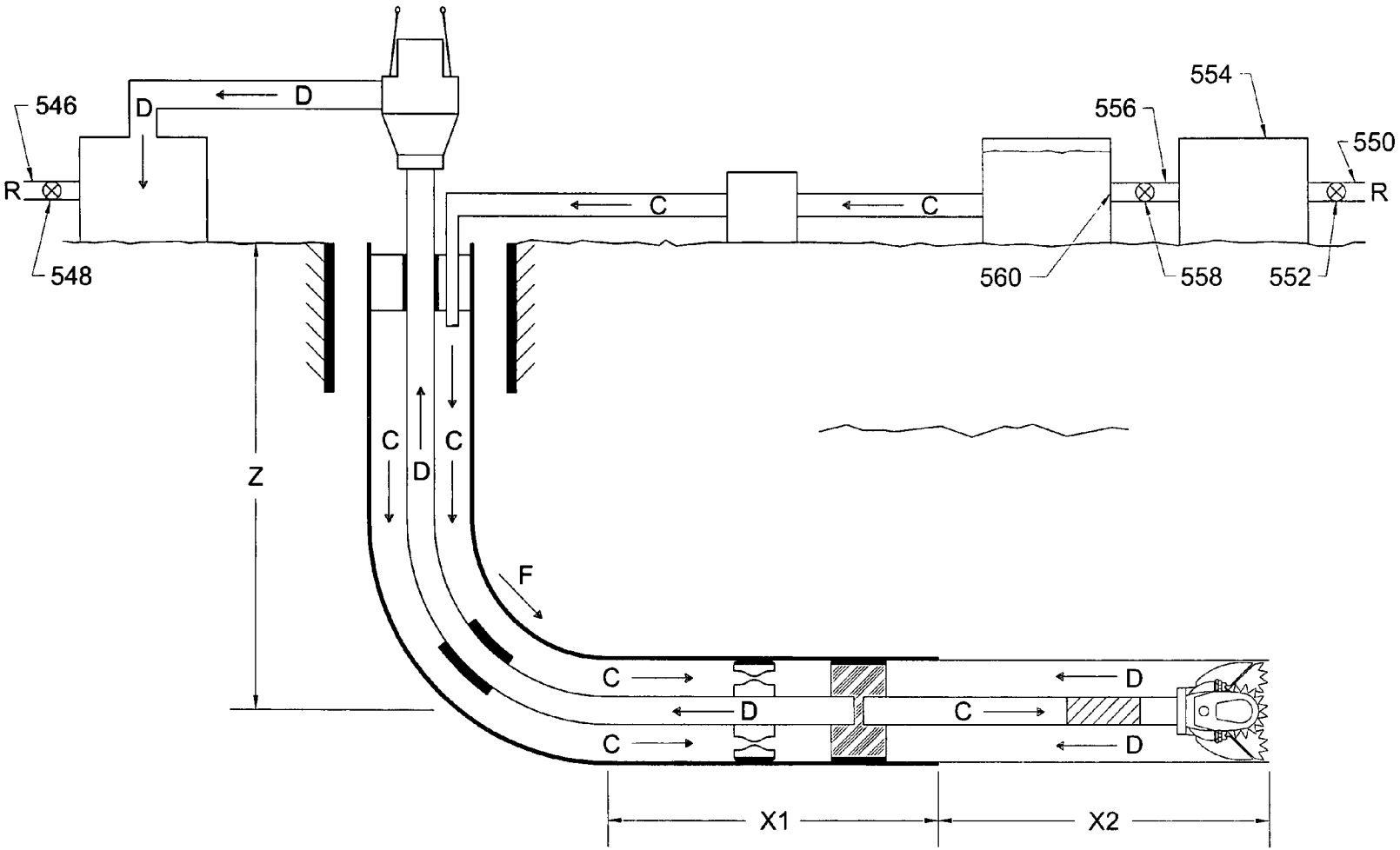
FIG. 11 shows an embodiment of a closed-loop mud management system with the Universal Drilling Machine.

FIG. 11 shows a closed-loop mud system. All the elements in FIG. 10 also appear in FIG. 11.

In addition, dirty mud recycle line 546 has valve 548 that in another optional preferred embodiment, provides a quantity of dirty mud R to input line 550 having valve 552 of the dirty mud cleaning apparatus 554. The dirty mud cleaning apparatus 554 processes the mud so that it can be sent downhole again—ie, it is recycled. The recycled mud proceeds through line 556 having valve 558 and flows through orifice 560 into the clean mud tank 502. This is a closed-loop mud control system designated by numeral 503 (which is not shown in FIG. 11 in the interests of brevity).

Any mud lost into formation, or otherwise lost, will be determined and measured by the volume in clean mud tank 502 as indicated in one embodiment by drilling mud level 504.

Figure 12:
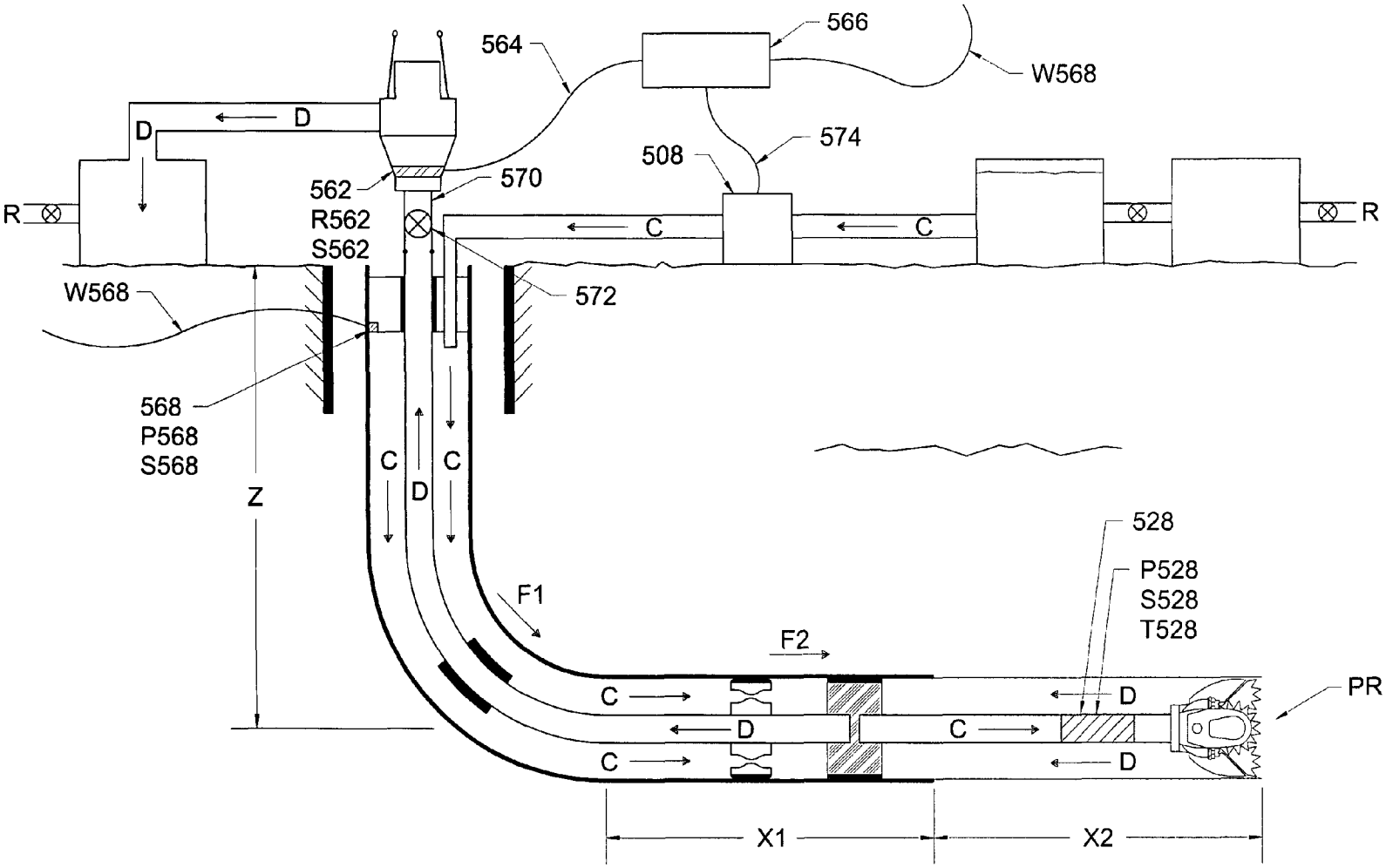
FIG. 12 shows one embodiment of the closed-loop feedback control an entire drilling system at the wellsite to perform Managed Pressure Drilling with the Universal Drilling Machine shown in FIG. 11.

FIG. 12 shows the measurements performed and the feedback control of the drilling system shown in FIG. 10. This is just one particularly simple preferred embodiment of the invention.

Instrumentation package 528 possesses pressure sensor package S528 that includes a pressure measurement device measuring the pressure P528 (the pressure of the borehole fluid at that location). Instrumentation package (528) also possesses a data transmission device T528, and in this preferred embodiment, this is a mud pressure encoded transducer that sends data corresponding to P528 up the mud column towards the surface. In one embodiment, this mud pulse encoder is battery powered. In another embodiment, the battery is re-charged by a generator which obtains its energy from the mud flow.

Instrumentation package 562 possesses sensor package S562 that includes mud pulse receiver R562 that sends electrical signals over wire 564 to computer 566. Computer 566 therefore obtains information that is interpreted to be the Pressure 528.

Various different drilling procedures exist including Conventional Drilling Operations, Underbalanced Drilling ("UBD") and Managed Pressure Drilling ("MPD"). See SPE Paper No. 122281 entitled "Managed-Pressure Drilling: What it Is and What It Is Not", an entire copy of which is incorporated herein by reference.

Suppose that the technique desired is MPD. Therefore, the P528 must be kept within a Drilling Window between the Fracture Pressure and the Pore Pressure. This will be called the Acceptable Drilling Pressure Range for P528. Those parameters are representative by PR (for "Pressure Range") on FIG. 12. In one version of MPD, the pressure is kept constant at the bit, and this variant is called "Constant Pressure Drilling".

Because of the effects of Extra Back Pressure due to reverse mud flow, in many cases oil based muds will be used to offset this increase in pressure. At the bit, and while mud is flowing, the pressure will be the hydrostatic weight of mud in the well plus the Unwanted Back Pressure.

Instrumentation package 568 possesses sensor package S568 that pressure sensor P568 and this sensor sends information over wire W568 to computer 566. In nominal drilling conditions, the pressure P568 should provide adequate mud flow through the Leaky Seal to provide force F2 and to provide pressure P528 within the Acceptable Drilling Range.

In this embodiment, there is a short stab of threaded drill pipe 570 that connects into the top most drill pipe in the well. It has valve 572 in it. When a new section of pipe needs to be added, valve 572 is closed. However, if the pressure P568 is NOT increased, then it is possible to have a blow-out situation. So, as the flow is decreased with valve 572, then the computer issues commands through wire 574 to mud pump 508 to increase the pressure of its output even though the fluid flow is dropping. This closed-loop feedback control is used to keep pressure P528 equal to a selected constant (within the Drilling Window) during all phases of drilling.

This closed-loop feedback control is also used to maintain the pressure P528 within acceptable limits if the mud is a Newtonian fluid, or a Bingham plastic fluid, or any other wellbore fluid. In certain preferred embodiments, this is done by requiring the computer 566 issue commands to mud pump 508 to continually adjust and update the pressure instant by instant to maintain the desired flow rate and to maintain the pressure at the bit within the Drilling Window. The computer 566 controls the mud pump 508, and the mud pump 508 is able to control its output pressure as a first independent parameter at any instant in time, and its mud flow rate as a second independent parameter at any instant in time. This is one example of a closed-loop feedback control system. Many different embodiments employ closed-loop feedback control. Sensors measuring such quantities as pressure and flow rate, are disposed as necessary at any portion of the Mud Flow Path 308 to ensure that the close-loop feedback system will maintain the pressure at the bit within the Drilling Window. This closed-loop feedback control system also must work with any other hydraulic means disposed in any portion of the Mud Flow Path 308. For example, if a check valve, or cement float valve is used within the Mud Flow Path 308, then the computer system must maintain the proper pressure at the bit within the Drilling Window. All of these functional requirements on the closed-loop feedback control system are merely minor variations of various embodiments of the invention.

Standard components to accomplish this task are known to anyone having ordinary skill in the art and will not be further discussed for the sake of brevity. In other embodiments of the invention, the computer 566 is also used to control the entire process to recalculate dirty mud as shown in FIG. 11. However, it is evident from this description how that can be done with additional instrumentation packages, selected sensors including pressure sensors, etc.

Figure 13:
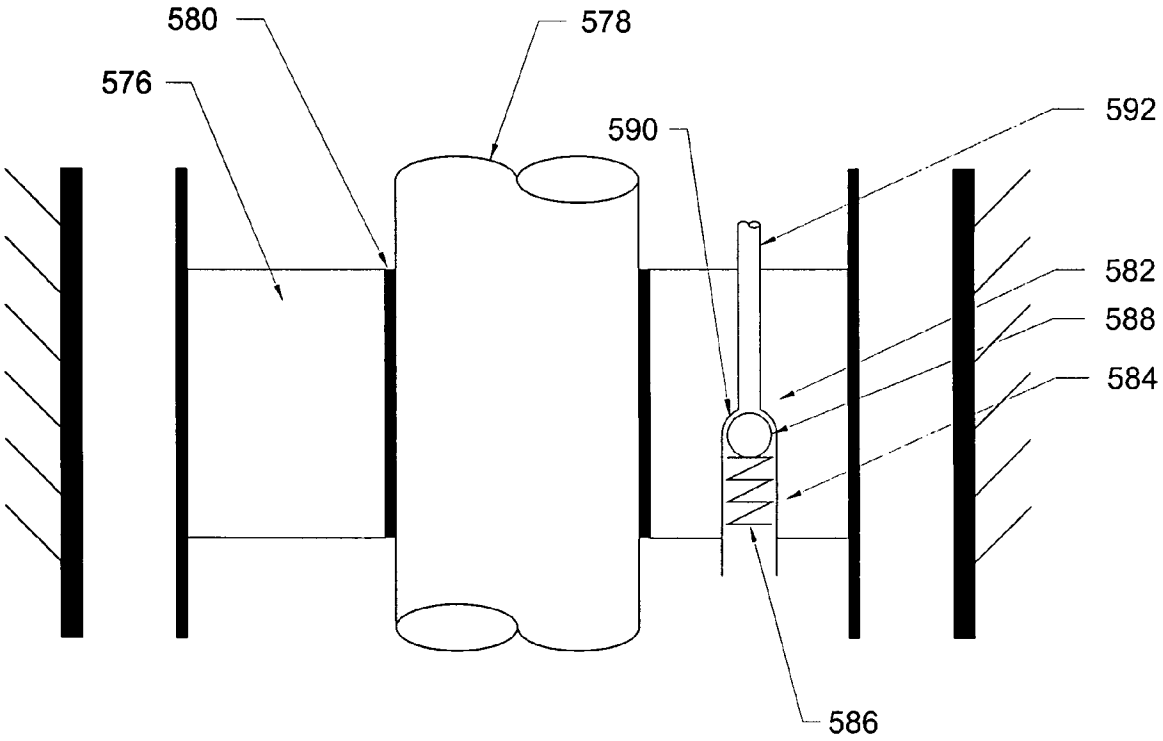
FIG. 13 shows one embodiment of an Annular Rotary Control Device used with the Universal Drilling Machine.

One embodiment of the Annular Rotary Control Device 576 is shown in FIG. 13. The term Rotary Control Device is used in the SPE 122281 about MPD on page 2 and in Reelwell's SPE 12489 about MPD among other topics. That Annular Rotary Control Device seals against the rotating drill pipe 578.

In this case, rotary drill pipe rotates within dynamic seal 580. Annular blow-out prevention device generally shown as 582 is comprised of a check valve assembly 584. In this embodiment, the check valve assembly 584 possesses spring 586, ball 588, seat 590 and tube 592. Mud pumped by the mud pump into the annulus forces the ball downward, and mud flows into the annulus. In a blow-out situation, pressure builds up in the annulus, and the ball is forced against the seat cutting off potentially dangerous reverse annular fluid flow.

Figure 14:
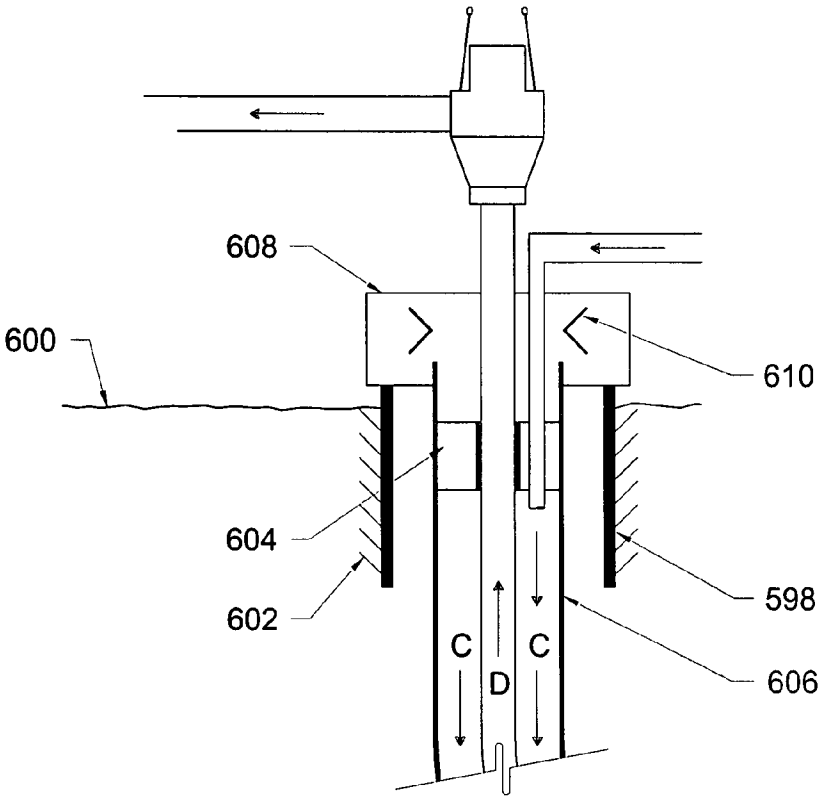
FIG. 14 shows a typical BOP installed with an embodiment of the invention.

FIG. 14 shows a typical BOP installed with an embodiment of the invention.

Large conductor pipe 598 is installed within the earth 600 and firmly anchored in place with cement 602. The Rotating Control Device 604 is installed within casing 606.

In this embodiment, the Rotating Control Device 604 is located below Blow Out Preventer Assembly 608 having many typical components 610 that include shear rams, ram preventers on the bottom and annular preventers at the top. Multiple BOP's are often used. In Schlumberger's definition of "BOP stack", it says: "The BOP stack also includes various spools, adapters, and piping outlets to permit the circulation of wellbore fluids under pressure in the event of a well control incident". Various embodiments of the invention use those components.

In other embodiments, the Rotating Control Device 204 may be located above the Blow Out Preventer Assembly 208. The other components have already been identified.

A form of Cross-Over 616 is shown in FIG. 3D. Here, in addition to the usual components is check valve 618. This check valve is used to prevent high pressure fluids from running in the reverse direction up the inside of the drill pipe in a blow-out situation. In other embodiments, similar check valves may be installed within channels of the Cross-Overs, in passageways through Leaky Seals, and in other portions of the downhole apparatus.

Other standard apparatus and methods that are known in the industry may be adapted to the methods and apparatus described herein. In particular, subsea Blow Out Preventers, rig choke manifolds, booster pumps for pressure management, mud gas separators, oil water separators, shakers, centrifuges, stroke counters, additional flow meters anywhere in the system, additional pressure sensors anywhere in the system, auxiliary pumps, additional rig pumps, etc. may be used. Anyone having ordinary skill in the art would be familiar with this apparatus and methods of operation that may be added to the embodiments described herein.

Figure 15:
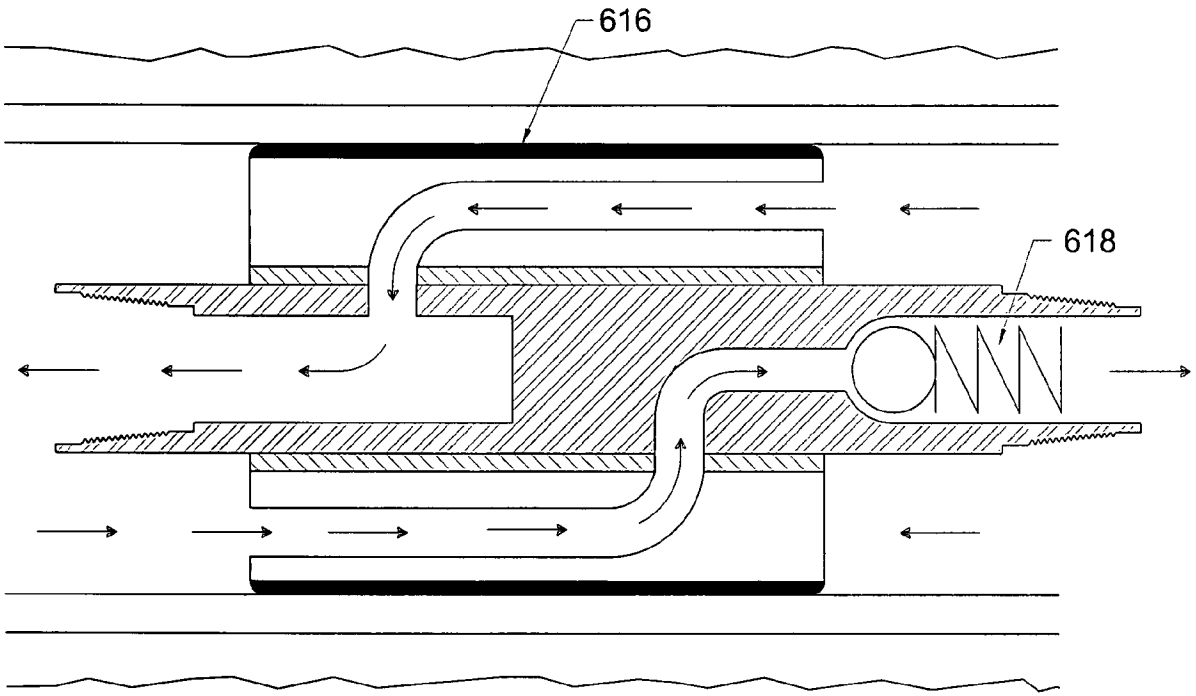
FIG. 15 shows an embodiment of the invention with a check valve installed within a Cross-Over used for the purposes of the pressure control of wells.

In another embodiment of the invention, the check valve 618 may function as a cooperative portion of the interaction between a Leaky Seal and a Cross-Over to generate extra WOB. Any check valve 618 in a clean mud flow path 619 (not shown in FIG. 15) used in combination with any Leaky Seal is an embodiment of this invention. Any flapper valve in a clean mud flow path used in combination with any Leaky Seal is an embodiment of this invention. Any float valve, normally used for cementing purposes, used in a clean mud flow path is an embodiment of this invention. Darts and balls which are often used with downhole apparatus for a variety of different purposes. Any darts and/or balls used in a clean mud flow path in combination with a Leaky Seal is also an embodiment of the invention. Many such configurations are shown in drawings that are in U.S. Provisional Patent Applications which have been made a part of this specification by reference.

Any hydraulic device, or hydraulic means, that is inserted into any clean mud flow path possessing a Leaky Seal is an embodiment of the invention. Provided that inserted hydraulic means does not dissipated significant power compared to that dissipated by the Leaky Seal, then the Leaky Seal will normally operate in conjunction with a Cross-Over as previously described. Put another way, provided that the pressure drop across the inserted hydraulic means is significantly less than the pressure drop across the Leaky Seal, then the Leaky Seal will normally operate in conjunction with a Cross-Over as previously described. Any of these methods of operation are embodiments of the invention.

In FIGS. 10, 11, and 12, dirty mud "D" flows up relatively long distances within the drill pipe. This is called "reverse mud flow". There is a complexity due to this "reverse mud flow". Reverse mud flow causes an Extra Back Pressure at the drill bit face compared to typical annular mud flow that carries rock chips to the surface in normal drilling operations. This Extra Back Pressure is caused by the typically smaller cross-section to fluid flow presented by the interior of the drill pipe as compared to the area available for flow through typically larger annular spaces.

This Extra Back Pressure can be useful to prevent blowouts and for other purposes. That being said, there are a number of ways to overcome the Extra Back Pressure including using lower density drilling mud; using a downhole hydraulic pump that is useful for Underbalanced Drilling ("UBD"); increasing the size of the drill pipe; etc.

Figure 11A:
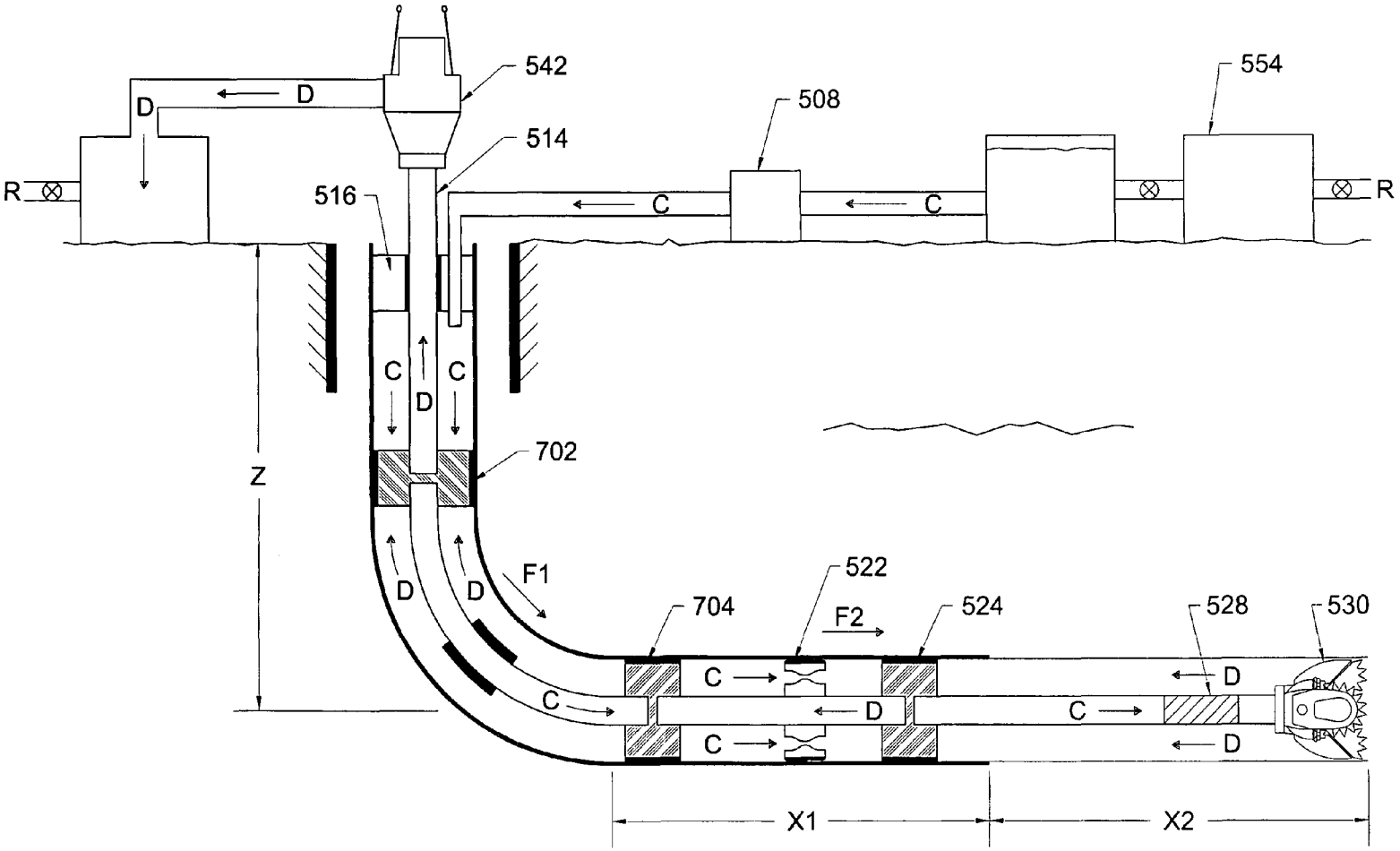
FIG. 11A shows an embodiment of The Force Sub™ used with the Universal Drilling Machine shown in FIG. 11.

One other method to reduce the Extra Back Pressure is to use The Force Sub™. The configuration of Force Sub is shown in FIG. 11A. FIG. 11A derives from FIG. 11.

Many of the numerals in FIG. 11A have already been defined. Previously defined rotating drill pipe (514) proceeds through annular seal (516) which is rigidly mounted to the wall of the casing in one embodiment. Leaky Seal 522 and Cross-Over 524 have already been defined. Cross-Over 524 may also be callused the "First Cross-Over".

Added to the downhole assembly to make The Force Sub are two more Cross-Overs, respectively Second Cross-Over 702 and Third Cross-Over 704. Distances between each element in FIG. 11A may be defined as L(516 to 702); L(702 to 704); L (704 to 522); L(522 to 524); and L(524 to 528); and DL(528 to 530). Here L means the length between the two elements cited within the parentheses.

If D(702 to 704) is substantially larger than the sum of D(516 to 702) plus the distance of D(704 to 522) plus the distance of D (522 to 5224), then the Extra Back Pressure will be substantially reduced. Under these circumstances, most of the dirty drilling mud flows through annular spaces as in conventional drilling. Consequently, under such circumstances, the pressure profile would more resemble typically drilling circumstances. What has been described here is just one of the many possible embodiments of The Force Sub.

Figure 11B:
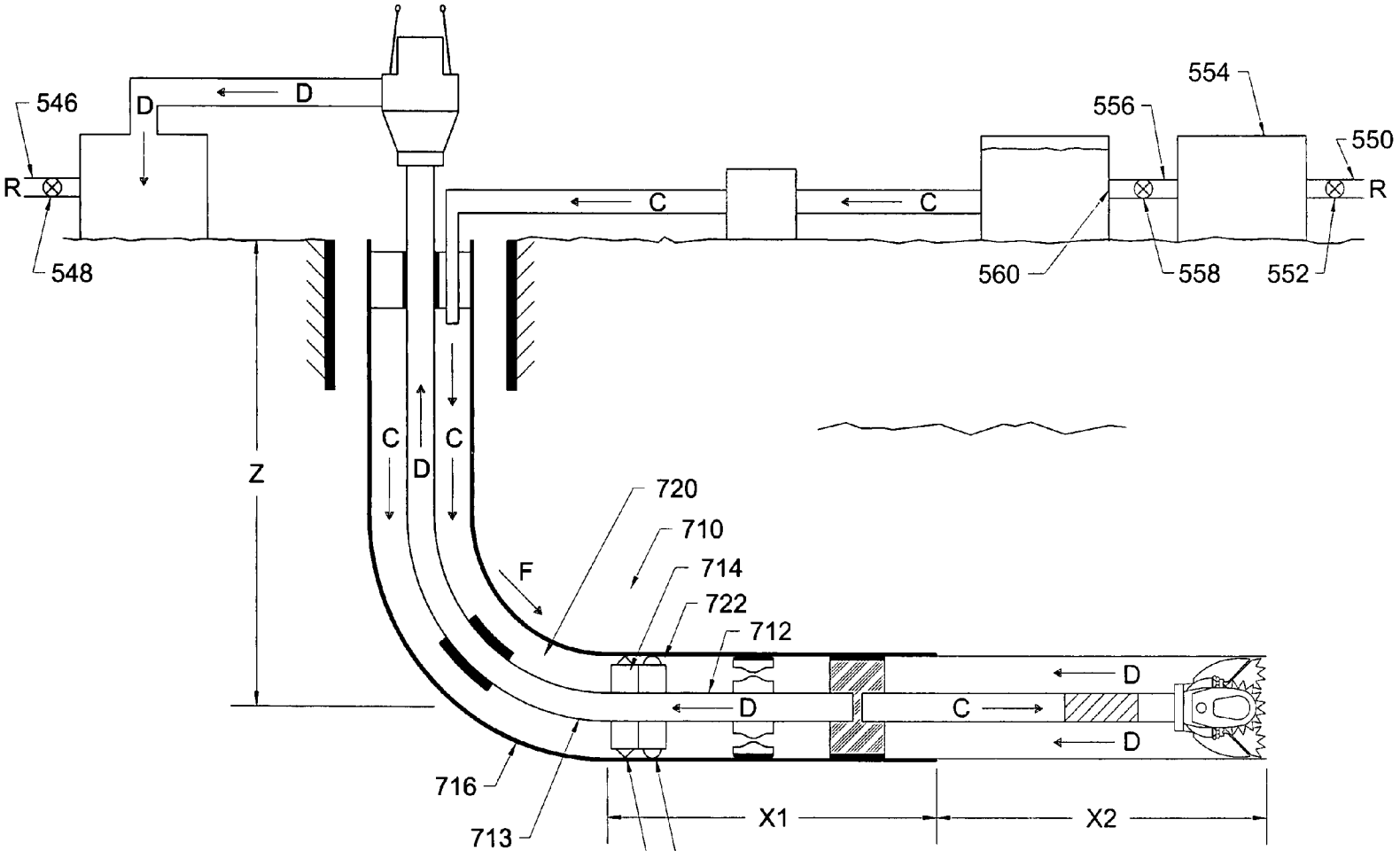
FIG. 11B shows an embodiment of The Torque Sub™ used with the Universal Drilling Machine shown in FIG. 11.

Another useful device for extended reach drilling is The Torque Sub™. Please refer to FIG. 11B. Many of the elements have already been defined in relation to FIGS. 10, 11, 11A, and 12. As the name suggests, The Torque Sub adds torque for drilling purposes by a hydraulic means.

The Torque Sub 710 adds torque to downhole pipe section 712. Downhole pipe section 712 is able to turn in relation to uphole pipe section 713. First portion 714 of The Torque Sub is temporarily locked in place within the casing 716 by locking dogs 718. Clean pressurized mud flow down annulus 720 enters The Torque Sub 710 that has an interior hydraulic motor means that rotates second portion 722 of The Torque Sub that in turn causes the downhole pipe section 712 to rotate. An example of a hydraulic motor means 726 is any type of positive displacement motor 728 that fits into the available space 730 (which numerals 726, 728 and 730 are not shown for the purposes of simplicity). The mud flow rate 732 and the pressure drop 734 are related to the power 736 delivered to The Torque Sub (which numerals 732, 734, and 736 are not shown for the purposes of simplicity). Seal 724 prevents the pressurized clean mud from bypassing The Torque Sub. Many detailed designs for The Torque Sub appear in several of the U.S. Provisional Patent Applications that are incorporated herein by reference. Many such embodiments possess a ratchet-device 738 to prevent back-spinning of the positive displacement motor, so that it rotate in only one direction 740 (which numerals 738 and 740 are not shown for the purposes of simplicity).

In one embodiment of the invention, The Torque Sub and The Force Sub work together in one downhole drilling machine for drilling purposes. In another embodiment, the Torque Sub and the normal Leaky Seal with Cross-Over are used together for drilling purposes.

In complex machines such as that shown in FIG. 11A, it can be helpful to identify annular portions in sequence, starting from the top to bottom of the well. The purpose of FIG. 11C is to provide such a sequential listing.

Figure 11C:
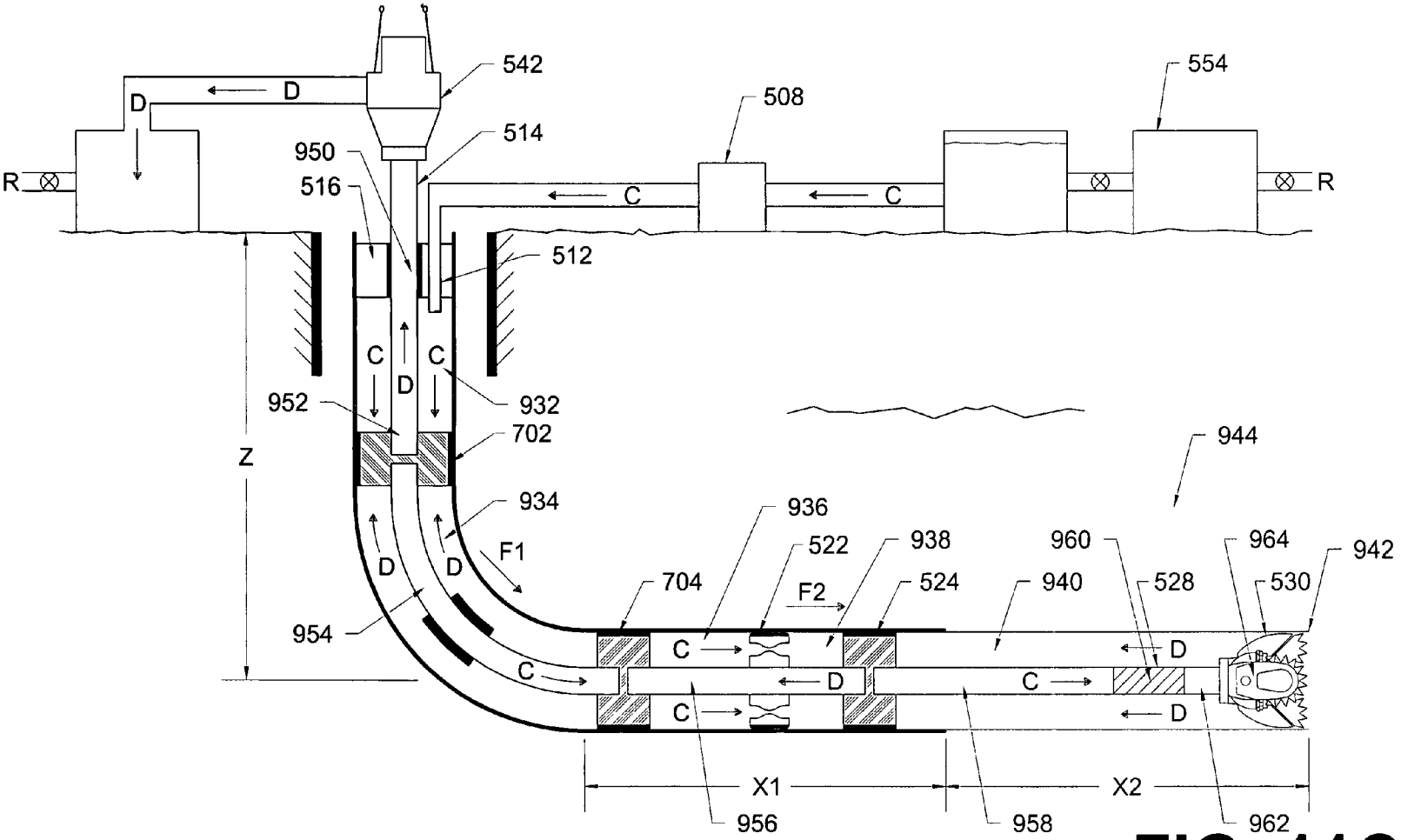
FIG. 11C shows how annular portions of the apparatus are sequentially defined and how interior tubular elements of the apparatus are sequentially defined in one preferred embodiment of the invention.

In FIG. 11C, beginning with element 512, sequential annular sections of this apparatus are defined as: 932 through 940. Element 942 is the location of the rock bit engaging the geological formation 944.

Similarly, it can be helpful to identify interior portions of tubular elements in sequence, starting from the top of the well. Beginning with an interior element of the drill pipe 950 adjacent to element 516, these sequential interior portions of tubular elements are defined as: 950-960. This sequence again ends at element 942 that is the location of the rock bit engaging the geological formation 944.

For example, beginning with element 512, annular portions of the apparatus can be described as follows: first annular portion 932, second annular portion 934, third annular portion 936, fourth annular portion 938, and fifth annular portion 940 which ends at the face of the rock bit engaging the formation 944.

As another example, beginning with element 950, interior tubular portions can be described as follows: first interior tubular portion 952, second interior tubular portion 954, third interior tubular portion 956, fourth interior tubular portion, fifth interior tubular portion 958, sixth interior tubular portion 960, seventh interior portion 962, seventh interior portion 964 (on the interior of the drill bit), that ends at the face of the rock bit engaging the formation 944.

For the purposes of this disclosure, any machine may be similarly labeled commencing with a the location of a particular numeral. The labeling goes from the uphole side going downhole in this system of enumerating apparatus portions.

Figure 16:
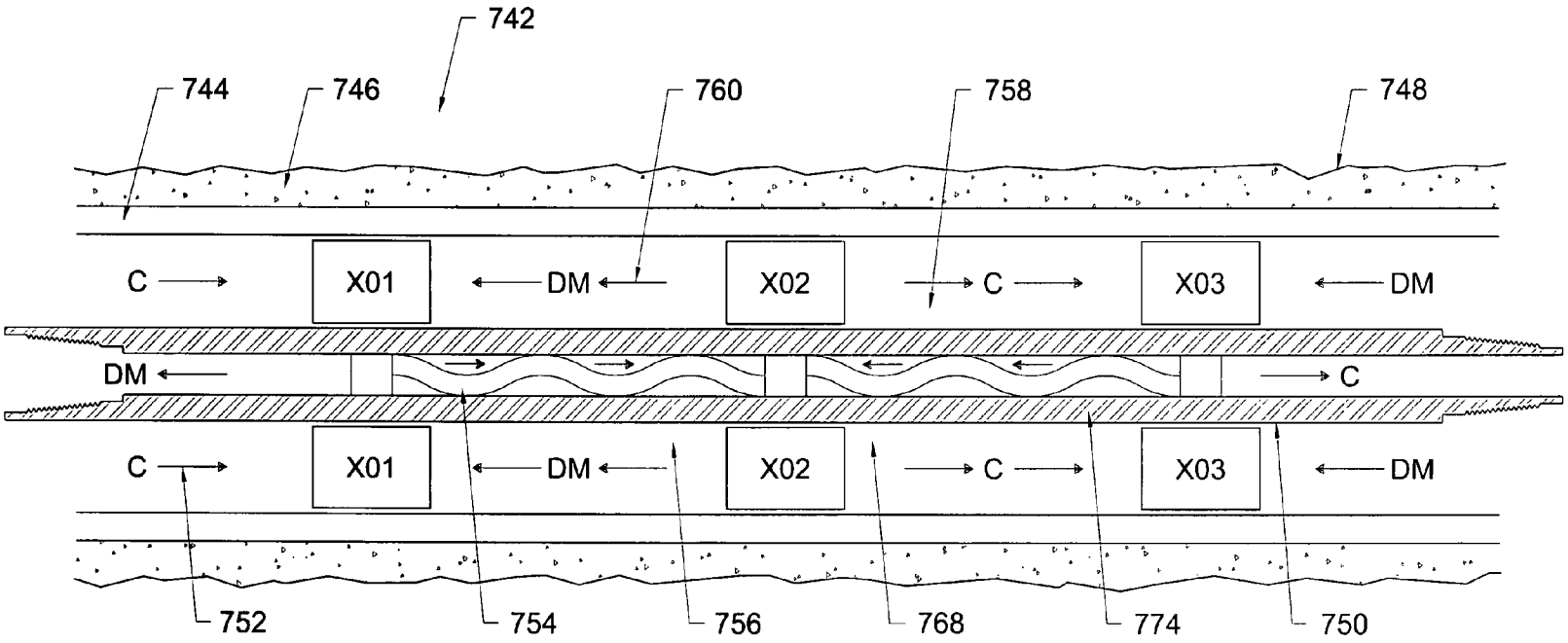
FIG. 16 shows an embodiment of the invention used as a mud-motor driven progressing cavity pump that is used for Underbalanced Drilling or Managed Pressure Drilling with the Universal Drilling Machine.

FIG. 16 shows a downhole mud pump being powered by clean mud flow down the annulus that is useful for Underbalanced Drilling and other uses. Another description for this apparatus is a mud motor driven downhole progressing cavity pump.

FIG. 16 shows cased well 742 having casing 744, cement 746, which are in borehole 748. Cross-Overs X01, X02, and X03 are integral with mandrel 750. Clean mud flow from the surface 752 (designated by the legend C in FIG. 16) is used to turn shaft 754 of mud motor section 756 that eventually turns the drill bit. The stator of the motor section 755 is not shown in the drawing for the purposes of simplicity. The attached drill bit 757 is not shown in FIG. 16 for the purposes of simplicity nor is the coupling apparatus 781 that connects the rotating shaft 754 to the drill bit. However, the rotating metal shaft 754 of the mud motor extends into another stator housing 774 of a downhole progressing cavity pump 758. (In several embodiments the pitch and volumetric displacement of this portion 759 of the metal shaft within the progressing cavity pump is different than the portion of the metal shaft 753 within the mud motor.) This pump 758 is used to pump dirty mud 760 to the surface to establish underbalanced drilling conditions. The dirty mud 760 is also designated by the legend DM in FIG. 16.

This device consumes horsepower. It is a Horsepower Dissipating Device ("HDD") designated by numeral 770, although that is not shown in FIG. 16 for the purposes of simplicity. Because mud flows through it, and its operation results in a pressure drop 772 to the mud flowing downhole in the annulus, there is necessarily a force 764 imparted to the entire apparatus that adds weight on bit 766. The numerals 764, 766, and 772 are not shown in FIG. 16 in the interests of brevity.

One embodiment of the invention may be described as a mud-motor driven progressing cavity pump designated by the numeral 768 in FIG. 16.

Figure 16A:
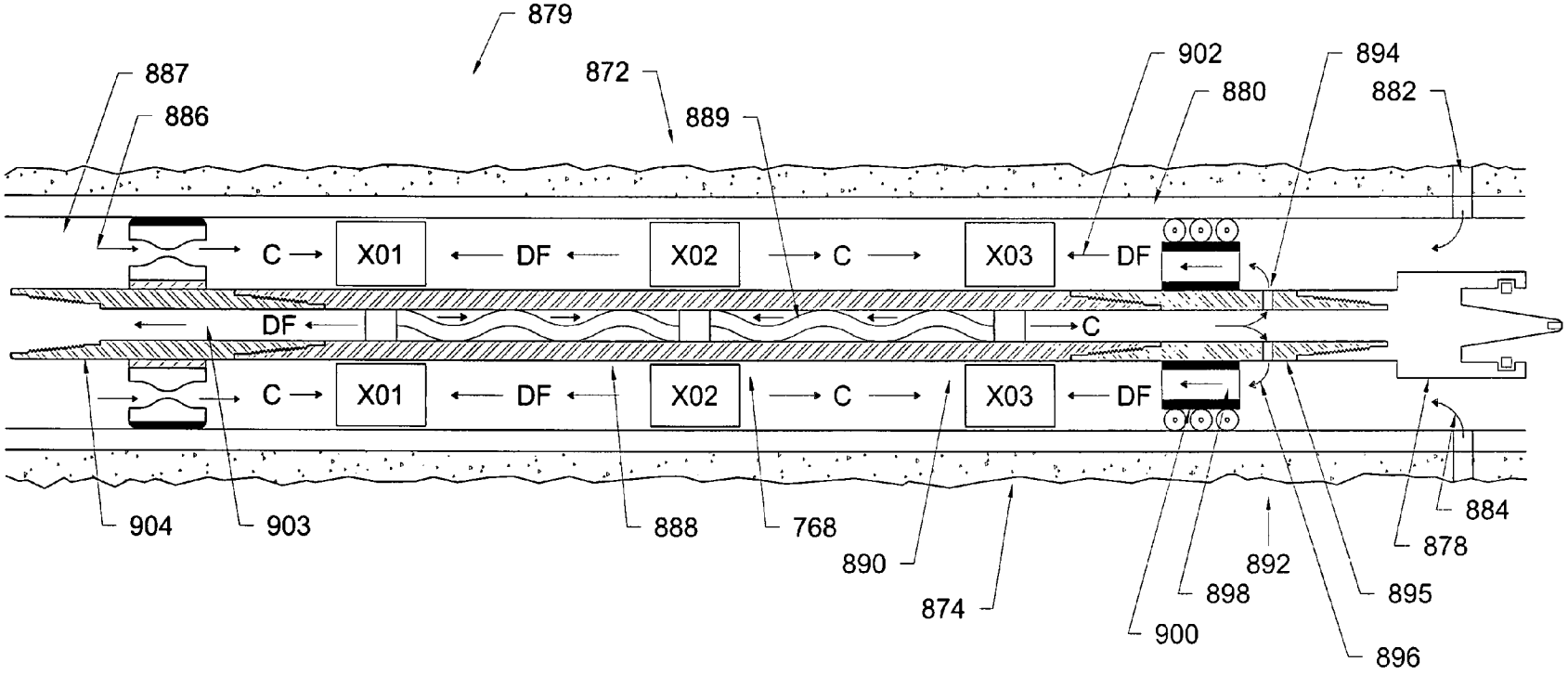
FIG. 16A shows the mud-motor driven progressing cavity pump of FIG. 16 that is used as a portion of yet another embodiment of the invention called The Annular Pressure Tractor & Shuttle™ which is a form of an annular mud powered conveyance system.

There is another use for the mud-motor driven progressing cavity pump 768 that shown in FIG. 16A. The similarities in FIGS. 16A and 16 are evident, and the relevant numerals will not be repeated here in the interests of brevity.

One preferred embodiment of the invention is The Annular Pressure Tractor & Shuttle™ 872 which is generally shown in FIG. 16A. This is also called a Conveyance System 873 or simply a Shuttle 873 for the purposes herein, which numerals are not shown in the interest of brevity. The mud-motor driven progressing cavity pump 768 is a portion of this Shuttle 872.

In one embodiment of the invention, it is desired to convey into the cased wellbore 874 a logging tool 876 (not shown) attached to Retrieval Sub 878 to measure formation parameters of geological formation 879. (The Retrieval Sub 878 and the many devices for drilling, completion, workover and abandonment that are attached to that Retrieval Sub are described in U.S. Pat. No. 7,836,950 and in U.S. 2009/0308656, entire copies of which are incorporated herein by reference.) The casing 880 has perforations 882 and production fluids 884 are entering the cased wellbore. Pressurized clean fluids 886 are pressurized in the upper annulus 887 by surface pumps 889 (that are not shown). The pressurized clean fluids are designated by the legend C in FIG. 16A. In one embodiment, the pressurized fluids are water. In another embodiment treated wellbore fluids are recalculated. Those pressurized clean fluids 886 cause the motor section 888 to turn the shaft 889 which is a portion of the progressing cavity pump section 890 as explained in FIG. 16. The pressurized clean fluids 886 are used to deliver power to the progressing cavity pump section 890, and are eventually exhausted into the interior of the cased well at position 892 through hole 894 in tool mandrel 895.

A portion of the clean fluids 896 exhausting into the interior of the casing are shown in FIG. 16A. Those clean fluids 896 are co-mingled with production fluids 884, which flow through channel 898 of roller-locking mechanism 900 that become the dirty fluids 902 designated by the legend DF. Those dirty fluids are pumped uphole by the progressing cavity pump section 890 through the interior portion 903 of the upper mandrel assembly 904 and the fluids are then sent uphole through the interior of tubular 906 to the surface 908. In FIG. 16A, numerals 906 and 908 are not shown for the purposes of simplicity. In one embodiment, the tubular 906 is chosen to be a coiled tubing suspended by a coiled tubing rig 910 (not shown in FIG. 16A) located on the surface 908 (not shown in FIG. 16A).

Computers 912, sensor systems 914, and closed-loop feedback control system 916 prevent any "reverse fluid flow" 918 in the reverse direction 920 through hole 882 into geological formation 879 during any transit into or out of the wellbore by Conveyance System 872. Numerals 912, 914, 916, 918, and 920 are not shown in FIG. 16A for the purposes of brevity. These components and systems also prevent any "fluid lock-up" in the event the well is sealed, having no perforations, and is full of fluids during the transit of Conveyance System 872 into or out of the well.

Figure 17:
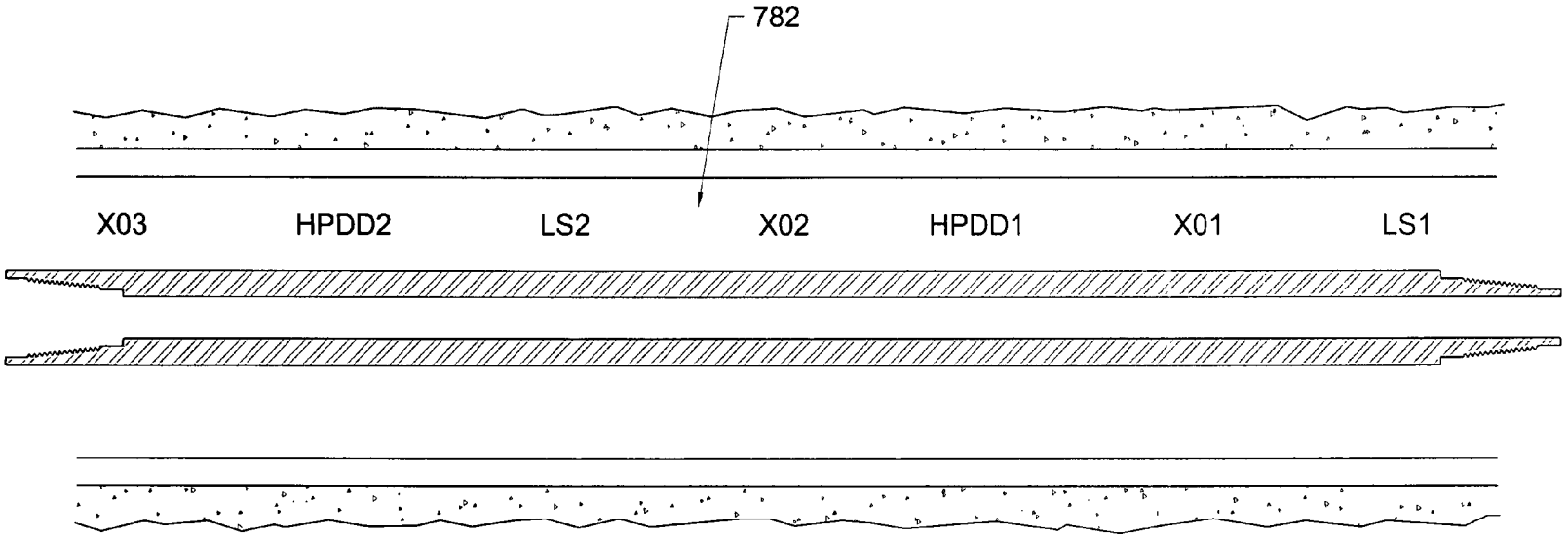
FIG. 17 shows how other Horsepower Dissipating Devices ("HPDD") may be used with different embodiments of the invention.

FIG. 17 shows other Horsepower Dissipating Devices ("HPDD") may be used in various embodiments of the invention. Such devices include mud motors, restrictions to flow, etc.

FIG. 17 shows several cross-overs X01, X02, and X03, Leaky Seals LS1 and LS2, and first Horsepower Dissipating Device HPDD1 and Second Horsepower Dissipating Device HPDD2. A sequence of such devices will result in a force on such a device when clean mud is passed through the horsepower dissipating devices which will place additional weight on bit ("WOB").

The apparatus shown in FIG. 17 may be called a Horsepower Dissipating Assembly 782 having one or more Cross-Overs and one or more Leaky Seals. Any device extracting power from the mud flow is called a Horsepower Dissipating Device 784 having a volume of mud per second flowing through it 786, that generates a pressure differential 788 from a first side 789 to a second side 790 of the device, said numerals 784, 786, 788, 789 and 790 are not shown in FIG. 17 for the purposes of brevity.

Similar descriptive language can be used to describe embodiments of the invention for completing wellbores. Many completion procedures depend upon using a lengthy tubular to convey completion devices and systems into a wellbore. A Leaky Seal with Cross-Over may be used to do so. As just one embodiment of the invention, consider conveying into a wellbore a new section of liner to be cemented in place.

Universal Completion Machine 792 is disposed in the first downhole section of wellbore 794 that is cased well having casing 796, surrounded by cement 798 which are located within the first borehole 800. That first downhole section of wellbore 794 is designated with numeral 795.

The second downhole section of wellbore 794 is the open-hole section 802 previously drilled to a maximum lateral distance 804.

Figure 18:
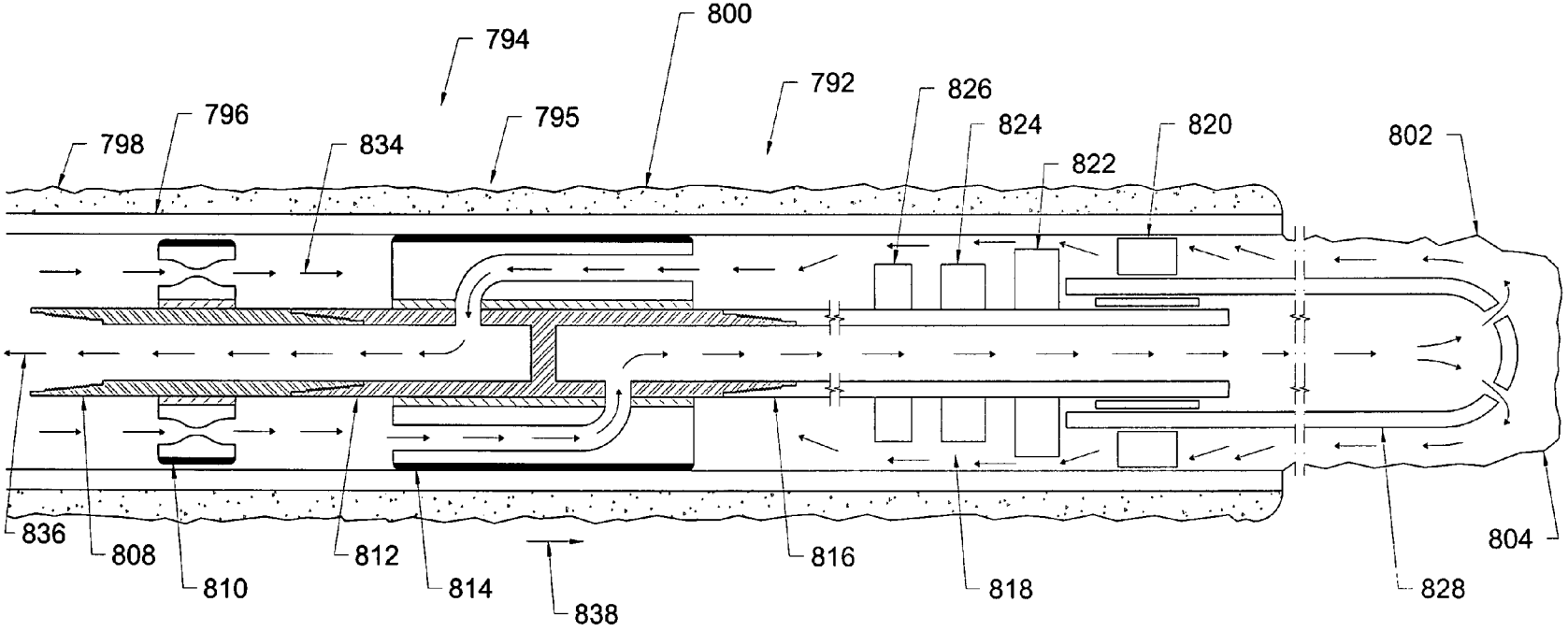
FIG. 18 shows one embodiment of the Universal Completion Machine™ used to convey a liner into an open hole section of a well.

In FIG. 18, the first tubular portion of the Universal Completion Machine 792 is comprised of mandrel 808 supporting the Leaky Seal 810 that is, in turn, joined to mandrel 812 that is integral with the Cross-Over 814.

The second tubular portion of Universal Completion Machine 794 is a drill string 816 comprised of one or more segmented drill pipes attached to the Completion Bottom Hole Assembly 818. The Completion Bottom Hole Assembly 818 has various components including the liner hanger 820, the liner engagement tool 822, the well completion control and communication unit 824, optionally added electronics 826, and the liner 828. The Completion Bottom Hole Assembly may also be abbreviated as "CBHA".

The third tubular portion of Universal Completion Machine 792 are sections of drill pipe 830 attached to surface hoist equipment 832 (neither numerals 830 nor 832 are shown in FIG. 18 in the interests of brevity).

The downward pointing arrow 834 shows clean mud being forced downhole by one or more surface mud pumps. The upward pointing arrow 836 shows recirculating mud going uphole. The numeral 837 designates the entire mud flow path, although that is not shown in FIG. 18 in the interests of brevity.

High pressure and high flow rate mud from the surface mud pump generates a large force 838 on the Completion Bottom Hole Assembly 818 to help convey that assembly into place. In this case, the liner 828 is placed into the proper position in the well, and then the Universal Completion Machine 792 is retrieved to the surface.

Element 304 in FIG. 3D shows a first annular portion of a cased wellbore in that figure, and a similar annular space exists in FIG. 18 that shall be designated by the same numeral.

This is one example of the Universal Completion Machine™. A Leaky Seal and Cross-Over on a set of mandrels screwed into an existing threaded set of drill pipes can be used to generate a large force on a liner to be conveyed downhole. It is "Universal", because this assembly can be used with any tubular elements normally used to complete wellbores.

It is also "Universal" because most completion steps to complete a wellbore involve procedures analogous to these described herein. The term "Well Completion" is defined in Schlumberger's on-line Oilfield Glossary as follows: "To perform activities in the final stages of well construction to prepare a well for production. The well is completed once zones of interest have been identified. Specific completion steps that can be done with various embodiments of the Universal Completion Machine include, but are not limited to, the following: running in a tubular so that cement can be pumped into the wellbore; running in perforation guns and perforating; conveying production tubing downhole to land in a liner; and conveying downhole any tubular means attached to any Completion Bottom Hole Assembly in wellbore having any portion that has casing.

This invention allows mud circulation AND the application of an extra force while forcing the liner down. The circulating mud helps to maintain borehole stability and assists to maintain pressure control of the well.

In the case of FIG. 18, mud is circulated in the normal fashion up the annulus of the open hole. There is another alternative as shown in FIG. 19.

Figure 19:
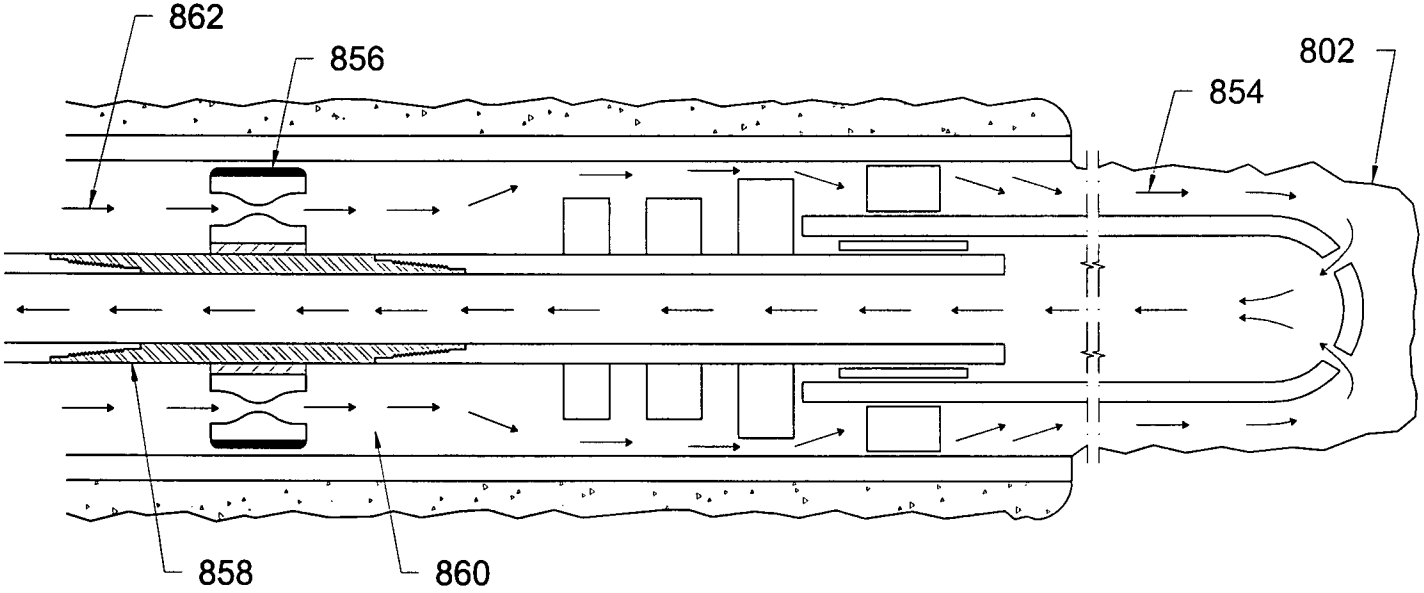
FIG. 19 shows another embodiment of the Universal Completion Machine used to convey a liner into an open hole section of a well.

FIG. 19 shows another embodiment of the Universal Completion Machine. As in FIG. 18, a liner is being conveyed downhole. However, the direction of mud flow 854 has been reversed in the open hole region and elsewhere. In addition, in this embodiment, only one Leaky Seal 856 on its mandrel 858 comprises the first tubular portion 860 of the Universal Completion Machine. In this embodiment, only one Leaky Seal is in the mud flow path 862. Otherwise, the components are similar to those shown in FIG. 18.

Figures 1, 20:
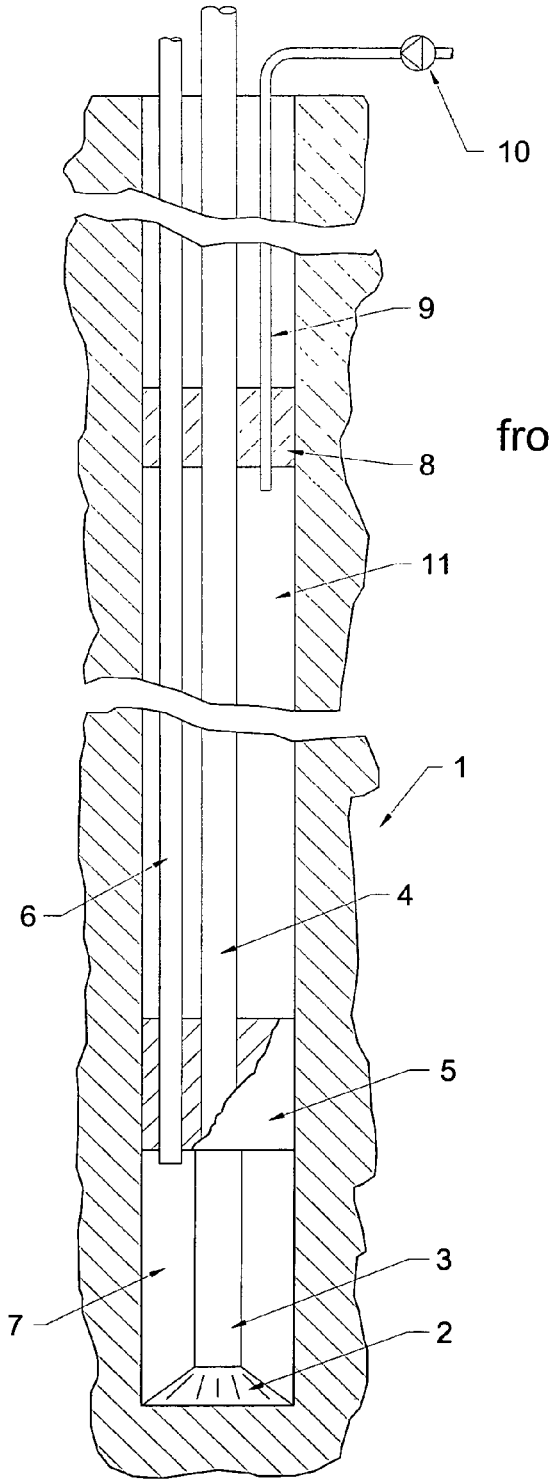
PRIOR ART FIG. 20
FIG. 20 shows FIG. 1 from WO 94/13925 (Vestavik) that is Prior Art.

FIG. 20 provides a copy of FIG. 1 from WO 94/13925 having the inventor of Ola M. Vestavik. This figure conveniently allows identification of several basic elements of the Reelwell Drilling Method described in SPE/IADC 119491 entitled "Reelwell Drilling Method" by Vestavik, et. al. Pipe 9 provides annular pressure that generates a hydraulic force on piston 5 that in turn contributes to weight on bit. In addition, clean mud is pumped down drill string 4, and dirty mud with rock cuttings returns to the surface via return line 6. The elements 4 and 6 described here have been functionally implemented within the Dual Drill String of the Reelwell Drilling Method. In FIG. 1 of this patent, the annulus is used to provide hydraulic pressure on the piston 5, but does not use downward flowing mud within an annulus for multiple purposes.

Different Embodiments of the Invention

In view of the above disclosure, the following are merely minor variations of the above preferred embodiments of the invention.

The use of two Leaky Seals in series in a clean mud flow path is an embodiment of this invention.

The use of two or more Leaky Seals in series in a clean mud flow path is an embodiment of the invention.

Each Leaky Seal may have one fluid passageway within the body of the Leaky Seal. Each Leaky Seal may have two fluid passageways in the body of the Leaky Seal. Each Leaky Seal may have two or more fluid passageways through the body of the Leaky Seal. All of these variations are embodiments of the invention.

In a given clean mud flow path, two Leaky Seals may be used in parallel in different geometric arrangements, which are embodiments of the invention.

The use of the mud motor driven progressing cavity pump in a DBHA for UBD or MPD is another embodiment of the invention.

Trademarks Related to Leaky Seals

The Universal Drilling and Completion System™ is comprised of the Universal Drilling Machine™ and the Universal Completion Machine™. UDCS™ is the trademarked abbreviation for the Universal Drilling and Completion System.

UDM™ is the trademarked abbreviation for the Universal Drilling Machine™. UCM™ is the trademarked abbreviation for the Universal Completion Machine™. The Leaky Seal™, The Force Sub™ and The Torque Sub™ are used in various embodiments of these systems and machines.

References

The below references provide a description of what is known by anyone having ordinary skill in the art. In view of the above disclosure, particular preferred embodiments of the invention may use selected features of the below defined methods and apparatus.

References Cited in the Description of the Related Art

Paper No. CSUG/SPE 137821, entitled "New Approach to Improve Horizontal Drilling", by Vestavik, et. al., Oct. 19-21, 2010, an entire copy of which is incorporated herein by reference.

Paper No. SPE 89505, entitled "Reverse Circulation With Coiled Tubing—Results of 1600+Jobs", by Michel, et. al., Mar. 23-24, 2004, an entire copy of which is incorporated herein by reference.

Paper No. IADC/SPE 122281, entitled "Managed-Pressure Drilling: What It Is and What It is Not", by Malloy, et. al., Feb. 12-13, 2009, an entire copy of which is incorporated herein by reference.

Paper No. SPE 124891, entitled "Reelwell Drilling Method—A Unique Combination of MPD and Liner Drilling", by Vestavik of ReelWell a.s., et. al., Sep. 8-11, 2009, an entire copy of which is incorporated herein by reference.

U.S. Pat. No. 6,585,043, entitled "Friction Reducing Tool", inventor Geoffrey Neil Murray, issued Jul. 1, 2003, assigned to Weatherford, an entire copy of which is incorporated herein by reference.

U.S. Pat. No. 7,025,136, entitled "Torque Reduction Tool", inventors Tulloch, et. al., issued Apr. 11, 2006, an entire copy of which is incorporated herein by reference.

U.S. Pat. No. 7,025,142, entitled "Bi-Directional Thruster Pig Apparatus and Method of Utilizing Same", inventor James R. Crawford, issued Apr. 11, 2006, an entire copy of which is incorporated herein by reference.

Paper No. OTC 8675, entitled "Extended Reach Pipeline Blockage Remediation", by Baugh, et. al., May 4-7, 1998, an entire copy of which is incorporated herein by reference.

Standard Text Books on Fluid Flow and Mud Properties Include

The book entitled "Fluid Mechanics and Hydraulics", Third Edition, by Giles, et. al., Schaum's Outline Series, McGraw-Hill, 1994, an entire copy of which is incorporated herein by reference.

The book entitled "Well Production Practical Handbook", by H. Cholet, Editions Technip, 2008, an entire copy of which is incorporated herein by reference.

The book entitled "Applied Drilling Engineering", by Bourgoyne, Jr., et. al., Society of Petroleum Engineers, 1991, an entire copy of which is incorporated herein by reference.

The book entitled "Petroleum Well Construction", by Economides, et. al., John Wiley & Sons, 1988, an entire copy of which is incorporated herein by reference.

The book entitled "Drilling Mud and Cement Slurry Rheology Manual", Edited by R. Monicard, Editions Technip, Gulf Publishing Company, 1982, an entire copy of which is incorporated herein by reference.

Other Standard References

The book entitled "Dictionary of Petroleum Exploration, Drilling & Production", by Norman J. Hyne, Ph.D., Pennwell Publishing Company, 1991, an entire copy of which is incorporated herein by reference.

The book entitled "The Illustrated Petroleum Reference Dictionary", 4th Edition, Edited by Robert D. Langenkamp, Pennwell Publishing Company, 1994, an entire copy of which is incorporated herein by reference.

The book entitled "Handbook of Oil Industry Terms & Phrases", R. D. Langenkamp, Pennwell Books, Pennwell Publishing Company, Tulsa, Okla., 5th Edition, 1994, an entire copy of which is incorporated herein by reference.

Rotary Drilling Series and Related References

Typical procedures used in the oil and gas industries to drill and complete wells are well documented. For example, such procedures are documented in the entire "Rotary Drilling Series" published by the Petroleum Extension Service of The University of Texas at Austin, Austin, Tex. that is incorporated herein by reference in its entirety that is comprised of the following:

Unit I—"The Rig and Its Maintenance" (12 Lessons);
Unit II—"Normal Drilling Operations" (5 Lessons);
Unit III—Nonroutine Rig Operations (4 Lessons);
Unit IV—Man Management and Rig Management (1 Lesson);
and Unit V—Offshore Technology (9 Lessons).

All of the individual Glossaries of all of the above Lessons in this Rotary Drilling Series are also explicitly incorporated herein by reference, and all definitions in those Glossaries are also incorporated herein by reference.

Additional procedures used in the oil and gas industries to drill and complete wells are well documented in the series entitled "Lessons in Well Servicing and Workover" published by the Petroleum Extension Service of The University of Texas at Austin, Austin, Tex. that is incorporated herein by reference in its entirety that is comprised of all 12 Lessons. All of the individual Glossaries of all of the above Lessons are incorporated herein by reference, and definitions in those Glossaries are also incorporated herein by reference.

Reference Related to Feedback and Control Systems

The book entitled "Feedback and Control Systems", Second Edition, by DiStefano, III, Ph.D., et. al., Schaum's Outline Series, McGraw-Hill, 1990, an entire copy of which is incorporated herein by reference, which describes the general features used in feedback control systems particularly including Chapter 2 "Control Systems Terminology"; and Chapter 7, "Block Diagram Algebra and Transfer Functions of Systems".

Additional References Related to Reelwell

Paper No. SPE 96412, entitled "New Concept for Drilling Hydraulics", by Vestavik of ReelWell a.s., Sep. 6-9, 2005, an entire copy of which is incorporated herein by reference.

Paper No. SPE 116838, entitled "Feasibility Study of Combining Drilling with Casing and Expandable Casing", by Shen, et. al., Oct. 28-30, 2006, an entire copy of which is incorporated herein by reference.

Paper No. SPE/IADC 119491, entitled "Reelwell Drilling Method", by Vestavik of ReelWell a.s., et. al., Mar. 17-19, 2009, an entire copy of which is incorporated herein by reference.

Paper No. SPE 123953, entitled "Application of Reelwell Drilling Method in Offshore Drilling to Address Many Related Challenges", by Rajabi, et. al., Aug. 4-6, 2009, an entire copy of which is incorporated herein by reference.

Paper No. SPE/IADC 125556, entitled "A New Riserless Method Enable Us to Apply Managed Pressure Drilling in Deepwater Environments", by Rajabi, et. al, Oct. 26-28, 2009, an entire copy of which is incorporated herein by reference.

Paper No. IADC/SPE 126148, entitled "Riserless Reelwell Drilling Method to Address Many Deepwater Drilling Challenges", by Rajabi, et. al., Feb. 2-4, 2010, an entire copy of which is incorporated herein by reference.

References Related to Thruster Pigs

U.S. Pat. No. 6,315,498, entitled "Thruster Pig Apparatus For Injecting Tubing Down Pipelines", inventor Benton F. Baugh, issued Nov. 13, 2001, an entire copy of which is incorporated herein by reference.

In the following, to save space, U.S. Pat. No. 6,315,498 will be abbreviated as U.S. Pat. No. 6,315,498, and other references will be similarly shorted. References cited in U.S. Pat. No. 6,315,498 include the following, entire copies of which are incorporated herein by reference: U.S. Pat. No. 3,467,196 entitled "Method for running tubing using fluid pressure"; U.S. Pat. No. 3,495,546 entitled "Speed control device for pipeline inspection apparatus"; U.S. Pat. No. 3,525,401 entitled "Pumpable plastic pistons and their use"; U.S. Pat. No. 3,763,896 entitled "Plugging a home service sewer line"; U.S. Pat. No. 3,827,487 entitled "Tubing injector and stuffing box construction"; U.S. Pat. No. 4,073,302 entitled "Cleaning apparatus for sewer pipes and the like"; U.S. Pat. No. 4,360,290 entitled "Internal pipeline plug for deep subsea pipe-to-pipe pull-in connection operations"; U.S. Pat. No. 4,585,061 entitled "Apparatus for inserting and withdrawing coiled tubing with respect to a well"; U.S. Pat. No. 4,729,429 entitled "Hydraulic pressure propelled device for making measurements and interventions during injection or production in a deflected well"; U.S. Pat. No. 4,756,510 entitled "Method and system for installing fiber optic cable and the like in fluid transmission pipelines"; U.S. Pat. No. 4,919,204 entitled "Apparatus and methods for cleaning a well"; U.S. Pat. No. 5,069,285 entitled "Dual wall well development tool"; U.S. Pat. No. 5,180,009 entitled "Wireline delivery tool"; U.S. Pat. No. 5,188,174 entitled "Apparatus for inserting and withdrawing coil tubing into a well"; U.S. Pat. No. 5,208,936 entitled "Variable speed pig for pipelines"; U.S. Pat. No. 5,209,304 entitled "Propulsion apparatus for positioning selected tools in tubular members"; U.S. Pat. No. 5,309,990 entitled "Coiled tubing injector"; U.S. Pat. No. 5,309,993 entitled "Chevron seal for a well tool"; U.S. Pat. No. 5,316,094 entitled "Well orienting tool and/or thruster"; U.S. Pat. No. 5,429,194 entitled "Method for inserting a wireline inside coiled tubing"; U.S. Pat. No. 5,445,224 entitled "Hydrostatic control valve"; U.S. Pat. No. 5,447,200 entitled "Method and apparatus for downhole sand clean-out operations in the petroleum industry"; U.S. Pat. No. 5,494,103 entitled "Well jetting apparatus"; U.S. Pat. No. 5,497,807 entitled "Apparatus for introducing sealant into a clearance between an existing pipe and a replacement pipe"; U.S. Pat. No. 5,566,764 entitled "Improved coil tubing injector unit"; U.S. Pat. No. 5,692,563 entitled "Tubing friction reducer";

U.S. Pat. No. 5,695,009 entitled "Downhole oil well tool running and pulling with hydraulic release using deformable ball valving member"; U.S. Pat. No. 5,704,393 entitled "Coiled tubing apparatus"; U.S. Pat. No. 5,795,402 entitled "Apparatus and method for removal of paraffin deposits in pipeline systems"; U.S. Pat. No. 6,003,606 entitled "Puller-thruster downhole tool"; and U.S. Pat. No. 6,024,515 entitled "Live service pipe insertion apparatus and method". Again, entire copies of all the references cited above are incorporated herein by reference.

Further, other patents cite U.S. Pat. No. 6,315,498, which are listed as follows, entire copies of which are incorporated herein by reference: U.S. Pat. No. 7,406,738 entitled "Thruster pig"; U.S. Pat. No. 7,279,052 entitled "Method for hydrate plug removal"; U.S. Pat. No. 7,044,226 entitled "Method and a device for removing a hydrate plug"; U.S. Pat. No. 7,025,142 entitled "Bi-directional thruster pig apparatus and method of utilizing same"; U.S. Pat. No. 6,651,744 entitled "Bi-directional thruster pig apparatus and method of utilizing same"; U.S. Pat. No. 6,481,930 entitled "Apparatus and method for inserting and removing a flexible first material into a second material"; and U.S. Pat. No. 6,382,875 entitled "Process for laying a tube in a duct and device for pressurizing a tube during laying". Again, entire copies of all the references cited above are incorporated herein by reference.

References Related to Managed Pressure Drilling

Paper No. IADC/SPE 143093, entitled "Managed Pressure Drilling Enables Drilling Beyond the Conventional Limit on an HP/HT Deepwater Well in the Mediterranean Sea", by Kemche, et. al., Apr. 5-6, 2011, an entire copy of which is incorporated herein by reference.

Paper No. IADC/DPE 143102, entitled "The Challenges and Results of Applying Managed Pressure Drilling Techniques on an Exploratory Offshore Well in India—A Case History", by Ray and Vudathu, Apr. 5-6, 2011, an entire copy of which is incorporated herein by reference.

References Related to Closed Loop Drilling Systems

U.S. Pat. No. 5,842,149, entitled "Closed Loop Drilling System", inventors of Harrell, et. al., issued Nov. 24, 1998, an entire copy of which is incorporated herein by reference.

In the following, to save space, U.S. Pat. No. 5,842,149 will be abbreviated as U.S. Pat. No. 582,149, and other references will be similarly shorted. References cited in U.S. Pat. No. 582,149 include the following, entire copies of which are incorporated herein by reference: U.S. Pat. No. 3,497,019 entitled "Automatic drilling system"; U.S. Pat. No. 4,662,458 entitled "Method and apparatus for bottom hole measurement"; U.S. Pat. No. 4,695,957 entitled "Drilling monitor with downhole torque and axial load transducers"; U.S. Pat. No. 4,794,534 entitled "Method of drilling a well utilizing predictive simulation with real time data"; U.S. Pat. No. 4,854,397 entitled "System for directional drilling and related method of use"; U.S. Pat. No. 4,972,703 entitled "Method of predicting the torque and drag in directional wells"; U.S. Pat. No. 5,064,006 entitled "Downhole combination tool"; U.S. Pat. No. 5,163,521 entitled "System for drilling deviated boreholes"; U.S. Pat. No. 5,230,387 entitled "Downhole combination tool"; U.S. Pat. No. 5,250,806 entitled "Stand-off compensated formation measurements apparatus and method". Again, entire copies of all the references cited above are incorporated herein by reference.

Further, other patents cite U.S. Pat. No. 5,842,149, which are listed as follows, entire copies of which are incorporated herein by reference: U.S. Pat. No. RE42,245 entitled "System and method for real time reservoir management"; U.S. Pat. No. 7,866,415 entitled "Steering device for downhole tools"; U.S. Pat. No. 7,866,413 entitled "Methods for designing and fabricating earth-boring rotary drill bits having predictable walk characteristics and drill bits configured to exhibit predicted walk characteristics"; U.S. Pat. No. 7,857,052 entitled "Stage cementing methods used in casing while drilling"; U.S. Pat. No. RE41,999 entitled "System and method for real time reservoir management"; U.S. Pat. No. 7,849,934 entitled "Method and apparatus for collecting drill bit performance data"; U.S. Pat. No. 7,832,500 entitled "Wellbore drilling method"; U.S. Pat. No. 7,823,655 entitled "Directional drilling control"; U.S. Pat. No. 7,802,634 entitled "Integrated quill position and toolface orientation display"; U.S. Pat. No. 7,730,965 entitled "Retractable joint and cementing shoe for use in completing a wellbore"; U.S. Pat. No. 7,712,523 entitled "Top drive casing system"; U.S. Pat. No. 7,669,656 entitled "Method and apparatus for rescaling measurements while drilling in different environments"; U.S. Pat. No. 7,650,944 entitled "Vessel for well intervention"; U.S. Pat. No. 7,645,124 entitled "Estimation and control of a resonant plant prone to stick-slip behavior"; U.S. Pat. No. 7,617,866 entitled "Methods and apparatus for connecting tubulars using a top drive"; U.S. Pat. No. 7,607,494 entitled "Earth penetrating apparatus and method employing radar imaging and rate sensing"; U.S. Pat. No. 7,604,072 entitled "Method and apparatus for collecting drill bit performance data"; U.S. Pat. No. 7,584,165 entitled "Support apparatus, method and system for real time operations and maintenance"; U.S. Pat. No. 7,509,722 entitled "Positioning and spinning device"; U.S. Pat. No. 7,510,026 entitled "Method and apparatus for collecting drill bit performance data"; U.S. Pat. No. 7,506,695 entitled "Method and apparatus for collecting drill bit performance data"; U.S. Pat. No. 7,503,397 entitled "Apparatus and methods of setting and retrieving casing with drilling latch and bottom hole assembly"; U.S. Pat. No. 7,500,529 entitled "Method and apparatus for predicting and controlling secondary kicks while dealing with a primary kick experienced when drilling an oil and gas well"; U.S. Pat. No. 7,497,276 entitled "Method and apparatus for collecting drill bit performance data"; U.S. Pat. No. 7,413,034 entitled "Steering tool"; U.S. Pat. No. 7,413,020 entitled "Full bore lined wellbores"; U.S. Pat. No. 7,395,877 entitled "Apparatus and method to reduce fluid pressure in a wellbore"; U.S. Pat. No. 7,370,707 entitled "Method and apparatus for handling wellbore tubulars"; U.S. Pat. No. 7,363,717 entitled "System and method for using rotation sensors within a borehole"; U.S. Pat. No. 7,360,594 entitled "Drilling with casing latch"; U.S. Pat. No. 7,358,725 entitled "Correction of NMR artifacts due to axial motion and spin-lattice relaxation"; U.S. Pat. No. 7,350,410 entitled "System and method for measurements of depth and velocity of instrumentation within a wellbore"; U.S. Pat. No. 7,334,650 entitled "Apparatus and methods for drilling a wellbore using casing"; U.S. Pat. No. 7,325,610 entitled "Methods and apparatus for handling and drilling with tubulars or casing"; U.S. Pat. No. 7,313,480 entitled "Integrated drilling dynamics system"; U.S. Pat. No. 7,311,148 entitled "Methods and apparatus for wellbore construction and completion"; U.S. Pat. No. 7,303,022 entitled "Wired casing"; U.S. Pat. No. 7,301,338 entitled "Automatic adjustment of NMR pulse sequence to optimize SNR based on real time analysis"; U.S. Pat. No. 7,287,605 entitled "Steerable drilling apparatus having a differential displacement side-force exerting mechanism"; U.S. Pat. No. 7,284,617 entitled "Casing running head"; U.S. Pat. No. 7,277,796 entitled "System and methods of characterizing a hydrocarbon reservoir"; U.S. Pat. No. 7,264,067 entitled "Method of drilling and completing multiple wellbores inside a single caisson"; U.S. Pat. No. 7,245,101 entitled "System and method for monitoring and control"; U.S. Pat. No. 7,234,539 entitled "Method and apparatus for rescaling measurements while drilling in different environments"; U.S. Pat. No. 7,230,543 entitled "Downhole clock synchronization apparatus and methods for use in a borehole drilling environment"; U.S. Pat. No. 7,228,901 entitled "Method and apparatus for cementing drill strings in place for one pass drilling and completion of oil and gas wells"; U.S. Pat. No. 7,225,550 entitled "System and method for using microgyros to measure the orientation of a survey tool within a borehole"; U.S. Pat. No. 7,219,730 entitled "Smart cementing systems"; U.S. Pat. No. 7,219,744 entitled "Method and apparatus for connecting tubulars using a top drive"; U.S. Pat. No. 7,219,747 entitled "Providing a local response to a local condition in an oil well"; U.S. Pat. No. 7,216,727 entitled "Drilling bit for drilling while running casing"; U.S. Pat. No. 7,213,656 entitled "Apparatus and method for facilitating the connection of tubulars using a top drive"; U.S. Pat. No. 7,209,834 entitled "Method and apparatus for estimating distance to or from a geological target while drilling or logging"; U.S. Pat. No. 7,195,083 entitled "Three dimensional steering system and method for steering bit to drill borehole"; U.S. Pat. No. 7,193,414 entitled "Downhole NMR processing"; U.S. Pat. No. 7,191,840 entitled "Casing running and drilling system"; U.S. Pat. No. 7,188,685 entitled "Hybrid rotary steerable system"; U.S. Pat. No. 7,188,687 entitled "Downhole filter"; U.S. Pat. No. 7,172,038 entitled "Well system"; U.S. Pat. No. 7,168,507 entitled "Recalibration of downhole sensors"; U.S. Pat. No. 7,165,634 entitled "Method and apparatus for cementing drill strings in place for one pass drilling and completion of oil and gas wells"; U.S. Pat. No. 7,158,886 entitled "Automatic control system and method for bottom hole pressure in the underbalance drilling"; U.S. Pat. No. 7,147,068 entitled "Methods and apparatus for cementing drill strings in place for one pass drilling and completion of oil and gas wells"; U.S. Pat. No. 7,143,844 entitled "Earth penetrating apparatus and method employing radar imaging and rate sensing"; U.S. Pat. No. 7,140,445 entitled "Method and apparatus for drilling with casing"; U.S. Pat. No. 7,137,454 entitled "Apparatus for facilitating the connection of tubulars using a top drive"; U.S. Pat. No. 7,136,795 entitled "Control method for use with a steerable drilling system"; U.S. Pat. No. 7,131,505 entitled "Drilling with concentric strings of casing"; U.S. Pat. No. 7,128,161 entitled "Apparatus and methods for facilitating the connection of tubulars using a top drive"; U.S. Pat. No. 7,128,154 entitled "Single-direction cementing plug"; U.S. Pat. No. 7,117,957 entitled "Methods for drilling and lining a wellbore"; U.S. Pat. No. 7,117,605 entitled "System and method for using microgyros to measure the orientation of a survey tool within a borehole"; U.S. Pat. No. 7,111,692 entitled "Apparatus and method to reduce fluid pressure in a wellbore"; U.S. Pat. No. 7,108,084 entitled "Methods and apparatus for cementing drill strings in place for one pass drilling and completion of oil and gas wells"; U.S. Pat. No. 7,100,710 entitled "Methods and apparatus for cementing drill strings in place for one pass drilling and completion of oil and gas wells"; U.S. Pat. No. 7,093,675 entitled "Drilling method"; U.S. Pat. No. 7,090,021 entitled "Apparatus for connecting tublars using a top drive"; U.S. Pat. No. 7,090,023 entitled "Apparatus and methods for drilling with casing"; U.S. Pat. No. 7,082,821 entitled "Method and apparatus for detecting torsional vibration with a downhole pressure sensor"; U.S. Pat. No. 7,083,005 entitled "Apparatus and method of drilling with casing"; U.S. Pat. No. 7,073,598 entitled "Apparatus and methods for tubular makeup interlock"; U.S. Pat. No. 7,054,750 entitled "Method and system to model, measure, recalibrate, and optimize control of the drilling of a borehole"; U.S. Pat. No. 7,048,050 entitled "Method and apparatus for cementing drill strings in place for one pass drilling and completion of oil and gas wells"; U.S. Pat. No. 7,046,584 entitled "Compensated ensemble crystal oscillator for use in a well borehole system"; U.S. Pat. No. 7,043,370 entitled "Real time processing of multicomponent induction tool data in highly deviated and horizontal wells"; U.S. Pat. No. 7,036,610 entitled "Apparatus and method for completing oil and gas wells"; U.S. Pat. No. 7,028,789 entitled "Drilling assembly with a steering device for coiled-tubing operations"; U.S. Pat. No. 7,026,950 entitled "Motor pulse controller"; U.S. Pat. No. 7,027,922 entitled "Deep resistivity transient method for MWD applications using asymptotic filtering"; U.S. Pat. No. 7,020,597 entitled "Methods for evaluating and improving drilling operations"; U.S. Pat. No. 7,002,484 entitled "Supplemental referencing techniques in borehole surveying"; U.S. Pat. No. 6,985,814 entitled "Well twinning techniques in borehole surveying"; U.S. Pat. No. 6,968,909 entitled "Realtime control of a drilling system using the output from combination of an earth model and a drilling process model"; U.S. Pat. No. 6,957,575 entitled "Apparatus for weight on bit measurements, and methods of using same"; U.S. Pat. No. 6,957,580 entitled "System and method for measurements of depth and velocity of instrumentation within a wellbore"; U.S. Pat. No. 6,944,547 entitled "Automated rig control management system"; U.S. Pat. No. 6,937,023 entitled "Passive ranging techniques in borehole surveying"; U.S. Pat. No. 6,923,273 entitled "Well system"; U.S. Pat. No. 6,899,186 entitled "Apparatus and method of drilling with casing"; U.S. Pat. No. 6,883,638 entitled "Accelerometer transducer used for seismic recording"; U.S. Pat. No. 6,882,937 entitled "Downhole referencing techniques in borehole surveying"; U.S. Pat. No. 6,868,906 entitled "Closed-loop conveyance systems for well servicing"; U.S. Pat. No. 6,863,137 entitled "Well system"; U.S. Pat. No. 6,857,486 entitled "High power umbilicals for subterranean electric drilling machines and remotely operated vehicles"; U.S. Pat. No. 6,854,533 entitled "Apparatus and method for drilling with casing"; U.S. Pat. No. 6,845,819 entitled "Down hole tool and method"; U.S. Pat. No. 6,843,332 entitled "Three dimensional steerable system and method for steering bit to drill borehole"; U.S. Pat. No. 6,837,313 entitled "Apparatus and method to reduce fluid pressure in a wellbore"; U.S. Pat. No. 6,814,142 entitled "Well control using pressure while drilling measurements"; U.S. Pat. No. 6,802,215 entitled "Apparatus for weight on bit measurements, and methods of using same"; U.S. Pat. No. 6,785,641 entitled "Simulating the dynamic response of a drilling tool assembly and its application to drilling tool assembly design optimization and drilling performance optimization"; U.S. Pat. No. 6,755,263 entitled "Underground drilling device and method employing down-hole radar"; U.S. Pat. No. 6,727,696 entitled "Downhole NMR processing"; U.S. Pat. No. 6,719,071 entitled "Apparatus and methods for drilling"; U.S. Pat. No. 6,719,069 entitled "Underground boring machine employing navigation sensor and adjustable steering"; U.S. Pat. No. 6,662,110 entitled "Drilling rig closed loop controls"; U.S. Pat. No. 6,659,200 entitled "Actuator assembly and method for actuating downhole assembly"; U.S. Pat. No. 6,609,579 entitled "Drilling assembly with a steering device for coiled-tubing operations"; U.S. Pat. No. 6,607,044 entitled "Three dimensional steerable system and method for steering bit to drill borehole"; U.S. Pat. No. 6,601,658 entitled "Control method for use with a steerable drilling system";

U.S. Pat. No. 6,598,687 entitled "Three dimensional steerable system"; U.S. Pat. No. 6,484,818 entitled "Horizontal directional drilling machine and method employing configurable tracking system interface"; U.S. Pat. No. 6,470,976 entitled "Excavation system and method employing adjustable down-hole steering and above-ground tracking"; U.S. Pat. No. 6,467,341 entitled "Accelerometer caliper while drilling"; U.S. Pat. No. 6,469,639 entitled "Method and apparatus for low power, micro-electronic mechanical sensing and processing"; U.S. Pat. No. 6,443,242 entitled "Method for wellbore operations using calculated wellbore parameters in real time"; U.S. Pat. No. 6,427,783 entitled "Steerable modular drilling assembly"; U.S. Pat. No. 6,397,946 entitled "Closed-loop system to compete oil and gas wells"; U.S. Pat. No. 6,386,297 entitled "Method and apparatus for determining potential abrasivity in a wellbore"; U.S. Pat. No. 6,378,627 entitled "Autonomous downhole oilfield tool"; U.S. Pat. No. 6,353,799 entitled "Method and apparatus for determining potential interfacial severity for a formation"; U.S. Pat. No. 6,328,119 entitled "Adjustable gauge downhole drilling assembly"; U.S. Pat. No. 6,315,062 entitled "Horizontal directional drilling machine employing inertial navigation control system and method"; U.S. Pat. No. 6,308,787 entitled "Real-time control system and method for controlling an underground boring machine"; U.S. Pat. No. 6,296,066 entitled "Well system"; U.S. Pat. No. 6,276,465 entitled "Method and apparatus for determining potential for drill bit performance"; U.S. Pat. No. 6,267,185 entitled "Apparatus and method for communication with downhole equipment using drill string rotation and gyroscopic sensors"; U.S. Pat. No. 6,257,356 entitled "Magnetorheological fluid apparatus, especially adapted for use in a steerable drill string, and a method of using same"; U.S. Pat. No. 6,256,603 entitled "Performing geoscience interpretation with simulated data"; U.S. Pat. No. 6,255,962 entitled "Method and apparatus for low power, micro-electronic mechanical sensing and processing"; U.S. Pat. No. 6,237,404 entitled "Apparatus and method for determining a drilling mode to optimize formation evaluation measurements"; U.S. Pat. No. 6,233,498 entitled "Method of and system for increasing drilling efficiency"; U.S. Pat. No. 6,208,585 entitled "Acoustic LWD tool having receiver calibration capabilities"; U.S. Pat. No. 6,205,851 entitled "Method for determining drill collar whirl in a bottom hole assembly and method for determining borehole size"; U.S. Pat. No. 6,166,654 entitled "Drilling assembly with reduced stick-slip tendency"; U.S. Pat. No. 6,166,994 entitled "Seismic detection apparatus and method"; U.S. Pat. No. 6,152,246 entitled "Method of and system for monitoring drilling parameters"; U.S. Pat. No. 6,142,228 entitled "Downhole motor speed measurement method"; U.S. Pat. No. 6,101,444 entitled "Numerical control unit for wellbore drilling"; U.S. Pat. No. 6,073,079 entitled "Method of maintaining a borehole within a multidimensional target zone during drilling"; U.S. Pat. No. 6,044,326 entitled "Measuring borehole size"; U.S. Pat. No. 6,035,952 entitled "Closed loop fluid-handling system for use during drilling of wellbores"; U.S. Pat. No. 6,012,015 entitled "Control model for production wells". Again, entire copies of all the references cited above are incorporated herein by reference.

Still further, the Abstract for U.S. Pat. No. 5,842,149 states: "The present invention provides a closed-loop drilling system for drilling oilfield boreholes. The system includes a drilling assembly with a drill bit, a plurality of sensors for providing signals relating to parameters relating to the drilling assembly, borehole, and formations around the drilling assembly. Processors in the drilling system process sensors signal and compute drilling parameters based on models and programmed instructions provided to the drilling system that will yield further drilling at enhanced drilling rates and with extended drilling assembly life. The drilling system then automatically adjusts the drilling parameters for continued drilling. The system continually or periodically repeats this process during the drilling operations. The drilling system also provides severity of certain dysfunctions to the operator and a means for simulating the drilling assembly behavior prior to effecting changes in the drilling parameters."

Yet further, claim 1 of U.S. Pat. No. 5,842,149 states the following: "What is claimed is: 1. An automated drilling system for drilling oilfield wellbores at enhanced rates of penetration and with extended life of drilling assembly, comprising: (a) a tubing adapted to extend from the surface into the wellbore; (b) a drilling assembly comprising a drill bit at an end thereof and a plurality of sensors for detecting selected drilling parameters and generating data representative of said drilling parameters; (c) a computer comprising at least one processor for receiving signals representative of said data; (d) a force application device for applying a predetermined force on the drill bit within a range of forces; (e) a force controller for controlling the operation of the force application device to apply the predetermined force; (f) a source of drilling fluid under pressure at the surface for supplying a drilling fluid (g) a fluid controller for controlling the operation of the fluid source to supply a desired predetermined pressure and flow rate of the drilling fluid; (h) a rotator for rotating the bit at a predetermined speed of rotation within a range of rotation speeds; (i) receivers associated with the computer for receiving agnate signals representative of the data; (j) transmitters associated with the computer for sending control signals directing the force controller, fluid controller and rotator controller to operate the force application device, source of drilling fluid under pressure and rotator to achieve enhanced rates of penetration and extended drilling assembly life."

References Related to Closed-Loop Drilling Rig Controls

U.S. Pat. No. 6,662,110, entitled "Drilling Rig Closed Loop Controls", inventors of Bargach, et. al., issued Dec. 9, 2003, an entire copy of which is incorporated herein by reference.

In the following, to save space, U.S. Pat. No. 6,662,110 will be abbreviated as U.S. Pat. No. 6,662,110, and other references will be similarly shorted. References cited in U.S. Pat. No. 6,662,110 include the following, entire copies of which are incorporated herein by reference: U.S. Pat. No. 4,019,148 entitled "Lock-in noise rejection circuit"; U.S. Pat. No. 4,254,481 entitled "Borehole telemetry system automatic gain control"; U.S. Pat. No. 4,507,735 entitled "Method and apparatus for monitoring and controlling well drilling parameters";U.S. Pat. No. 4,954,998 entitled "Method for reducing noise in drill string signals"; U.S. Pat. No. 5,160,925 entitled "Short hop communication link for downhole MWD system"; U.S. Pat. No. 5,220,963 entitled "System for controlled drilling of boreholes along planned profile"; U.S. Pat. No. 5,259,468 entitled "Method of dynamically monitoring the orientation of a curved drilling assembly and apparatus"; U.S. Pat. No. 5,269,383 entitled "Navigable downhole drilling system"; U.S. Pat. No. 5,314,030 entitled "System for continuously guided drilling"; U.S. Pat. No. 5,332,048 entitled "Method and apparatus for automatic closed loop drilling system"; U.S. Pat. No. 5,646,611 entitled "System and method for indirectly determining inclination at the bit"; U.S. Pat. No. 5,812,068 entitled "Drilling system with downhole apparatus for determining parameters of interest and for adjusting drilling direction in response thereto"; U.S. Pat. No. 5,842,149 entitled "Closed loop drilling system"; U.S. Pat. No. 5,857,530 entitled "Vertical positioning system for drilling boreholes"; U.S. Pat. No. 5,880,680 entitled "Apparatus and method for determining boring direction when boring underground"; U.S. Pat. No. 6,012,015 entitled "Control model for production wells"; U.S. Pat. No. 6,021,377 entitled "Drilling system utilizing downhole dysfunctions for determining corrective actions and simulating drilling conditions"; U.S. Pat. No. 6,023,658 entitled "Noise detection and suppression system and method for wellbore telemetry"; U.S. Pat. No. 6,088,294 entitled "Drilling system with an acoustic measurement-while-driving system for determining parameters of interest and controlling the drilling direction"; U.S. Pat. No. 6,092,610 entitled "Actively controlled rotary steerable system and method for drilling wells"; U.S. Pat. No. 6,101,444 entitled "Numerical control unit for wellbore drilling"; U.S. Pat. No. 6,206,108 entitled "Drilling system with integrated bottom hole assembly"; U.S. Pat. No. 6,233,524 entitled "Closed loop drilling system"; U.S. Pat. No. 6,272,434 entitled "Drilling system with downhole apparatus for determining parameters of interest and for adjusting drilling direction in response thereto"; U.S. Pat. No. 6,296,066 entitled "Well system"; U.S. Pat. No. 6,308,787 entitled "Real-time control system and method for controlling an underground boring machine"; U.S. Pat. No. 6,310,559 entitled "Monitoring performance of downhole equipment"; U.S. Pat. No. 6,405,808 entitled "Method for increasing the efficiency of drilling a wellbore, improving the accuracy of its borehole trajectory and reducing the corresponding computed ellise of uncertainty"; U.S. Pat. No. 6,415,878 entitled "Steerable rotary drilling device"; U.S. Pat. No. 6,419,014 entitled "Apparatus and method for orienting a downhole tool"; US20020011358 entitled "Steerable drill string"; US20020088648 entitled "Drilling assembly with a steering device for coiled-tubing operations". Again, entire copies of all the references cited above are incorporated herein by reference.

Further, other patents cite U.S. Pat. No. 6,662,110, which are listed as follows, entire copies of which are incorporated herein by reference: U.S. Pat. No. 7,921,937 entitled "Drilling components and systems to dynamically control drilling dysfunctions and methods of drilling a well with same"; U.S. Pat. No. 7,832,500 entitled "Wellbore drilling method"; U.S. Pat. No. 7,823,656 entitled "Method for monitoring drilling mud properties"; U.S. Pat. No. 7,814,989 entitled "System and method for performing a drilling operation in an oilfield"; U.S. Pat. No. 7,528,946 entitled "System for detecting deflection of a boring tool"; U.S. Pat. No. 7,461,831 entitled "Telescoping workover rig"; U.S. Pat. No. 7,222,681 entitled "Programming method for controlling a downhole steering tool"; U.S. Pat. No. 7,128,167 entitled "System and method for rig state detection"; U.S. Pat. No. 7,054,750 entitled "Method and system to model, measure, recalibrate, and optimize control of the drilling of a borehole"; U.S. Pat. No. 6,892,812 entitled "Automated method and system for determining the state of well operations and performing process evaluation"; U.S. Pat. No. 6,854,532 entitled "Subsea wellbore drilling system for reducing bottom hole pressure". Again, entire copies of all the references cited above are incorporated herein by reference.

References Related to Closed-Loop Circulating Systems

U.S. Pat. No. 7,650,950, entitled "Drilling System and Method", inventor of Leuchenberg, issued Jan. 26, 2010, an entire copy of which is incorporated herein by reference.

In the following, to save space, U.S. Pat. No. 7,650,950 will be abbreviated as U.S. Pat. No. 7,650,950, and other references will be similarly shorted. References cited in U.S. Pat. No. 7,650,950 include the following, entire copies of which are incorporated herein by reference: U.S. Pat. No. 3,429,385 entitled "Apparatus for controlling the pressure in a well"; U.S. Pat. No. 3,443,643 entitled "Apparatus for controlling the pressure in a well"; U.S. Pat. No. 3,470,971 entitled "Apparatus and method for automatically controlling fluid pressure in a well bore"; U.S. Pat. No. 3,470,972 entitled "Bottom-hole pressure regulation apparatus"; U.S. Pat. No. 3,550,696 entitled "Control of a well"; U.S. Pat. No. 3,552,502 entitled "Apparatus for automatically controlling the killing of oil and gas wells"; U.S. Pat. No. 3,677,353 entitled "Apparatus for controlling oil well pressure"; U.S. Pat. No. 3,827,511 entitled "Apparatus for controlling well pressure"; U.S. Pat. No. 4,440,239 entitled "Method and apparatus for controlling the flow of drilling fluid in a wellbore"; U.S. Pat. No. 4,527,425 entitled "System for detecting blow out and lost circulation in a borehole"; U.S. Pat. No. 4,570,480 entitled "Method and apparatus for determining formation pressure"; U.S. Pat. No. 4,577,689 entitled "Method for determining true fracture pressure"; U.S. Pat. No. 4,606,415 entitled "Method and system for detecting and identifying abnormal drilling conditions"; U.S. Pat. No. 4,630,675 entitled "Drilling choke pressure limiting control system"; U.S. Pat. No. 4,653,597 entitled "Method for circulating and maintaining drilling mud in a wellbore"; U.S. Pat. No. 4,700,739 entitled "Pneumatic well casing pressure regulating system"; U.S. Pat. No. 4,709,900 entitled "Choke valve especially used in oil and gas wells"; U.S. Pat. No. 4,733,232 entitled "Method and apparatus for borehole fluid influx detection"; U.S. Pat. No. 4,733,233 entitled "Method and apparatus for borehole fluid influx detection"; U.S. Pat. No. 4,840,061 entitled "Method of detecting a fluid influx which could lead to a blow-out during the drilling of a borehole"; U.S. Pat. No. 4,867,254 entitled "Method of controlling fluid influxes in hydrocarbon wells"; U.S. Pat. No. 4,878,382 entitled "Method of monitoring the drilling operations by analyzing the circulating drilling mud"; U.S. Pat. No. 5,005,406 entitled "Monitoring drilling mud composition using flowing liquid junction electrodes"; U.S. Pat. No. 5,006,845 entitled "Gas kick detector"; U.S. Pat. No. 5,010,966 entitled "Drilling method"; U.S. Pat. No. 5,063,776 entitled "Method and system for measurement of fluid flow in a drilling rig return line"; U.S. Pat. No. 5,070,949 entitled "Method of analyzing fluid influxes in hydrocarbon wells"; U.S. Pat. No. 5,080,182 entitled "Method of analyzing and controlling a fluid influx during the drilling of a borehole"; U.S. Pat. No. 5,115,871 entitled "Method for the estimation of pore pressure within a subterranean formation"; U.S. Pat. No. 5,144,589 entitled "Method for predicting formation pore-pressure while drilling"; U.S. Pat. No. 5,154,078 entitled "Kick detection during drilling"; U.S. Pat. No. 5,161,409 entitled "Analysis of drilling solids samples"; U.S. Pat. No. 5,168,932 entitled "Detecting outflow or inflow of fluid in a wellbore"; U.S. Pat. No. 5,200,929 entitled "Method for estimating pore fluid pressure"; U.S. Pat. No. 5,205,165 entitled "Method for determining fluid influx or loss in drilling from floating rigs"; U.S. Pat. No. 5,205,166 entitled "Method of detecting fluid influxes"; U.S. Pat. No. 5,305,836 entitled "System and method for controlling drill bit usage and well plan"; U.S. Pat. No. 5,437,308 entitled "Device for remotely actuating equipment comprising a bean-needle system"; U.S. Pat. No. 5,443,128 entitled "Device for remote actuating equipment comprising delay means"; U.S. Pat. No. 5,474,142 entitled "Automatic drilling system"; U.S. Pat. No. 5,635,636 entitled "Method of determining inflow rates from underbalanced wells"; U.S. Pat. No. 5,857,522 entitled "Fluid handling system for use in drilling of wellbores"; U.S. Pat. No. 5,890,549 entitled "Well drilling system with closed circulation of gas drilling fluid and fire suppression apparatus"; U.S. Pat. No. 5,975,219 entitled "Method for controlling entry of a drill-stem into a wellbore to minimize surge pressure"; U.S. Pat. No. 6,035,952 entitled "Closed loop fluid-handling system for use during drilling of wellbores"; U.S. Pat. No. 6,119,772 entitled "Continuous flow cylinder for maintaining drilling fluid circulation while connecting drill string joints"; U.S. Pat. No. 6,176,323 entitled "Drilling systems with sensors for determining properties of drilling fluid downhole"; U.S. Pat. No. 6,189,612 entitled "Subsurface measurement apparatus, system, and process for improved well drilling, control, and production"; U.S. Pat. No. 6,234,030 entitled "Multiphase metering method for multiphase flow"; U.S. Pat. No. 6,240,787 entitled "Method of determining fluid inflow rates"; U.S. Pat. No. 6,325,159 entitled "Offshore drilling system"; U.S. Pat. No. 6,352,129 entitled "Drilling system"; U.S. Pat. No. 6,374,925 entitled "Well drilling method and system"; U.S. Pat. No. 6,394,195 entitled "Methods for the dynamic shut-in of a subsea mudlift drilling system"; U.S. Pat. No. 6,410,862 entitled "Device and method for measuring the flow rate of drill cuttings"; U.S. Pat. No. 6,412,554 entitled "Wellbore circulation system"; U.S. Pat. No. 6,434,435 entitled "Application of adaptive object-oriented optimization software to an automatic optimization oilfield hydrocarbon production management system"; U.S. Pat. No. 6,484,816 entitled "Method and system for controlling well bore pressure"; U.S. Pat. No. 6,527,062 entitled "Well drilling method and system"; U.S. Pat. No. 6,571,873 entitled "Method for controlling bottom-hole pressure during dual-gradient drilling"; U.S. Pat. No. 6,575,244 entitled "System for controlling the operating pressures within a subterranean borehole"; U.S. Pat. No. 6,618,677 entitled "Method and apparatus for determining flow rates"; U.S. Pat. No. 6,668,943 entitled "Method and apparatus for controlling pressure and detecting well control problems during drilling of an offshore well using a gas-lifted riser"; U.S. Pat. No. 6,820,702 entitled "Automated method and system for recognizing well control events"; U.S. Pat. No. 6,904,981 entitled "Dynamic annular pressure control apparatus and method"; U.S. Pat. No. 7,044,237 entitled "Drilling system and method"; U.S. Pat. No. 7,278,496 entitled "Drilling system and method"; US20020112888 entitled "Drilling system and method"; US20030168258 entitled "Method and system for controlling well fluid circulation rate"; US20040040746 entitled "Automated method and system for recognizing well control events"; US20060037781 entitled "Drilling system and method"; US20060113110 entitled "Drilling system and method". Again, entire copies of all the references cited above are incorporated herein by reference.

References Related to Closed-Loop Underbalanced Drilling

U.S. Pat. No. 7,178,592, entitled "Closed Loop Multiphase Underbalanced Drilling Process", inventors of Chitty, et. al., issued Feb. 20, 2007, an entire copy of which is incorporated herein by reference.

In the following, to save space, U.S. Pat. No. 7,178,592 will be abbreviated as U.S. Pat. No. 7,178,592, and other references will be similarly shorted. References cited in U.S. Pat. No. 7,178,592 include the following, entire copies of which are incorporated herein by reference: U.S. Pat. No. 4,020,642 entitled "Compression systems and compressors"; U.S. Pat. No. 4,099,583 entitled "Gas lift system for marine drilling riser"; U.S. Pat. No. 4,319,635 entitled "Method for enhanced oil recovery by geopressured waterflood"; U.S. Pat. No. 4,477,237 entitled "Fabricated reciprocating piston pump"; U.S. Pat. No. 4,553,903 entitled "Two-stage rotary compressor"; U.S. Pat. No. 4,860,830 entitled "Method of cleaning a horizontal wellbore"; U.S. Pat. No. 5,048,603 entitled "Lubricator corrosion inhibitor treatment"; U.S. Pat. No. 5,048,604 entitled "Sucker rod actuated intake valve assembly for insert subsurface reciprocating pumps"; U.S. Pat. No. 5,156,537 entitled "Multiphase fluid mass transfer pump"; U.S. Pat. No. 5,226,482 entitled "Installation and method for the offshore exploitation of small fields"; U.S. Pat. No. 5,295,546 entitled "Installation and method for the offshore exploitation of small fields"; U.S. Pat. No. 5,390,743 entitled "Installation and method for the offshore exploitation of small fields"; U.S. Pat. No. 5,415,776 entitled "Horizontal separator for treating under-balance drilling fluid"; U.S. Pat. No. 5,496,466 entitled "Portable water purification system with double piston pump"; U.S. Pat. No. 5,501,279 entitled "Apparatus and method for removing production-inhibiting liquid from a wellbore"; U.S. Pat. No. 5,638,904 entitled "Safeguarded method and apparatus for fluid communication using coiled tubing, with application to drill stem testing"; U.S. Pat. No. 5,660,532 entitled "Multiphase piston-type pumping system and applications of this system"; U.S. Pat. No. 5,775,442 entitled "Recovery of gas from drilling fluid returns in underbalanced drilling"; U.S. Pat. No. 5,857,522 entitled "Fluid handling system for use in drilling of wellbores"; U.S. Pat. No. 5,992,517 entitled "Downhole reciprocating plunger well pump system"; U.S. Pat. No. 6,007,306 entitled "Multiphase pumping system with feedback loop"; U.S. Pat. No. 6,032,747 entitled "Water-based drilling fluid deacidification process and apparatus"; U.S. Pat. No. 6,035,952 entitled "Closed loop fluid-handling system for use during drilling of wellbores"; U.S. Pat. No. 6,089,322 entitled "Method and apparatus for increasing fluid recovery from a subterranean formation"; U.S. Pat. No. 6,138,757 entitled "Apparatus and method for downhole fluid phase separation"; U.S. Pat. No. 6,164,308 entitled "System and method for handling multiphase flow"; U.S. Pat. No. 6,209,641 entitled "Method and apparatus for producing fluids while injecting gas through the same wellbore"; U.S. Pat. No. 6,216,799 entitled "Subsea pumping system and method for deepwater drilling"; U.S. Pat. No. 6,234,258 entitled "Methods of separation of materials in an under-balanced drilling operation"; U.S. Pat. No. 6,315,813 entitled "Method of treating pressurized drilling fluid returns from a well"; U.S. Pat. No. 6,318,464 entitled "Vapor extraction of hydrocarbon deposits"; U.S. Pat. No. 6,325,147 entitled "Enhanced oil recovery process with combined injection of an aqueous phase and of at least partially water-miscible gas"; U.S. Pat. No. 6,328,118 entitled "Apparatus and methods of separation of materials in an under-balanced drilling operation"; U.S. Pat. No. 6,454,542 entitled "Hydraulic cylinder powered double acting duplex piston pump"; U.S. Pat. No. 6,592,334 entitled "Hydraulic multiphase pump"; U.S. Pat. No. 6,607,607 entitled "Coiled tubing wellbore cleanout"; U.S. Pat. No. 6,629,566 entitled "Method and apparatus for removing water from well-bore of gas wells to permit efficient production of gas"; U.S. Pat. No. 6,668,943 entitled "Method and apparatus for controlling pressure and detecting well control problems during drilling of an offshore well using a gas-lifted riser"; US20030085036 entitled "Combination well kick off and gas lift booster unit"; US20040031622 entitled "Methods and apparatus for drilling with a multiphase pump"; US20040197197 entitled "Multistage compressor for compressing gases"; US20060202122 entitled "Detecting gas in fluids"; US20060207795 entitled "Method of dynamically controlling open hole pressure in a wellbore using wellhead pressure control". Again, entire copies of all the references cited above are incorporated herein by reference.

Further, other patents cite U.S. Pat. No. 7,178,592, which are listed as follows, entire copies of which are incorporated herein by reference: U.S. Pat. No. 7,740,455 entitled "Pumping system with hydraulic pump"; U.S. Pat. No. 7,650,944 entitled "Vessel for well intervention".

References Related to Friction Reduction

U.S. Pat. No. 6,585,043, entitled "Friction Reducing Tool", inventor of Murray issued Jul. 1, 2003, an entire copy of which is incorporated herein by reference.

U.S. Pat. No. 7,025,136, entitled "Torque Reduction Tool", inventors of Tulloch, et. al., issued Apr. 11, 2006, an entire copy of which is incorporated herein by reference.

While the above description contains many specificities, these should not be construed as limitations on the scope of the invention, but rather as exemplification of preferred embodiments thereto. As have been briefly described, there are many possible variations. Accordingly, the scope of the invention should be determined not only by the embodiments illustrated, but by the appended claims and their legal equivalents.

What is claimed is:

1. A method to rotary drill an extended section of a borehole with a rotary drill string that includes at least the step of inserting a mandrel possessing hydraulic means as a threaded component into said drill string comprised of discrete threaded drill pipes that are attached to a rotary drill bit used to drill said extended section of said borehole, whereby said mandrel possessing hydraulic means produces an additional force on said rotary drill bit, whereby said mandrel possessing hydraulic means is located within a segment of said wellbore having a casing, whereby said hydraulic means comprises a wear resistant elastomer material having a first portion bonded to said mandrel and a second portion that makes a sliding and rotating seal with an interior surface of said segment of casing, whereby said elastomer material is disposed within an annular region located between said mandrel and said interior of said segment of casing, whereby said elastomer material also possesses a fluid passageway within said elastomer material that allows clean drilling mud to flow within said annular region in a downhole direction towards said rotary drill bit, whereby said fluid passageway allows clean drilling mud to flow completely through the elastomer material from a first portion of the annular region uphole from said elastomer material to a second portion of the annular region downhole from the elastomer material, and whereby said additional force on said rotary drill bit is generated by clean drilling mud flowing through said fluid passageway within said elastomer material.

2. The method in claim 1 wherein a predetermined additional force is generated by said clean drilling mud flowing through said fluid passageway.

3. The method in claim 2 wherein said predetermined additional force is generated by a particular mud flow rate in gallons per minute of said clean drilling mud flowing through said fluid passageway.

4. The method in claim 3 wherein said clean drilling mud flows from a surface mud pump through said first portion of said annulus located in an uphole direction above said elastomer material.

5. The method in claim 4 wherein said particular mud flow rate in gallons per minute is generated and caused to flow by said surface mud pump.

6. The method in claim 5 wherein said particular mud flow rate is controlled by a computer.

7. The method in claim 1 wherein said elastomer material possesses a first side having a first area that is exposed to a first average ambient wellbore pressure in the direction uphole from said elastomer material and wherein said elastomer material possesses a second side having a second area that is exposed to a second average ambient wellbore pressure in the downhole direction from said elastomer material.

8. The method in claim 7 wherein a first force in the downhole direction is applied to said first side of said elastomer material that is algebraically given by the product of said first average ambient wellbore pressure times said first area.

9. The method in claim 8 wherein a second force in the uphole direction is applied to said second side of said elastomer material that is algebraically given by the product of said second average ambient wellbore pressure times said second area.

10. The method in claim 9 wherein said additional force on said rotary drill bit is provided by the difference between said first force and said second force.

11. The method in claim 10 wherein said passageway passes through said first and second areas.

12. The method in claim 11 wherein said passageway is a round hollow tube that passes through the entire body of said elastomer material that also passes through said first and second areas.

13. The method in claim 12 wherein said round hollow tube has a first length and a first inside diameter.

14. The method in claim 13 wherein said particular mud flow rate is chosen to be 600 gallons per minute, the first length is chosen to be 11 inches, the first inside diameter is chosen to be 0.91 inches, and the determined pressure drop is calculated to be 725 pounds per square inch.

15. The method in claim 13 wherein said first area is equal to said second area.

16. The method in claim 15 wherein said additional force is a predetermined additional force that is the product of said determined pressure drop times said first area.

17. The method in claim 16 wherein said predetermined additional force is applied to said rotary drill bit.

* * * * *